US012502583B2

(12) United States Patent
Morales et al.

(10) Patent No.: US 12,502,583 B2
(45) Date of Patent: Dec. 23, 2025

(54) GOLF CLUB HEADS WITH DYNAMIC BACK WEIGHTS

(71) Applicant: KARSTEN MANUFACTURING CORPORATION, Phoenix, AZ (US)

(72) Inventors: Eric J. Morales, Laveen, AZ (US); Joshua B. Matthews, Chino Hills, CA (US); Cory S. Bacon, Scottsdale, AZ (US); Lance R. White, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 7 days.

(21) Appl. No.: 18/455,616

(22) Filed: Aug. 24, 2023

(65) Prior Publication Data

US 2024/0066365 A1 Feb. 29, 2024

Related U.S. Application Data

(60) Provisional application No. 63/373,445, filed on Aug. 24, 2022.

(51) Int. Cl.
*A63B 53/04* (2015.01)

(52) U.S. Cl.
CPC ..... *A63B 53/0466* (2013.01); *A63B 53/045* (2020.08); *A63B 2053/0491* (2013.01)

(58) Field of Classification Search
CPC ..... A63B 2053/0491
See application file for complete search history.

(56) References Cited

U.S. PATENT DOCUMENTS

| | | | | |
|---|---|---|---|---|
| 6,773,360 | B2 * | 8/2004 | Willett | A63B 60/02 473/409 |
| 6,890,267 | B2 * | 5/2005 | Mahaffey | A63B 60/02 473/328 |
| 7,611,424 | B2 * | 11/2009 | Nagai | A63B 60/02 473/335 |
| 7,775,905 | B2 | 8/2010 | Beach | |
| 7,806,781 | B2 | 10/2010 | Imamoto | |
| 8,016,694 | B2 * | 9/2011 | Llewellyn | A63B 53/04 473/335 |

(Continued)

FOREIGN PATENT DOCUMENTS

| | | | | |
|---|---|---|---|---|
| JP | 2015013078 A | * | 1/2015 | A63B 53/0433 |
| JP | 2019042192 A | * | 3/2019 | |

(Continued)

OTHER PUBLICATIONS

PCT International Search Report and Written Opinion, dated Mar. 21, 2019 from corresponding PCT Int'l Application No. PCT//, filed Dec. 21, 2018.

*Primary Examiner* — Alvin A Hunter

(57) ABSTRACT

A wood-type golf club head includes an angled weight assembly with an adjustable weight disposed within a weight channel. The adjustable weight assembly is positioned at an angle relative to a ground plane to reduce and redirect bending of the golf club head at impact. The reduction and redirection of bending decreases and redirects stress applied to the weight channel at impact to reduce resultant oscillations of the weight channel, which in turn reduces support material for the weight assembly and increases discretionary mass.

16 Claims, 44 Drawing Sheets
(4 of 44 Drawing Sheet(s) Filed in Color)

(56) References Cited

U.S. PATENT DOCUMENTS

| | | | | |
|---|---|---|---|---|
| 8,696,491 | B1 * | 4/2014 | Myers | A63B 60/02 473/345 |
| 9,011,269 | B2 | 4/2015 | Billings | |
| 9,199,145 | B1 * | 12/2015 | Myers | A63B 53/0466 |
| 9,205,312 | B2 * | 12/2015 | Zimmerman | A63B 53/0466 |
| 9,238,162 | B2 * | 1/2016 | Breier | A63B 60/52 |
| 9,259,625 | B2 * | 2/2016 | Sargent | A63B 53/045 |
| 9,289,660 | B1 * | 3/2016 | Myers | A63B 53/0466 |
| 9,333,404 | B2 | 5/2016 | Abbott | |
| 9,381,410 | B2 * | 7/2016 | Golden | A63B 53/0466 |
| 9,387,373 | B1 | 7/2016 | Demille | |
| 9,498,686 | B2 * | 11/2016 | Breier | A63B 53/06 |
| 9,630,069 | B2 * | 4/2017 | Foster | A63B 53/0466 |
| 9,737,770 | B2 | 8/2017 | Bennett | |
| 9,757,630 | B2 * | 9/2017 | Mata | A63B 53/0466 |
| 9,878,223 | B2 * | 1/2018 | Foster | A63B 60/04 |
| 9,914,028 | B1 * | 3/2018 | Cleghorn | A63B 60/02 |
| 9,981,163 | B2 | 5/2018 | Wada | |
| 10,065,094 | B2 | 9/2018 | Wallin | |
| 10,183,203 | B1 * | 1/2019 | Yi | A63B 60/52 |
| 10,391,368 | B2 * | 8/2019 | Cleghorn | A63B 60/52 |
| 10,391,371 | B2 * | 8/2019 | Luttrell | A63B 53/0466 |
| 10,441,856 | B2 | 10/2019 | Rice | |
| 10,441,859 | B2 * | 10/2019 | Willett | A63B 53/0466 |
| 10,463,928 | B2 * | 11/2019 | Stokke | A63B 53/06 |
| 10,518,141 | B2 * | 12/2019 | Goudarzi | A63B 60/54 |
| 10,556,161 | B2 * | 2/2020 | Jertson | A63B 53/06 |
| 10,576,337 | B2 * | 3/2020 | Soracco | A63B 60/52 |
| 10,675,516 | B2 | 6/2020 | Johnson | |
| 10,864,416 | B2 * | 12/2020 | Jertson | A63B 53/0466 |
| 11,020,637 | B2 * | 6/2021 | Stokke | A63B 53/04 |
| 11,033,782 | B1 * | 6/2021 | Evans | A63B 53/04 |
| 11,192,005 | B2 * | 12/2021 | Bennett | A63B 60/02 |
| 11,207,577 | B1 * | 12/2021 | Evans | A63B 53/04 |
| 11,278,771 | B2 | 3/2022 | Lacey | |
| 11,291,892 | B2 * | 4/2022 | Jertson | A63B 53/0466 |
| 11,305,163 | B2 | 4/2022 | Johnson | |
| 11,331,546 | B2 | 5/2022 | Golden | |
| 11,338,182 | B2 * | 5/2022 | Morales | A63B 60/02 |
| 11,541,283 | B1 * | 1/2023 | Evans | A63B 53/04 |
| 11,602,678 | B2 * | 3/2023 | Stokke | A63B 53/04 |
| 11,679,310 | B1 * | 6/2023 | Evans | A63B 60/02 473/350 |
| 11,752,406 | B2 * | 9/2023 | Gonzalez | A63B 53/08 473/349 |
| 11,819,743 | B2 * | 11/2023 | Morales | A63B 60/02 |
| 11,865,415 | B2 * | 1/2024 | Oldknow | A63B 53/0437 |
| 11,918,871 | B2 * | 3/2024 | Jertson | A63B 53/06 |
| 11,925,841 | B2 * | 3/2024 | Yi | A63B 53/0466 |
| 12,042,701 | B2 * | 7/2024 | Brubaker | A63B 60/52 |
| 12,076,623 | B2 * | 9/2024 | Morales | A63B 53/0466 |
| 12,145,032 | B2 * | 11/2024 | Stokke | A63B 53/0466 |
| 2008/0194354 | A1 | 8/2008 | Nagai | |
| 2010/0160091 | A1 | 6/2010 | Boyd | |
| 2020/0086188 | A1 | 3/2020 | Nakamura | |

FOREIGN PATENT DOCUMENTS

| | | | | |
|---|---|---|---|---|
| JP | 2021094339 A * | 6/2021 | | |
| WO | WO-2018005876 A2 * | 1/2018 | | A63B 53/04 |
| WO | WO-2021108723 A1 * | 6/2021 | | A63B 1/00 |

* cited by examiner

GOLF CLUB HEADS WITH DYNAMIC BACK WEIGHTS

TECHNICAL FIELD

The present disclosure relates to a golf club head, and more specifically to a golf club head having an adjustable weighting system.

BACKGROUND

The weighting of a golf club head can greatly impact key performance indicators, such as path manipulation and impact delivery of the golf ball. More specifically, how weight is distributed in a golf club head can directly affect the center of gravity and the moment of inertia. Weight assemblies can be used on club heads to provide discretely located regions having concentrated mass. Some weight assemblies are movable within a weight channel, thereby allowing users to adjust key parameters of the golf club head, such as center of gravity, moment of inertia, path direction, and spin of the golf ball.

For example, weight may be repositioned within the channel so that it is closer to a sole portion of the club head, closer to a strike face of the club head, and/or closer to a toe end and heel end of the club head, which will alter the center of gravity and/or the moment of inertia of the club head. Altering the moment of inertia of the club head can in turn alter the forgiveness of the golf club. Weight position further affects the flight direction of the golf ball, and/or flight angle of the golf ball. A desirable CG position on a golf club head is low and rearward from the strike face to optimally raise the launch angle, spin, path direction, and MOI. Additionally, the CG position can be moved nearer to the toe end or heel end of the golf club head to further affect the side spin of the golf ball.

At impact with a golf ball, the golf club head will undergo reaction forces that cause portions of the club head to deform or bend. Bending will be greatest at locations of stress concentrations and/or structural weakness. The moveable weight may be revived by a weight channel, which is typically a void formed in an exterior surface of the club head and therefore may cause stress concentrations and weak points that exacerbate bending in the club head, induce oscillations of the weight assembly, and increase the risk of failure of the club head. There is a need in the art to solve short, heavy weight channels while maintaining down and back center of gravity positions with high moment of inertia and creating stability to the weight channel.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DEFINITIONS

Figure 1:
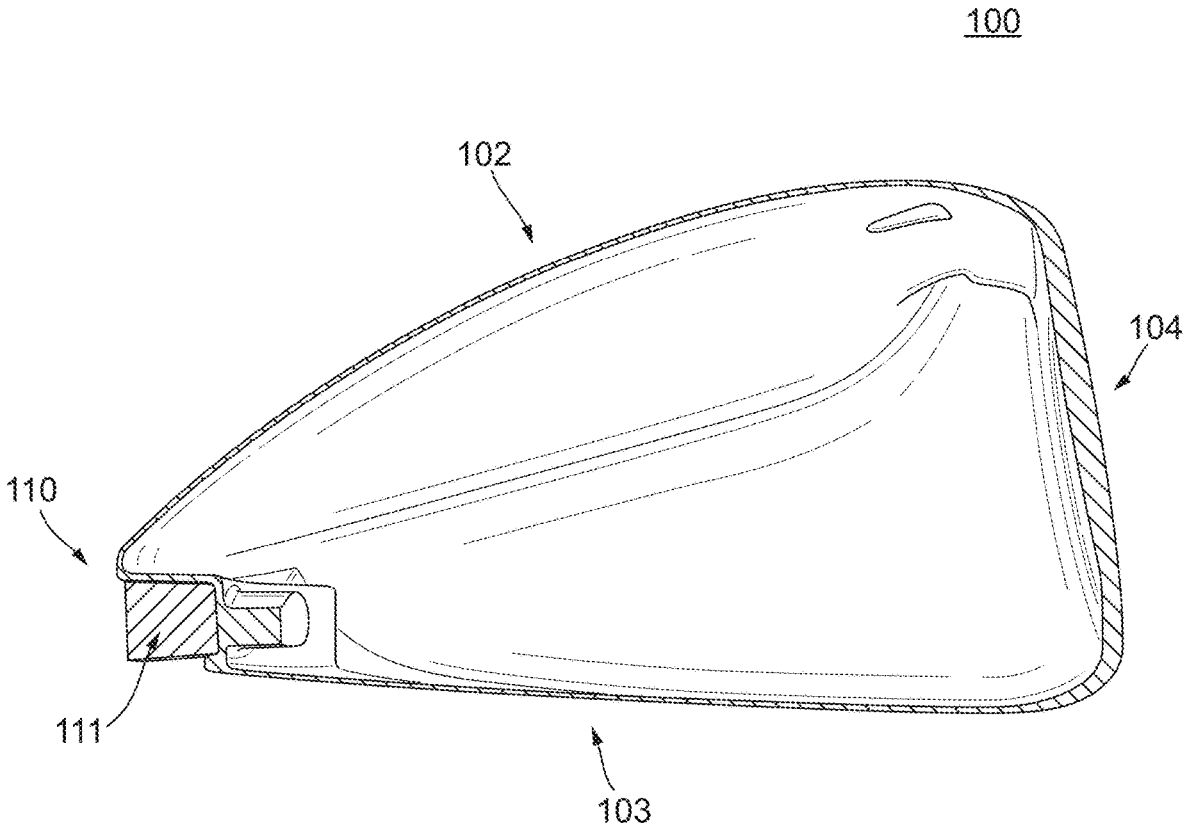
FIG. 1 illustrates a cross-sectional view of a wood-type club head according to prior art.

The terms "include," and "have," and any variations thereof, are used herein to mean a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "first," "second," "third," "fourth," and the like in the description and in the claims, if any, are used herein for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are used herein to mean a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," "up," "down," and the like in the description and in the claims are used herein to provide a descriptive purpose and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

"Driver golf club heads" as used herein to comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc 650 cc, approximately 600 cc-700 cc, or approximately 600 cc-800 cc.

The golf club heads described in this disclosure can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C250 steel, C300 steel, C350 steel, 17-4 stainless steel, 15-5 stainless steel, 13-8 stainless steel, 431 stainless steel, 8620 stainless steel, 4140 stainless steel, 4340 stainless steel, 4130 stainless steel, 4330 stainless steel, 4335 stainless steel, T9s+titanium, Ti 6-4 titanium, HST-220 titanium, TSG 1 titanium, TSG 2 titanium, TSG 3 titanium, Ti 6-22-22 titanium, Ti 10-2-3 titanium, Ti 6-6-2 titanium, Ti 15-5-3 titanium, Ti-15-3-3-3 titanium, Beta-C titanium, SJ721 titanium, Super TiX-51AF titanium, SSAT-2041 titanium, and SP700 titanium.

The term "geometric centerpoint," as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as used herein, can refer to a reference plane associated with the surface on which a golf ball is placed. The ground plane can be a horizontal plane tangent to the sole at an address position.

The term "face height," as used herein, can refer to a distance measured parallel to loft plane between a top end of the strikeface perimeter and a bottom end of the strikeface perimeter.

The term "lie angle," as used herein, can refer to an angle between a hosel axis, extending through the hosel, and the ground plane. The lie angle is measured from a front view.

The "loft plane" of the driver-type golf club head, as used herein, is a plane that is tangent to the geometric center of the strike face. The loft plane forms a loft angle with the ground plane.

The term "loft angle," as used herein, can refer to an angle measured between the loft plane and the XY plane.

The "depth" of the driver-type golf club head as used herein can be defined as a front-to-rear dimension of the driver-type golf club head.

The "height" of the driver-type golf club head as used herein can be defined as a crown-to-sole dimension of the driver-type club head. In many embodiments, the height of the club head can be measured according to a golf governing body such as the United States Golf Association (USGA).

The "length" of the driver-type golf club head as used herein can be defined as a heel-to-toe dimension of the driver-type club head. In many embodiments, the length of the club head 100 can be measured according to a golf governing body such as the United States Golf Association (USGA).

The "face height" of the driver-type golf club head, as used herein, can be defined as a height measured parallel to loft plane between a top end of the strike face perimeter near the crown and a bottom end of the strike face perimeter near the sole. In these embodiments, the strike face perimeter can be located along the outer edge of the strike face, where the curvature deviates from the bulge and/or roll of the strike face.

The "geometric center" of the driver-type golf club head, as used herein, is the geometric center point of a strike face perimeter. As another approach, the geometric center of the strike face can be located in accordance with the definition of a golf governing body such as the United States Golf Association (USGA).

The "geometric center height" of the driver-type golf club head, as used herein, is a height measured perpendicular from the ground plane to the geometric center of the driver-type club head.

The "leading edge" of the driver-type golf club head as used herein can be identified as the most sole-ward portion of the strike face perimeter. For example, a driver-type golf club head leading edge is the transition from the roll and bulge of the strike face to the sole of the driver-type golf club head.

An "XYZ" coordinate system of the golf club head, as used herein, is based upon the geometric center of the strike face. The golf club head dimensions as used herein can be measured based on a coordinate system as defined below. The geometric center of the strike face defines a coordinate system having an origin located at the geometric center of the strike face. The coordinate system defines an X axis, a Y axis, and a Z axis. The X axis extends through the geometric center of the strike face in a direction from the heel to the toe of the fairway-type club head. The Y axis extends through the geometric center of the strike face in a direction from the crown to the sole of golf club head. The Y axis is perpendicular to the X axis. The Z axis extends through the geometric center of the strike face in a direction from the front end to the rear end of the golf club head. The Z axis is perpendicular to both the X axis and the Y axis.

The term or phrase "center of gravity position" or "CG location" as used herein, is the location of the club head center of gravity (CG) with respect to the secondary coordinate system, wherein the CG position is characterized by locations along the X'-axis, the Y'-axis, and the Z'-axis. The term "CGx" can refer to the CG location along the X'-axis, measured from the origin point. The term "CG height" can refer to the CG location along the Y'-axis, measured from the origin point. The term "CGy" can be synonymous with the CG height. The term "CG depth" can refer to the CG location along the Z'-axis, measured from the origin point. The term "CGz" can be synonymous with the CG depth.

The term or phrase "moment of inertia" (hereafter "MOI") as used herein, are the values measured about the CG. The term "MOIxx" as used herein, is the MOI measured in the heel-to-toe direction, parallel to the X-axis. The term "MOIyy" as used herein, is the MOI measured in the sole-to-crown direction, parallel to the Y-axis. The term "MOIzz" as used herein, is the MOI measured in the front-to-back direction, parallel to the Z-axis. The MOI values MOIxx, MOIyy, and MOIzz determine how forgiving the club head is for off-center impacts with a golf ball.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

Described herein are various embodiments of driver type golf club heads having weight assemblies that include weight ports and/or channels oriented at angles to reduce upwards bending of the club head through impact, thereby alleviating stresses and associated oscillations that are present in weight channels comprising heavy weights that are aligned more perpendicular to the Z axis. In some embodiments, the weight assemblies are oriented along an assembly axis that extends at an angle relative to a ground plane, and that extends upward from the rear region to the strike face. Reducing bending via upward orientation of the weight assembly reduces or eliminates the need for ribs and/or support structures, thereby increasing discretionary mass that can be redistributed throughout the club head as desired, and further prevents oscillation of the weight channel. The additional discretionary mass can be used to improve various golf club head parameters, such as CG, MOI, spin, and managing stresses, which leads to greater durability.

The CG and MOI of a golf club head affect the performance of the club. For example, high moment of inertia increases club head forgiveness for off-center hits. A center of gravity positioned low and to the back (i.e., toward the sole and rear of the club head) advantageously increases the moment of inertia, reduces backspin, and increases the launch angle of a golf ball on impact. Additionally, adjusting the center of gravity will change ball trajectory. Each of these parameters are important in golf club design to achieve desired performance characteristics. The various embodiments of golf club heads with angled weight assemblies, as described below, reduce undesirable bending produced at impact, thereby improving durability of the club head. Additionally, the angled weight assembly increases stability to the driver-type club head upon impact with a golf ball. These embodiments increase discretionary mass that can then be redistributed elsewhere in the club head, improving the golf club head parameters such as CG position and MOI.

Described herein are various embodiments of a driver-type golf club head 200, 300 with an angled weight assembly 214, 314. The driver-type golf club head 200, 300 can comprise a crown 202, 302, a sole 203, 303 opposite the crown 202, 302, a strike face 204, 304, a rear region 205, 305 opposite the strike face 204, 304, a heel end 206, 306 and a toe end 207, 307 opposite the heel end 206, 306. Together, the strike face 204, 304, the crown 202, 302, the sole 203, 303, the heel end 206, 306, the toe end 207, 307, and the rear region 205, 305, form an enclosed hollow interior of the club head 200, 300. The club head 200, 300 can further comprise a weight assembly 214, 314 located in the rear region 205, 305 of the club head 200, 300.

Referring to FIGS. 8, 9, 18, and 19, the weight assembly 214, 314 can comprise a weight port and/or weight channel 210, 310, a weight member 211, 311 and a fastener 213, 313. The weight channel 210, 310 can further be made up of a support material. The weight port 226, 326 and/or weight channel 210, 310 can be configured to receive the weight member. A heavy weight member (i.e. over 25 g, 30 g, 35 g, 40 g, etc.) placed within a shallow weight channel can reduce the oscillation of the weight channel 210, 310 in a y-axis direction, thereby reducing or eliminating the need for support material and/or ribs within the golf club head. The weight member 211, 311 can define an aperture 212, 312 configured to receive the fastener 213, 313. The fastener 213, 313 can be used as a means of securing the weight member 211, 311 to one of a plurality of attachment points 245, 345 within the weight channel 210, 310, as described below.

Reducing the oscillation can improve sound and durability. Additionally, the discretionary mass of the club head 200, 300 increased by the reduction or elimination of support material and/or a reduction in the thickness of the weight channel. Discretionary mass is increased while maintaining mass properties, performance characteristics, and durability, and while improving feel and sound. The weight assembly 214, 314 can be angled between 5-50 degrees relative to from the ground plane 1010, and upwardly for a rear to a front of the club head, which moves the CG to lower and to the rear of the golf club head. The discretionary mass can then be redistributed towards the rear region 205, 305 of the club head 200, 300 to reduce and/or eliminate the oscillation of the weight assembly 214, 314, leading to more favorable launch angles and spin. A first angle 240, 340 can be defined between a first surface plane 239, 339 and the ground plane 1010, a second angle 243, 343 can be defined between a second surface plane 242, 342 and the ground plane 1010, and a rear angle 236, 336 can be defined between a rear surface plane 235, 335 and the ground plane 1010. The first angle 240, 340 can be between 5-55 degrees, the second angle 243, 343 can be between 15-70 degrees, and the rear angle 236, 336 can be between 100-140 degrees. Adjusting the first angle 240, 340, second angle 243, 343, and rear angle 236, 336 of the weight channel 210, 310 can reduce the oscillation of the weight assembly 214, 314. The embodiments described herein, when compared to prior art clubs, can have between 20-35% more discretionary mass that can be redistributed to prevent oscillation. The combination of an angled and shallow weight channel allows for the use of a heavier weight member to be used thus to further moving the CG down and towards the rear. In some embodiments, the weight channel 210, 310 can be positioned solely in the rear region 205, 305 of the golf club head, wherein the weight channel 210, 310 is sized to receive the weight member 211, 311 and fastener 213, 313. In some embodiments, at least a portion of the weight channel 210, 310 is positioned within a skirt 208, 308 of the golf club head 200, 300.

Figure 5:
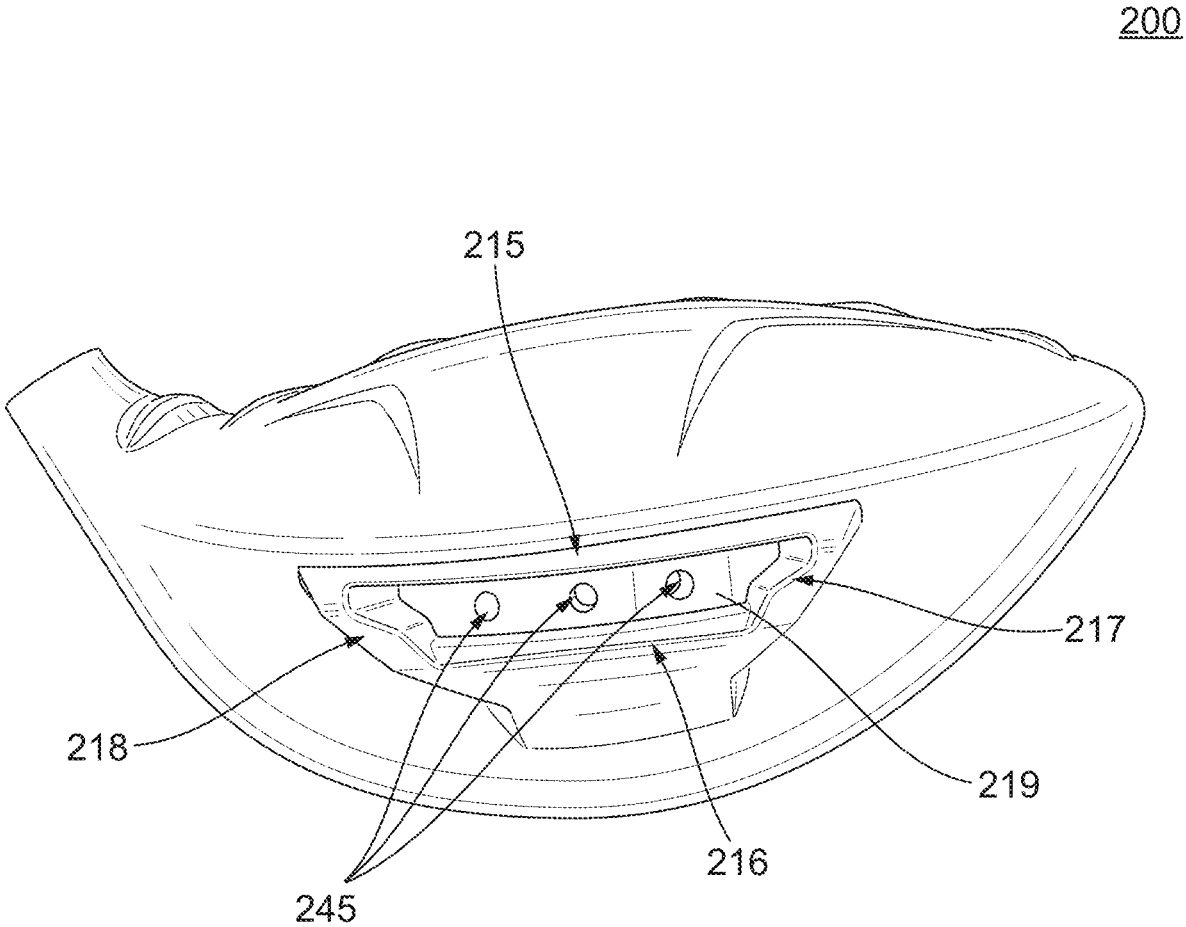
FIG. 5 illustrates a rear view of the club head according to a first embodiment.

As illustrated in FIG. 5, the weight channel 210, 310 can extend in a heel end 206, 306 to toe end 207, 307 direction, traversing a perimeter of the rear region 205, 305. The weight channel 210, 310 can be configured to permit the weight member 211, 311 to slide, translate, rotate or otherwise move within the weight channel 210, 310. The golf club head 200, 300 does not comprise a plurality of channels. Moving the weight member 211, 311 within the weight channel 210, 310 can allow the user to manipulate the CG as desired. For example, moving the CG toward the heel end 206, 306 or toe end 207, 307 of the golf club head contributes to the ability to shape the flight of a golf ball towards a fade or draw bias, which can help improve a golfer's shot.

With continued reference to FIG. 5, the weight channel 210, 310 can be defined by a plurality of surfaces. In some embodiments, the weight channel 210, 310 can be defined by a channel rear surface 219, 319, a channel first surface 215, 315, a channel second surface 216, 316, a channel toe side surface 217, 317, and a channel heel side surface 218, 318. The channel first surface 215, 315 can be proximate to the crown 202, 302. The channel second surface 216, 316 can be proximate to the sole 203, 303. The channel toe side surface 217, 317 can be proximate to the toe end 207, 307. The channel heel side surface 218, 318 can be proximate to the heel end 206, 306. In some embodiments, the channel toe side surface 217, 317 and the channel heel side surface 218, 318 can comprise a geometry compatible with the weight member 211, 311.

The weight channel 210, 310 can comprise a weight channel length. The weight channel length can be defined as a straight line between the heelward most point of the weight channel 210, 310 and the toeward most point of the weight channel 210, 310. In some embodiments, the weight channel length can be constant across the whole weight channel 210, 310. In some embodiments, the weight channel length can vary in a crown 202, 302 to sole 203, 303 direction. In some embodiments, the weight channel length can be between 1.5 inches and 3.5 inches. In some embodiments, the weight channel length can be between 1.5 inches and 2.0 inches, 2.0 inches and 2.5 inches, 2.5 inches and 3.0 inches, or 3.0 inches and 3.5 inches. The weight channel length can allow the weight member 211, 311 to be adjusted toward the heel end 206, 306 or toe end 207, 307, thereby moving the CG of the golf club head so that the user can more easily shape shots, such as a fade or draw bias.

The weight channel 210, 310 can comprise a weight channel depth. The weight channel depth can be measured from the outer most point of the channel first surface 215, 315 to the channel rear surface 219, 319. In some embodiments, the depth can be constant across the whole weight channel 210, 310. In some embodiments, the depth can vary in a heel end 206, 306 to toe end 207, 307 direction. In some embodiments, the weight channel depth can be sufficiently shallow to allow the weight member 211, 311 to protrude beyond the weight channel 210, 310 and position the CG low and to the back. In some embodiments, the weight channel depth can be between 0.1 inch and 2.0 inches. In some embodiments, the weight channel depth can be between 0.1 inch and 0.2 inch, 0.2 inch and 0.3 inch, 0.3 inch and 0.4 inch, 0.4 inch and 0.5 inch, 0.5 inch and 0.6 inch, 0.6 inch and 0.7 inch, 0.7 inch and 0.8 inch, 0.8 inch and 0.9 inch, 0.9 inch and 1.0 inch, 1.0 inch and 1.1 inches, 1.1 inches and 1.2 inches, 1.2 inches and 1.3 inches, 1.3 inches and 1.4 inches, 1.4 inches and 1.5 inches, 1.5 inches and 1.6 inches, 1.6 inches and 1.7 inches, 1.7 inches and 1.8 inches, 1.8 inches and 1.9 inches, or 1.9 inches and 2.0 inches. In one exemplary embodiment, the depth is constant. In such an embodiment, the depth is 0.45 inches. In another embodiment, the depth is 0.41 inches.

Further, the weight channel 210, 310 can comprise a weight channel height measured from the channel first surface 215, 315 and the channel second surface 216, 316. In some embodiments, the weight channel height can be constant across the whole weight channel in a heel end 206, 306 to toe end 207, 307 direction. In some embodiments the weight channel height can vary along the weight channel length. In some embodiments, the weight channel height can be between 0.1 inch and 2.0 inches. In some embodiments, the weight channel height can be between 0.1 inch and 0.2 inch, 0.2 inch and 0.3 inch, 0.3 inch and 0.4 inch, 0.4 inch and 0.5 inch, 0.5 inch and 0.6 inch, 0.6 inch and 0.7 inch, 0.7 inch and 0.8 inch, 0.8 inch and 0.9 inch, 0.9 inch and 1.0 inch, 1.0 inch and 1.1 inches, 1.1 inches and 1.2 inches, 1.2 inches and 1.3 inches, 1.3 inches and 1.4 inches, 1.4 inches and 1.5 inches, 1.5 inches and 1.6 inches, 1.6 inches and 1.7 inches, 1.7 inches and 1.8 inches, 1.8 inches and 1.9 inches, or 1.9 inches and 2.0 inches. In some embodiments the height is constant. In such embodiment, the height is 0.32 inches. In another exemplary embodiment the height is 0.38 inches.

In another embodiment, the weight channel height can comprise a variable height, wherein the height varies in a heel end 206, 306 to toe end 207, 307 direction. The non-uniform height of the weight channel can secure the weight member 211, 311 within the weight channel by preventing the weight member 211, 311 from sliding laterally throughout the weight channel 210, 310. This gives the golfer a limited number of discrete positions at which to fix the weight member 211, 311, thereby reducing potential confusion a golfer may have on how to adjust for shot shape and/or trajectory.

In some embodiments, the channel second surface 216, 316 can be located within 0.10 to 0.20 inches from the sole 203, 303. In some embodiments, the distance between the channel second surface 216, 316 and the sole 203, 303 can be 0.10 inches and 0.11 inches, 0.11 inches and 0.12 inches, 0.12 inches and 0.13 inches, 0.13 inches and 0.14 inches, 0.14 inches and 0.15 inches, 0.15 inches and 0.16 inches, 0.17 inches and 0.18 inches, 0.18 inches and 0.19 inches or 0.19 inches and 0.20 inches.

The channel rear surface 219, 319 can comprise a plurality of discrete attachment points 245, 345. The attachment points 245, 345 allow the weight member 211, 311 to be moved within the weight channel, to adjust desired performance characteristics (e.g., forgiveness, spin, trajectory). To adjust position, the weight member 211, 311 is removed from the weight channel 210, 310 and placed at another attachment point 245, 345 within the weight channel 210, 310. The movement of the weight member 211, 311 toward the toe end 207, 307 or the heel end 206, 306 of the club head will move the CG, thereby adjusting the shape the flight of a golf ball when it is struck with the club head.

Figure 8:
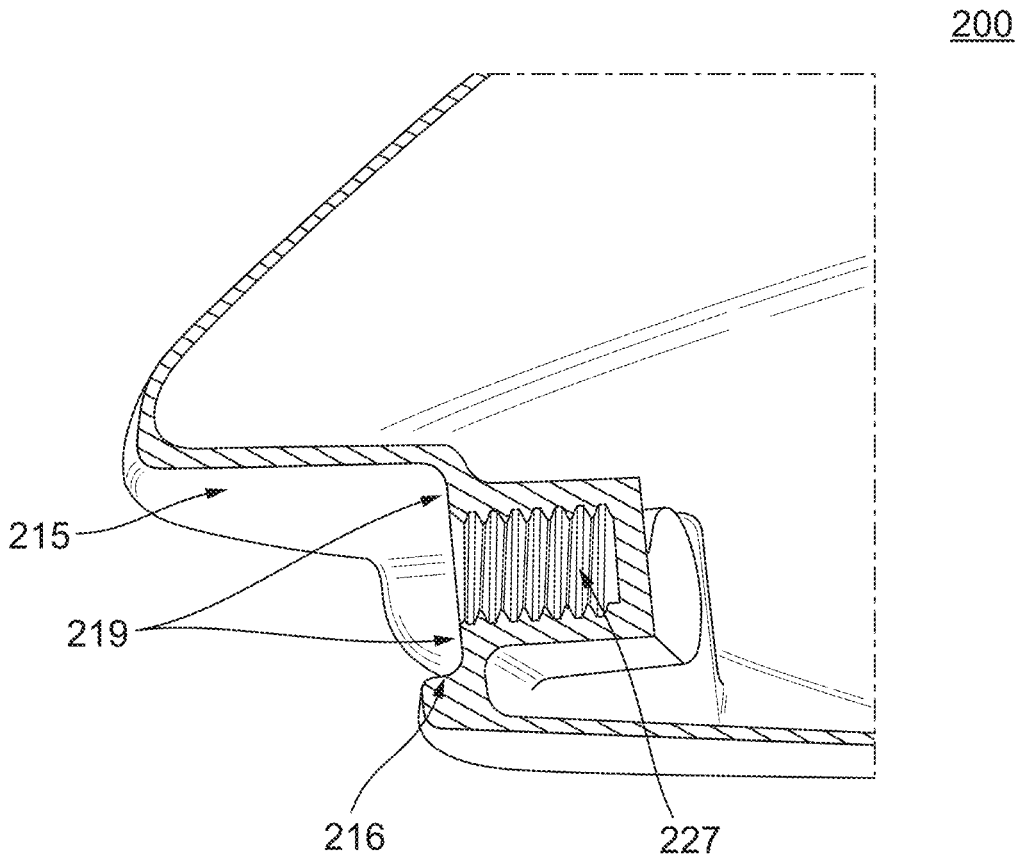
FIG. 8 illustrates a cross-sectional view of a weight channel of FIG. 6A.
Figure 9:
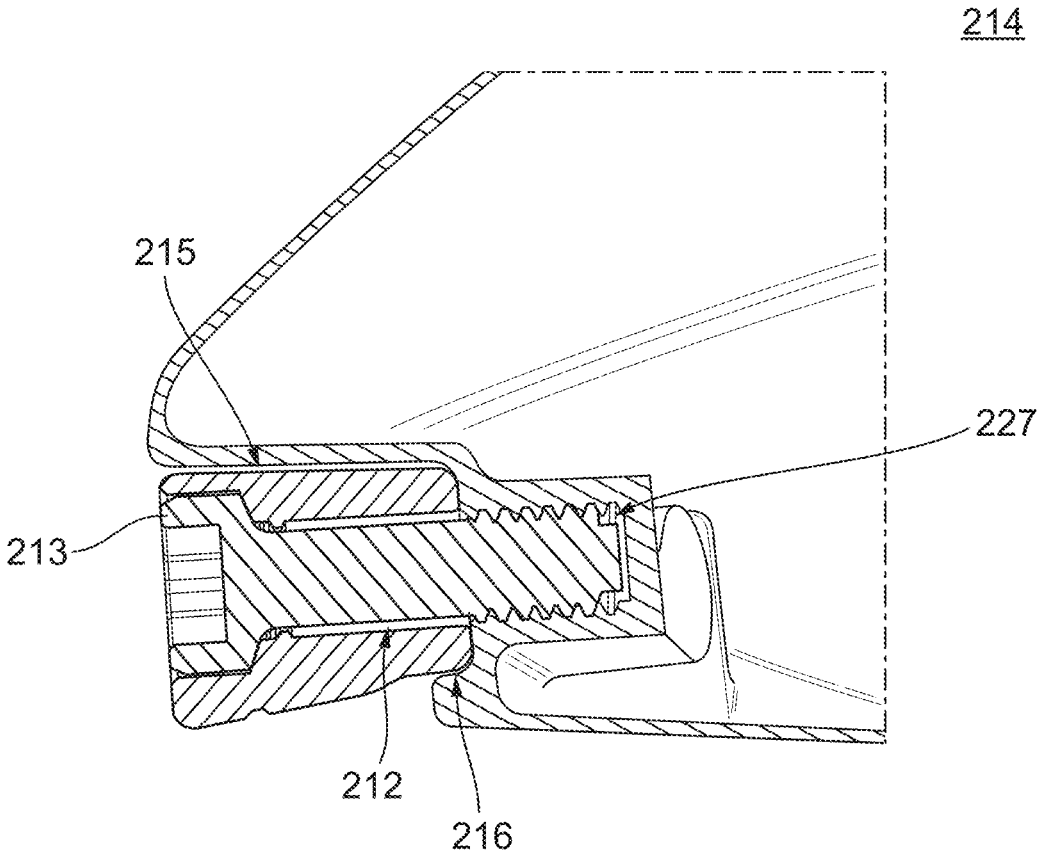
FIG. 9 illustrates a cross-sectional view of a weight assembly according to the first embodiment.
Figure 10:
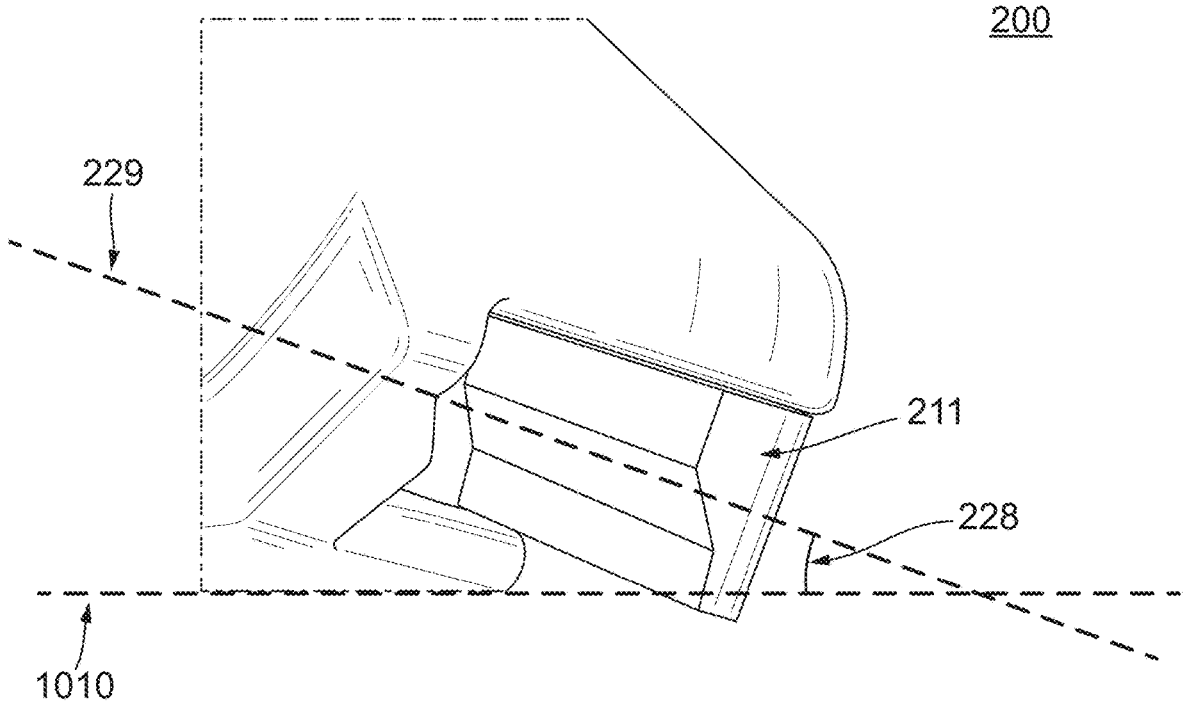
FIG. 10 illustrates a side view of a weight assembly of FIG. 9.
Figure 18:
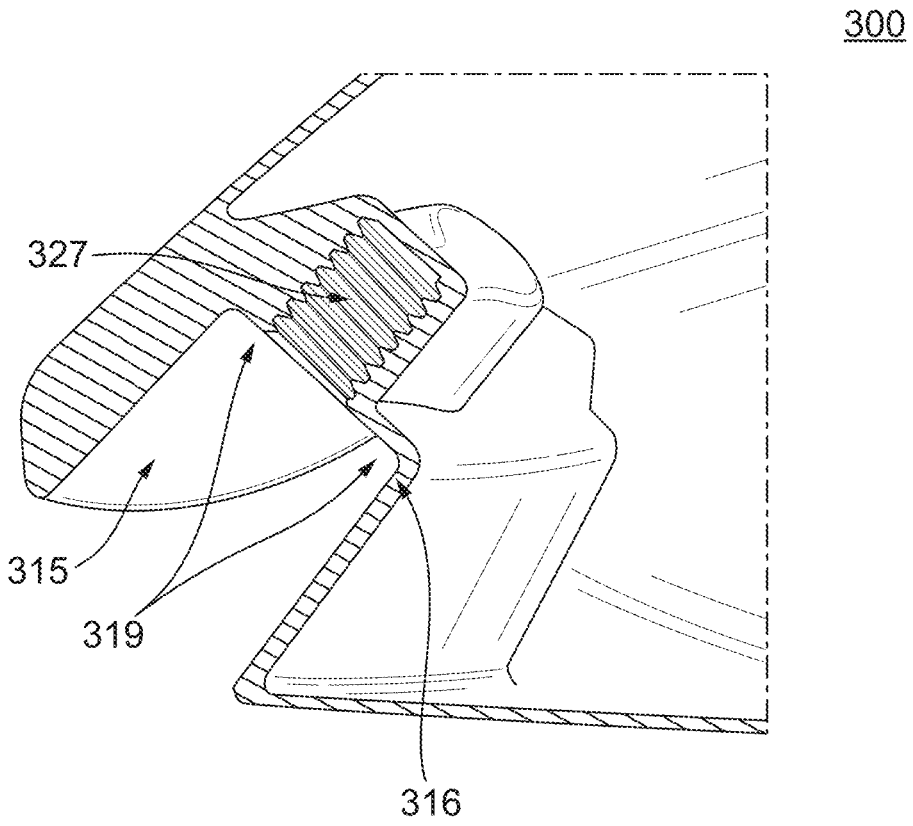
FIG. 18 illustrates a cross-sectional view of a weight channel according to a second embodiment.
Figure 19:
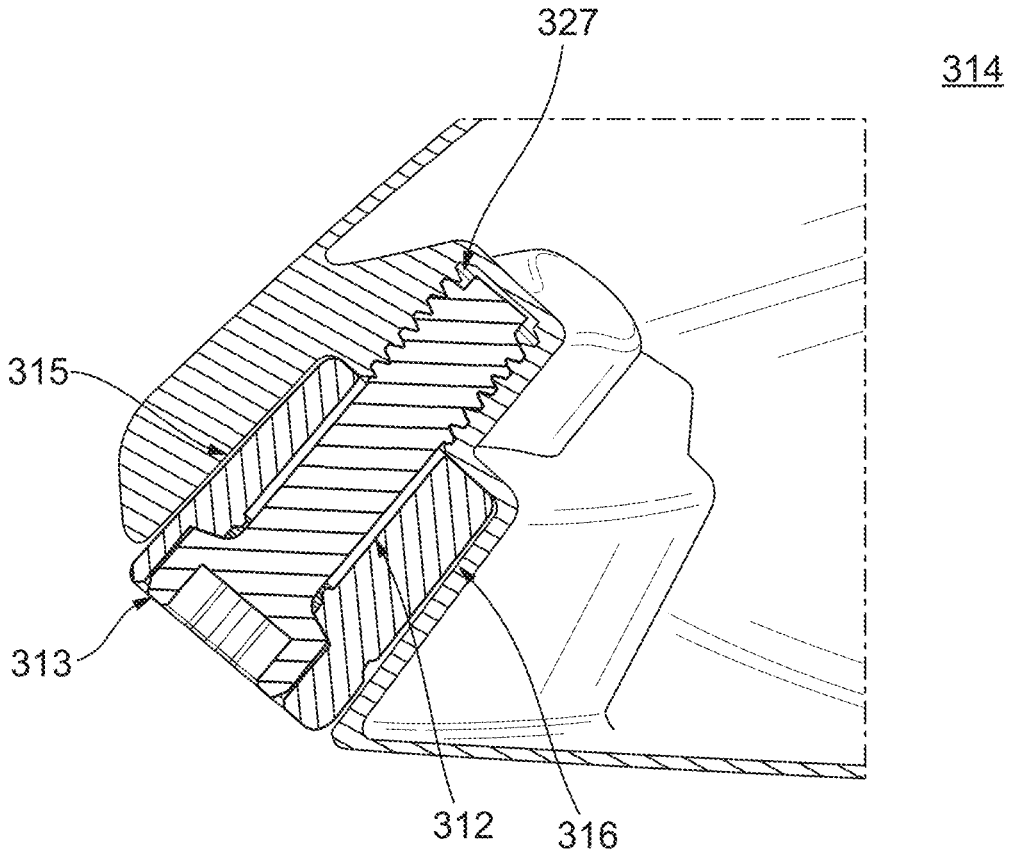
FIG. 19 illustrates a cross-sectional view of a weight assembly according to a second embodiment.
Figure 20:
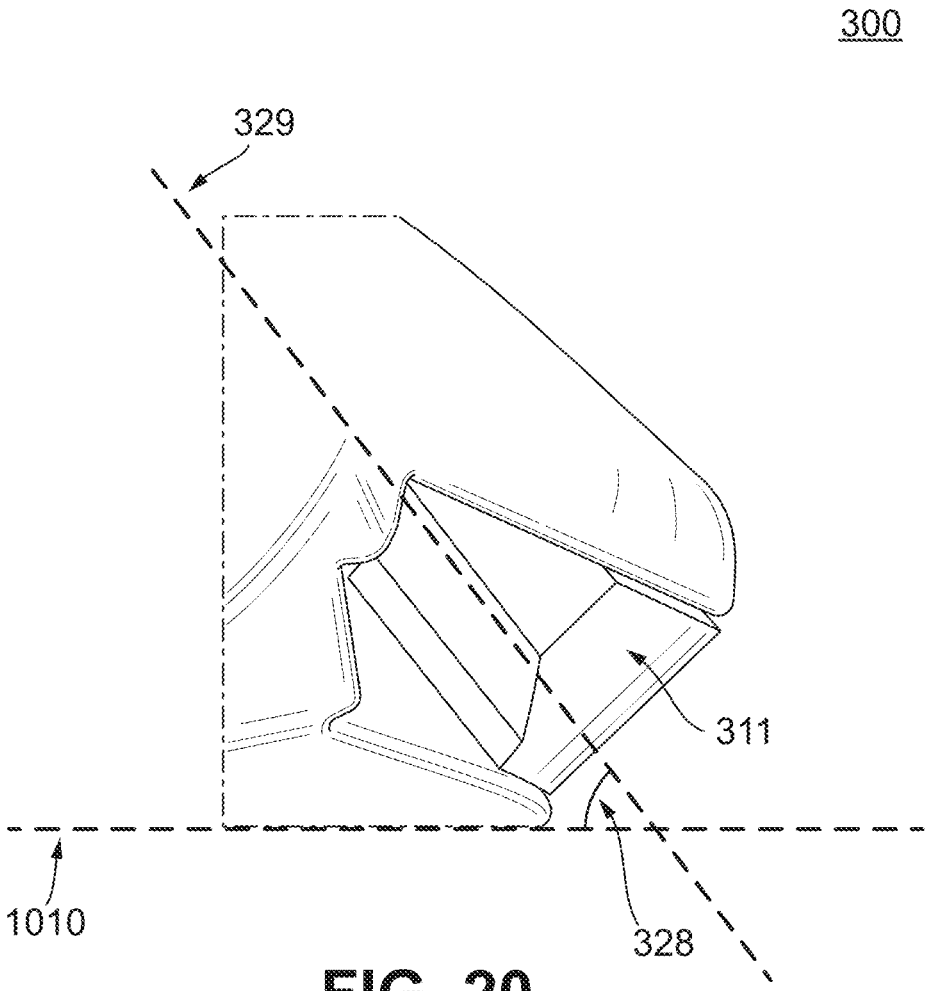
FIG. 20 illustrates a side view of a weight assembly of FIG. 19.
Figure 21:
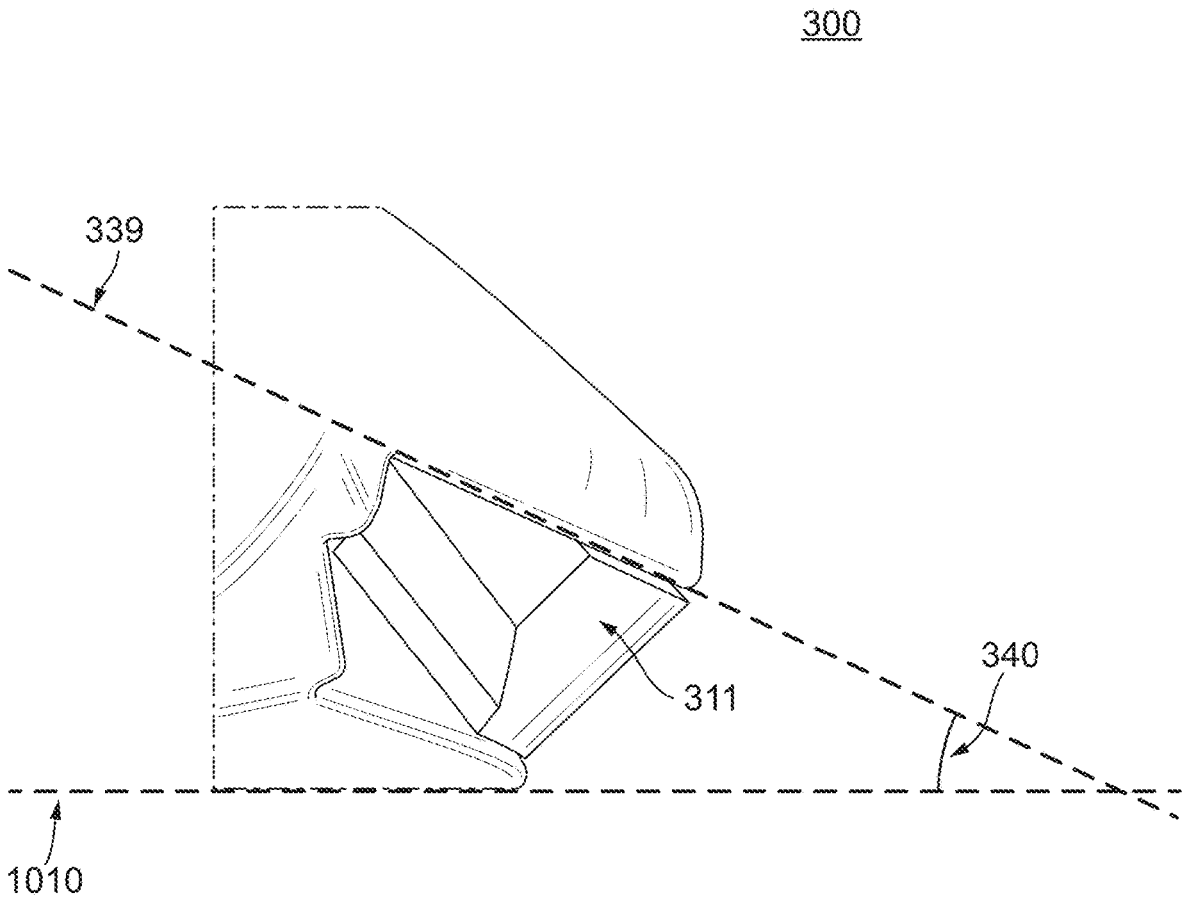
FIG. 21 illustrates a side view of a weight assembly FIG. 19.

The plurality of attachment points 245, 345 can comprise various features including protruding bodies, apertures, recesses, ports capable of receiving a fastener, notches, tabs, cutout regions, ribs or grooves, pegs, hooks, magnets, programmable magnets, or any other suitable attachment means. In some embodiments, the plurality of attachment points 245, 345 can comprise a plurality of threaded recesses 227, 327 configured to receive a fastener 213, 313. As shown in FIGS. 5, 8, and 18, the plurality of threaded recesses can comprise three threaded recesses, a toe-side recess, a central recess, and a heel-side recess. As further discussed below, the fastener 213, 313 can be used as a means for removably securing the weight member 211, 311 within the weight channel 210, 310 at each attachment point 245, 345. The plurality of threaded recesses 227, 327 can ensure the weight member 211, 311 stays secure throughout the entirety of the swing.

The channel rear surface 219, 319 can allow the weight member 211, 311 to lay flush with an outer surface of the club head to ensure a visibly sleek look to the customer. In some embodiments, the plurality of attachment points can comprise two to six attachment points. The plurality of attachment points can comprise 2, 3, 4, 5, or 6 attachment points. In most embodiments, the attachment points are equally spaced. In other embodiments, the attachment points can be unevenly spaced across the channel rear surface 219, 319. In one exemplary embodiment, the weight channel 210, 310 can comprise three attachment points spaced along the channel rear surface 219, 319 such that each attachment point center is spaced between 0.5 inch and 0.6 inch from the adjacent attachment points.

Further in most embodiments, the shape of the channel rear surface 219, 319 is complimentary to the shape of a front surface 224, 324 of the weight member 211, 311. In an exemplary embodiment, the channel rear surface 219, 319 is convex and is complementary to the concave weight front surface 224, 324. The weight channel 210, 310 can be open to the rear region 205, 305 and/or sole 203, 303 of the golf club head such that when the weight member 211, 311 is retained within the weight channel 210, 310 at least a portion of a weight back surface 225, 325 is visible when viewed from the bottom.

Referring to FIG. 5, the weight member placement moves the CG low and to the back, which can promote bending of the club head in a down and forward motion through impact. Further, the ability to move the weight member 211, 311 towards the heel end 206, 306 or toe end 207, 307 of the golf club head influences the resulting shape of the golf ball flight to a fade or draw bias. The weight member 211, 311 is configured to detachably affix to the weight channel at each of the plurality of attachment points such that the weight front surface is exposed at the rear region, and the weight second surface is at least partially exposed at the sole.

Figure 2:
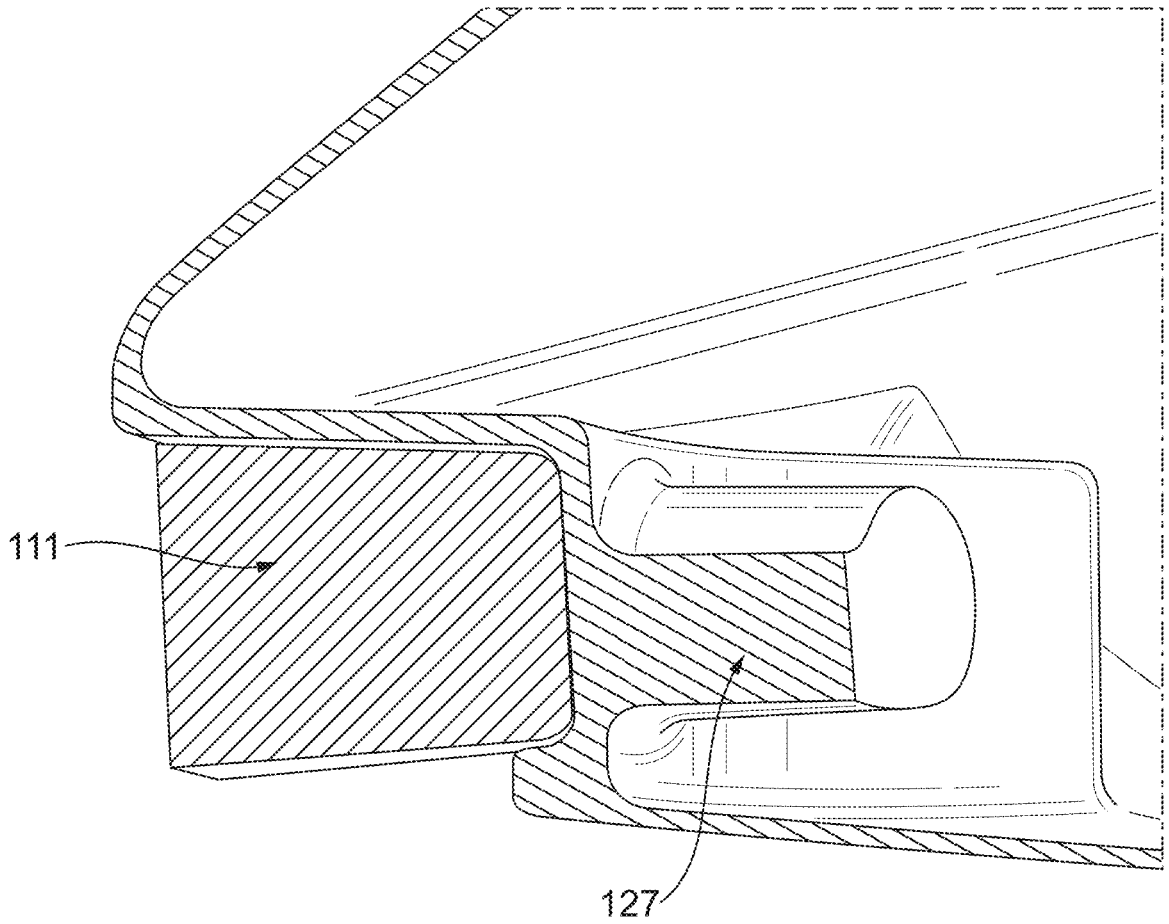
FIG. 2 illustrates a cross-sectional view of a weight assembly according to a first embodiment.
Figure 3:
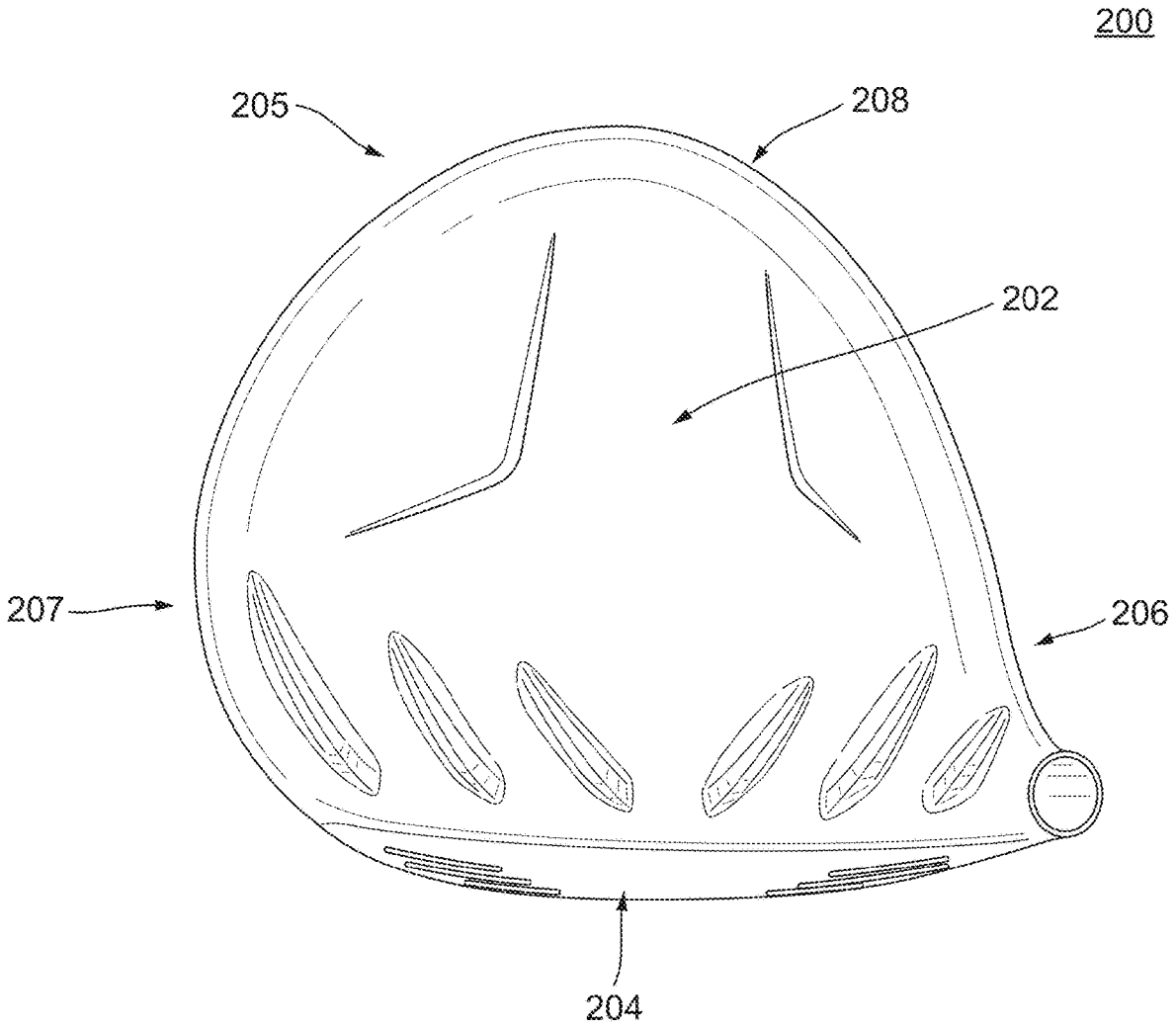
FIG. 3 illustrates a top view of a golf club head.
Figure 4:
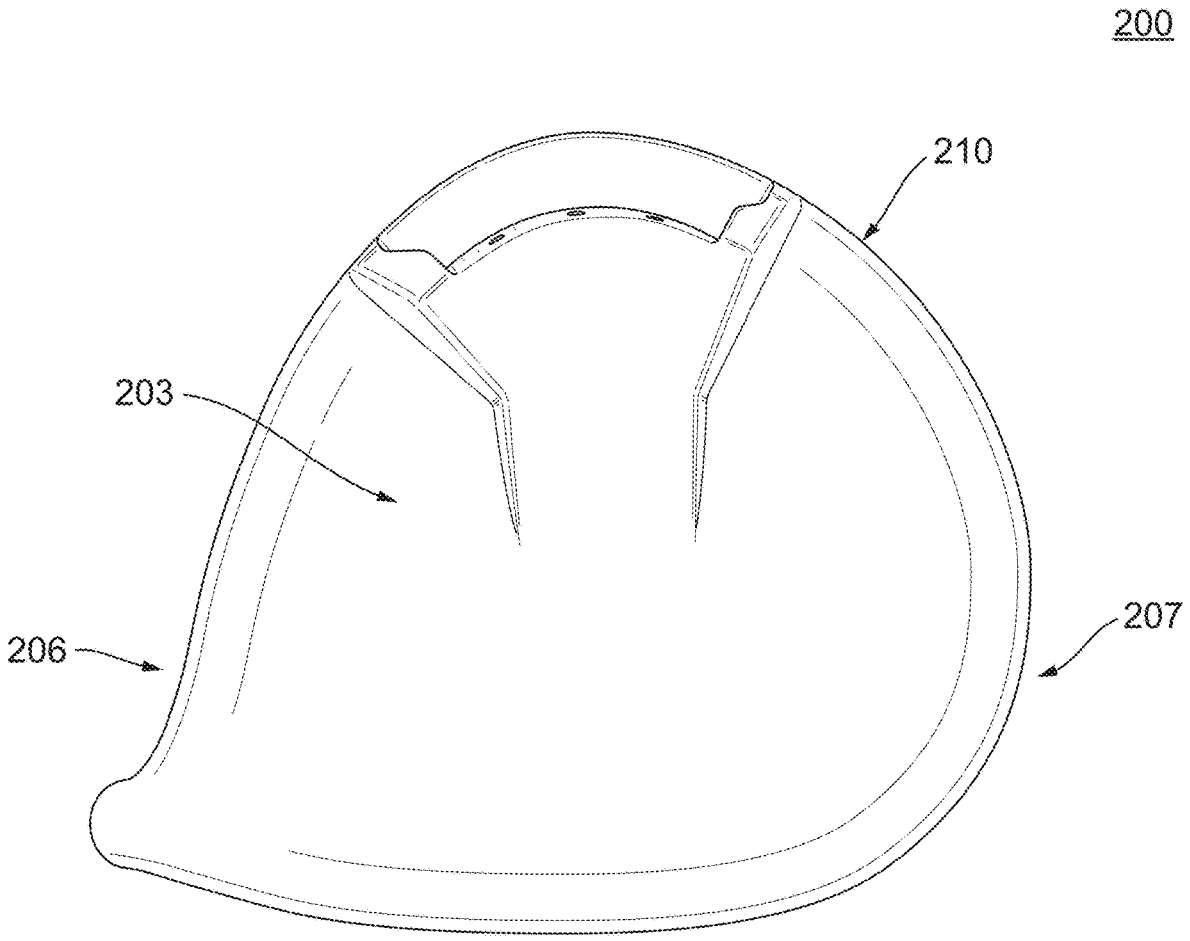
FIG. 4 illustrates a bottom view of the club head of FIG. 3.

The position of the weight member 211, 311 in the perimeter of the golf club can move the CG towards the rear and downward. This can increase MOI and improve shot parameters such as launch angle and spin rate. However, in a prior art club, as shown in FIGS. 1 and 2, the addition of a large mass within a small channel positioned in the perimeter of the golf club head at such an orientation caused an undesirable oscillations of the weight member 211, 311 at impact. The angled weight channel as described herein, however, reduces oscillations thereby improving sound and durability.

Figure 6A:
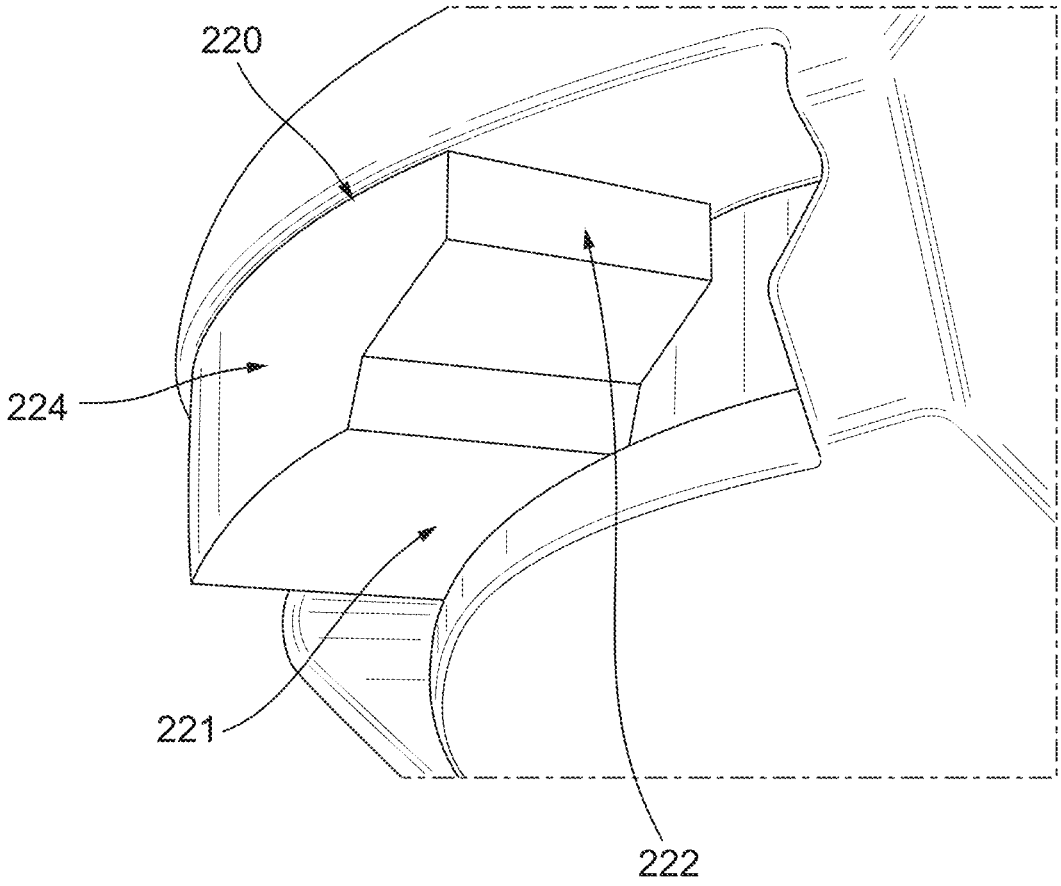
FIG. 6A illustrates an isometric view of a weight channel according to a first embodiment.
Figure 6B:
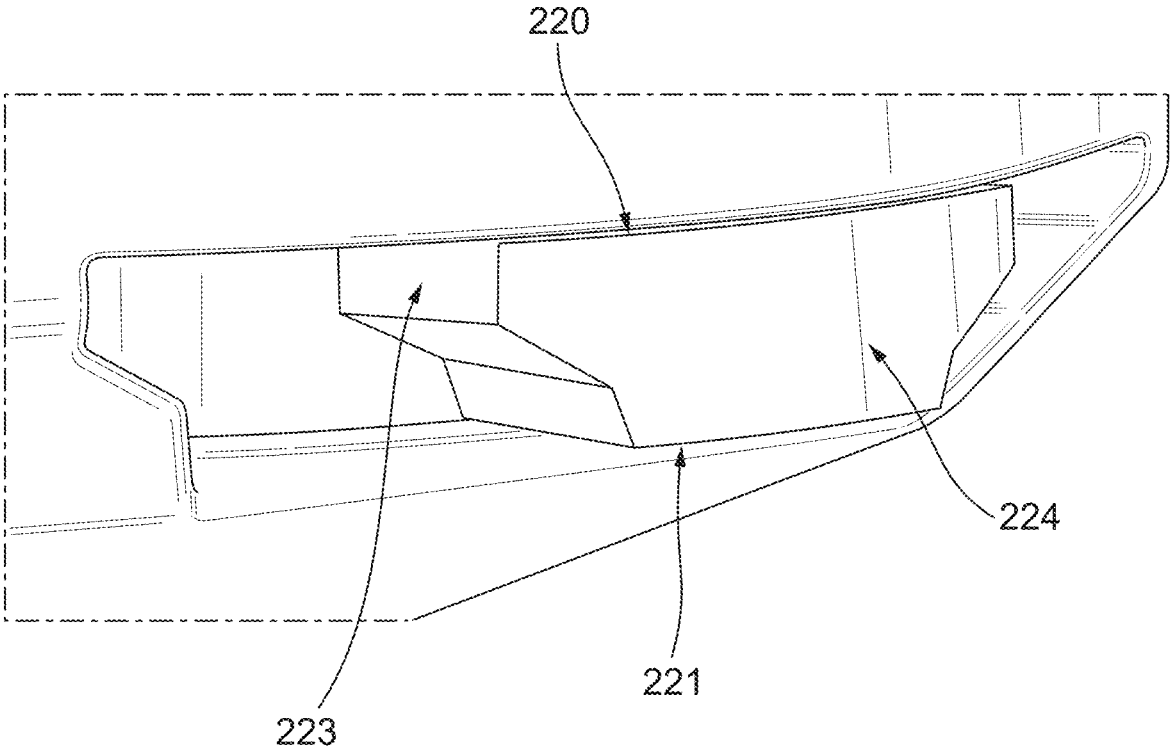
FIG. 6B illustrates an isometric view of a weight channel according to a first embodiment.
Figure 7:
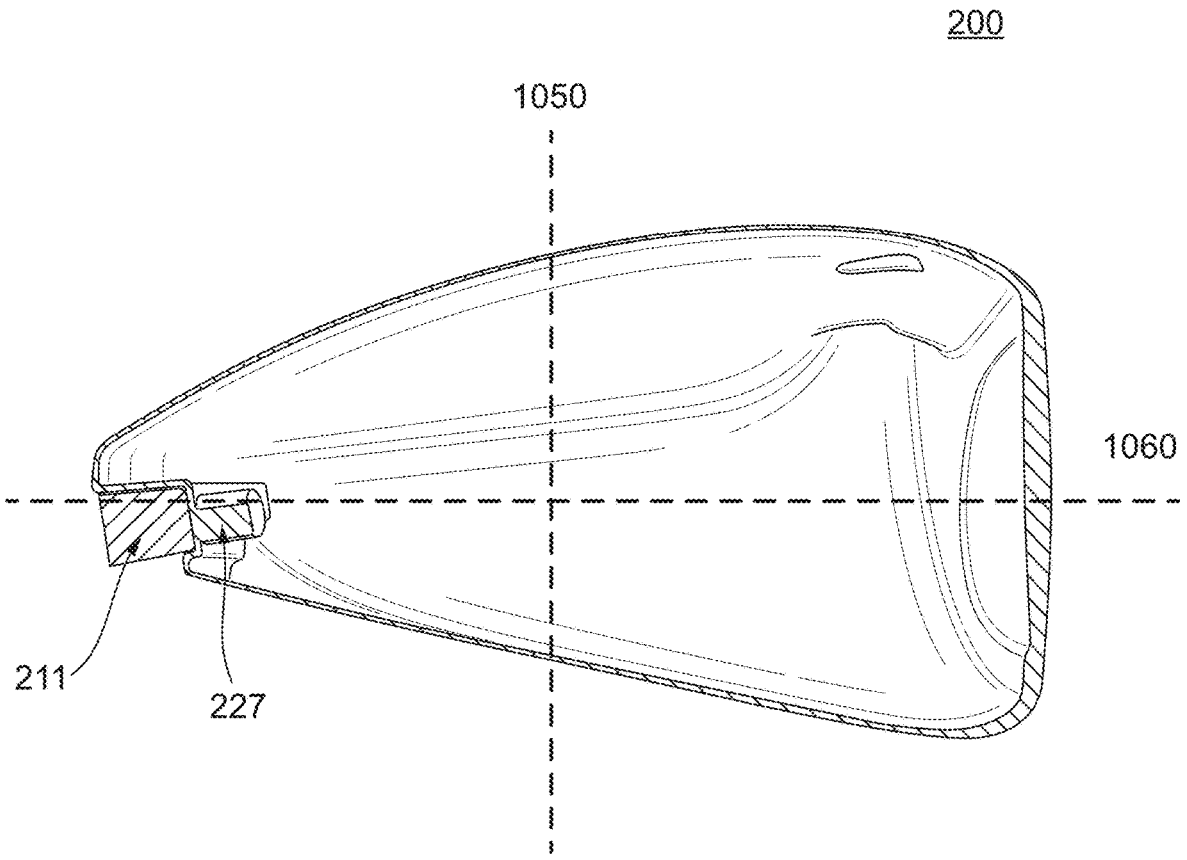
FIG. 7 illustrates a cross-sectional view of a golf club head of FIG. 5.

Referring to FIGS. 6A and 6B, the weight member 211, 311 can comprise a weight first surface 220, 320, a weight second surface 221, 321, a weight heel surface 223, 323, a weight toe surface 222, 322, a weight front surface 224, 324, and a weight back surface 225, 325. The weight member 211, 311 can further comprise dimensions similar to the weight channel 210, 310 to provide a seamless transition between the weight channel 210, 310, weight member 211, 311 and the rear region 205, 305.

The weight member 211, 311 can comprise a weight width measured from the weight front surface 224, 324 to the weight back surface. In some embodiments, the weight width may be between 0.3 inch to 1.0 inches. In some embodiments, the weight width may be between 0.3 inch to 0.4 inch, 0.4 inch to 0.5 inch, 0.5 inch to 0.6 inch, 0.6 inch to 0.7 inch, 0.7 inch to 0.8 inch, 0.8 inch to 0.9 inch, or 0.9 inch to 1.0 inch. In some embodiments, the weight width can be less than 1.0 inches, less than 0.75 inches, or less than 0.50 inches. In one exemplary embodiment, the weight width is 0.45 inches. In another exemplary embodiment, the weight width is 0.42 inches.

Further, the weight member 211, 311 can comprise a weight length measured from the weight heel surface 223, 323 to the weight toe surface 222, 322. In some embodiments, the weight length can be between 0.7 inch to 1.5 inches. In some embodiments, the weight length can be between 0.7 inch to 0.8 inch, 0.8 inch to 0.9 inch, 0.9 inch to 1.0 inch, 1.0 inch to 1.1 inches, 1.1 inches to 1.2 inches, 1.2 inches to 1.3 inches, 1.3 inches to 1.4 inches, or 1.4 inches to 1.5 inches. In one exemplary embodiment, the weight length is 1.65 inches. In another exemplary embodiment, the weight length is 1.12 inches.

Additionally, the weight member 211, 311 can comprise a weight height measured from the weight first surface 220, 320 to the weight second surface 221, 321. In some embodiments, the weight height can be between 0.1 inch to 0.6 inch. In some embodiments, the weight height can be between 0.1 inch to 0.2 inch, 0.2 inch to 0.3 inch, 0.3 inch to 0.4 inch, 0.4 inch to 0.5 inch, or 0.5 to 0.6 inch. The weight height can be less than 0.6 inch. In one exemplary embodiment, the weight height is 0.35 inches. In another exemplary embodiment, the weight height is 0.41 inches.

In many embodiments, the weight member 211, 311 can comprise a weight mass. The weight mass can be between 18 g and 48 g. In some embodiments, the weight mass 211, 311 can range between 18.0 g and 20.0 g, 20.0 g and 22.0 g, 22.0 g and 24.0 g, 24.0 g and 26.0 g, 26.0 g and 28.0 g, 28.0 g and 30.0 g, 30.0 g and 32.0 g, 32.0 g and 34.0 g, 34.0 g and 36.0 g, 36.0 g and 38.0, 38.0 g and 40.0 g, 40.0 g and 42.0 g, 42.0 g and 44.0 g, 44.0 g and 46.0 g, or 46.0 g and 48.0 g. In some embodiments the mass of the weight member 211, 311 can be greater than 20 g, greater than 25 g, greater than 30 g, greater than 35 g, greater than 40 g, or greater than 45 g. The weight mass and the weights position in the golf club head perimeter move the CG down and back.

In many embodiments, the weight assembly 214, 314 can comprise a weight assembly mass. As discussed above, the weight assembly 214, 314 can comprise the weight member 211,311, a fastener, and the weight channel 210, 310 including the support material that makes up the weight channel. The weight assembly mass can be between 22 grams and 50 grams. In some embodiments, the mass of the weight assembly 214, 314 can be between 22.0 g and 24.0 g, 24.0 g and 26.0 g, 26.0 g and 28.0 g, 28.0 g and 30.0 g, 30.0 g and 32.0 g, 32.0 g and 34.0 g, 34.0 g and 36.0 g, 36.0 g and 38.0, 38.0 g and 40.0 g, 40.0 g and 42.0 g, 42.0 g and 44.0 g, 44.0 g and 46.0 g, 46.0 g and 48.0 g, or 48.0 g and 50.0 g. The weight assembly mass as well as its position in the golf club head perimeter can play a key role in moving the CG down and back.

The weight member 211, 311 may have sufficient mass to affect golf club head performance. In some embodiments, the mass of the weight member 211, 311 is at least 18.0 grams. In other embodiments, the mass of the weight member 211, 311 and fastener 213, 313 combined is at least 22.0 grams. Lower masses for the weight member 211, 311 or weight member 211, 311 and fastener 213, 313 can be insufficient to affect golf club head performance in a meaningful manner, given the restriction of movement from the weight channel 210, 310 size and location imposes on movement of the weight member 211, 311.

In some embodiments, the weight member 211, 311 can comprise an asymmetric shape, wherein the cross-sectional shape of the weight member 211, 311 in a heel end 206, 306 to toe end 207, 307 direction is non-uniform. In some embodiments, the weight member 211, 311 can comprise a generally rectangular shape. In other embodiments, the weight member 211, 311 can comprise any shape. For example, the shape of the weight member 211, 311 can comprise a circle, an ellipse, a triangle, a rectangle, an octagon, or any other polygon or shape comprising at least two curved surfaces. As discussed above the weight member 211, 311 can comprise a compatible geometry to the weight channel 210, 310.

The weight member 211, 311 can be made out of a single material or multiple different materials. The weight member 211, 311 can be made of any material, such as metals, polymers (e.g. thermoplastic polyurethane, thermoplastic elastomer), composites, or any combination thereof. The weight member 211, 311 can be a polymer injection molded with different quantities of a high-density material (e.g. metal powder) or materials of different densities, to achieve backweights of varying mass, while maintaining the same volume. Injection molded weight members with different densities allow for a wide range of weight members with an identical volume and geometric shape.

In some embodiments, more than one weight member 211, 311 can be provided for attachment to the golf club head 200, 300. In some embodiments, the one or more weight members 211, 311 can comprise different masses. In other embodiments, only one weight member 211, 311 may be affixed to the golf club head 200, 300 at a time. In such embodiments, the one or more weight members 211, 311 can be constant or varying in shape and size, resulting in the one or more weight members 211, 311 having constant or varying masses.

As discussed above, in some embodiments the weight member 211, 311 is moveable to each of the attachment points. Each of the attachment points is separated from the adjacent attachment points by an attachment point separation distance. The attachment point separation distance can be between 0.5 inch to 0.6 inch. The attachment point separation distance can be 0.5 inch or 0.6 inch. In one exemplary embodiment, the attachment point separation distance is 0.6 inch. Moving the weight member 211, 311 from one attachment point to another moves the large mass of the weight member 211, 311 such that the overall CG of the golf club head is displaced. The movement of the weight member provides shot shaping between 5-15 yards left to right or 5-15 yards right to left direction.

In one embodiment, the weight member 211, 311 can be configured in the weight channel 210, 310 to set up in a neutral position to hit a straight golf shot. The central positioning of the weight member 211, 311 within the weight channel 210, 310 leads to a generally straight ball flight, as the center of gravity or CG of the entire golf club head is extremely balanced.

In another embodiment, the weight member 211, 311 can be configured in the weight channel 210, 310 to set up a heel-ward position and hit a fade type golf shot. The heel-ward positioning of the weight member 211, 311 within the weight channel 210, 310 leads to a generally left to right ball flight (for lefthanded golfers a right to left ball flight), as the entire golf club head CG is off center towards the heel end 206, 306 of the golf club head.

In another embodiment, the weight member 211, 311 can be configured in the weight channel 210, 310 to set up a toe-ward position, to hit a draw type golf shot. The toe-ward positioning of the weight member 211, 311 within the weight channel 210, 310 leads to a generally right to left ball flight (for righthanded golfers a left to right ball flight), as the entire golf club head CG is off center towards the toe end 207, 307 of the golf club head.

Further, when the weight member 211, 311, is positioned within the weight channel 210, 310, the weight member 211, 311 slopes downward from the channel rear surface 219, 319 to the rear region 205, 305 of the club such that more of the mass of the weight member 211, 311 is distributed towards the rear region 205, 305 and the sole 203, 303 of the golf club head. This moves the total CG of the club head rearwards and downwards to reduce the upward bending of the club head through impact.

I. POSITIONING OF WEIGHT CHANNEL

As discussed above, the weight assembly 214, 314 can be positioned at an angle relative to the ground plane 1010, known as an assembly angle. The assembly angle can be defined by one or more of several reference features and/or planes as described below. For example, the assembly angle can be an angle formed between the ground plane 1010 and the recess axis 229, 329, the ground plane 1010 and the first surface plane 239, 339, the ground plane 1010 and the second surface plane 242, 342, the ground plane 1010 and the rear surface plane 235, 335, or any other combination thereof. The angling of the weight channel 210, 310 can prevent the oscillation of the weight channel 210, 310 by reducing stresses experienced throughout the weight channel 210, 310. More specifically, the angling of the weight channel 210, 310 can reduce the upward bending motion of the club head and/or redirect the bending motion into a down and forward direction at impact, thereby better distributing stress throughout the golf club head and further increasing the dispersion of stress throughout the rear portion which reduces cyclic fatigue with repeated use and lowers the risk of failure over time, preventing undesired stress risers experienced by weight channels perpendicular to the Z axis.

Reduction and distributing stress placed on the weight channel 210, 310 at impact allows the weight channel support material to be reduced or eliminated, as discussed below, as well as the removal of one or more ribs. This can increase discretionary mass that can then be redistributed throughout the golf club head as desired, providing the ability to increase MOI, CG, or other golf club head parameters. A recess axis 229, 329 can be defined as an axis running through the geometric center of one of the plurality of attachment points on the ZY plane. In one embodiment, the recess axis 229, 329 can be defined as running through the central attachment point on the ZY plane.

The recess axis 229, 329 can form a recess ground angle 228, 328 relative to the ground plane 1010. In some embodiments, the recess ground angle 228, 328 can be between 5 degrees and 55 degrees. In some embodiments, the recess ground angle 228, 328 can be between 5 degrees and 15 degrees, 15 degrees and 25 degrees, 25 degrees and 35 degrees, 35 degrees and 45 degrees, or 45 degrees and 55 degrees. In some embodiments, the recess ground angle 228, 328 can be less than 10 degrees, less than 20 degrees, less than 30 degrees, less than 40 degrees or less than 50 degrees. In some embodiments, the recess ground angle can be 5 degrees, 10 degrees, 15 degrees, 20 degrees, 25 degrees, 30 degrees, 35 degrees, 40 degrees, 45 degrees, 50 degrees or 55 degrees. In one exemplary embodiment, the recess ground angle 228, 328 is approximately 15 degrees. In another exemplary embodiment, the recess ground angle 228, 328 is approximately 45 degrees. The angling of the recess axis 229, 329 can allow the club head 210, 310, to bend downwards through impact instead of upwards, which can reduce the amount of stress placed on the weight channel 210, 310 at impact. More specifically the angling of the weigh channel reduces and redirects the bending of the rear portion at impact. The reduction and redirection of bending can reduce the oscillation of the weight assembly allowing for the use of a heavy weight member further moving the CG down and towards the rear, while reducing the overall oscillation of the weight channel.

Figure 11:
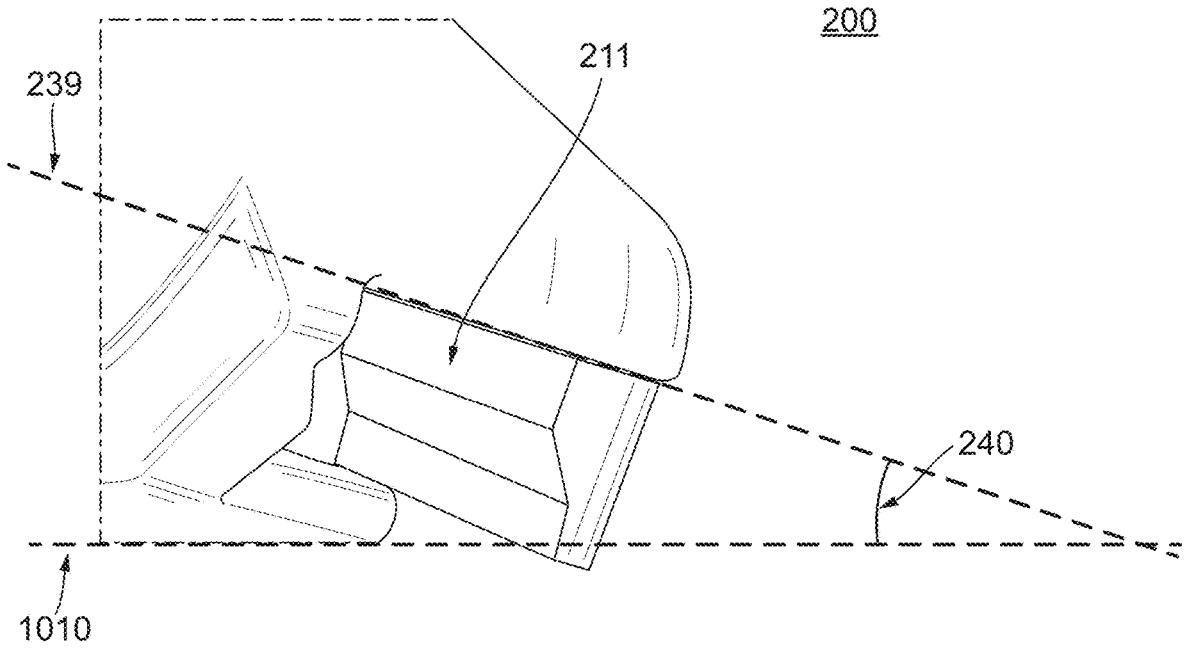
FIG. 11 illustrates a side view of a weight assembly of FIG. 9.

Referring to FIG. 11, the channel first surface 215, 315 can further define a first surface plane 239, 339. The first surface plane 239, 339 can form a first angle 240, 340 relative to the ground plane 1010. In some embodiments, the first angle 240, 340 can be between 5 degrees and 55 degrees. In some embodiments, the first angle 240, 340 can be between 5 degrees and 15 degrees, 15 degrees and 25 degrees, 25 degrees and 35 degrees, 35 degrees and 45 degrees, or 45 degrees and 55 degrees. In some embodiments, the first angle 240, 340 can be less than 100 degrees, less than 20 degrees, less than 30 degrees, less than 40 degrees or less than 50 degrees. In one exemplary embodiment, the first angle 240, 340 is approximately 15 degrees. In another exemplary embodiment, the first angle 240, 340 is approximately 45 degrees. The first surface plane 239, 339 can be approximately parallel to the recess axis 229, 329. The first angle 240, 340 can be approximately parallel to the recess ground plane 228, 238.

Figure 12:
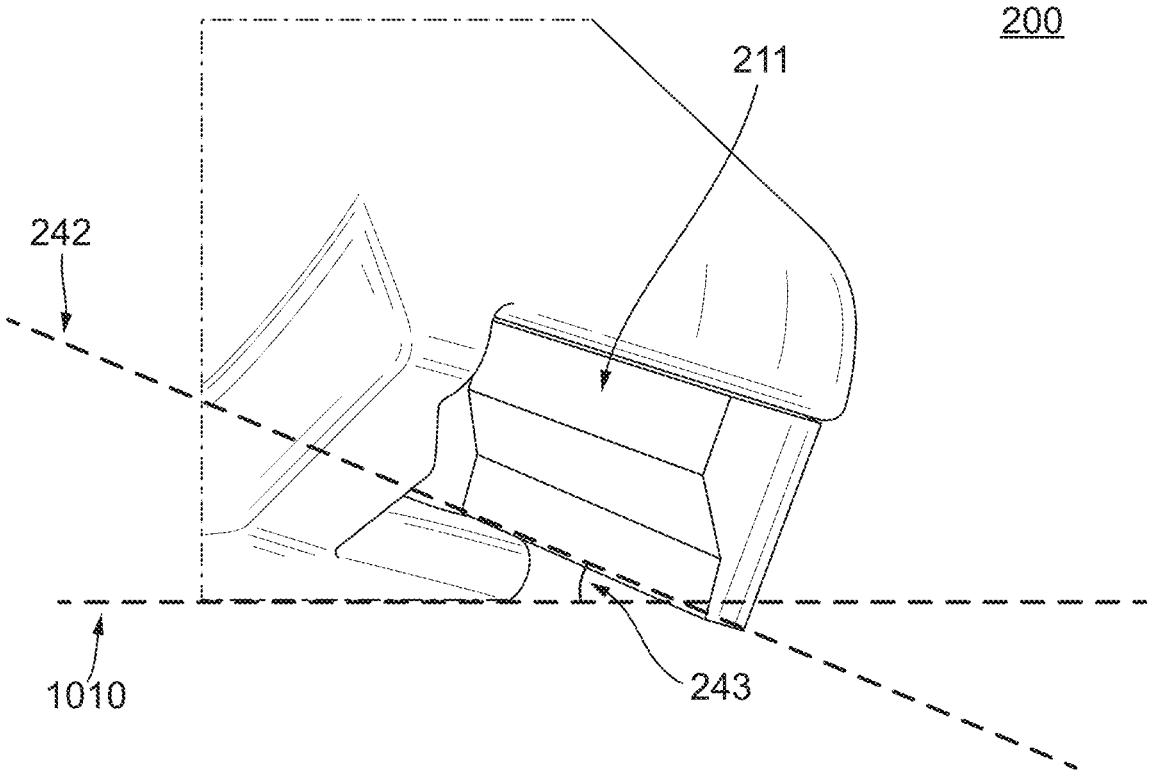
FIG. 12 illustrates a side view of a weight assembly of FIG. 9.
Figure 22:
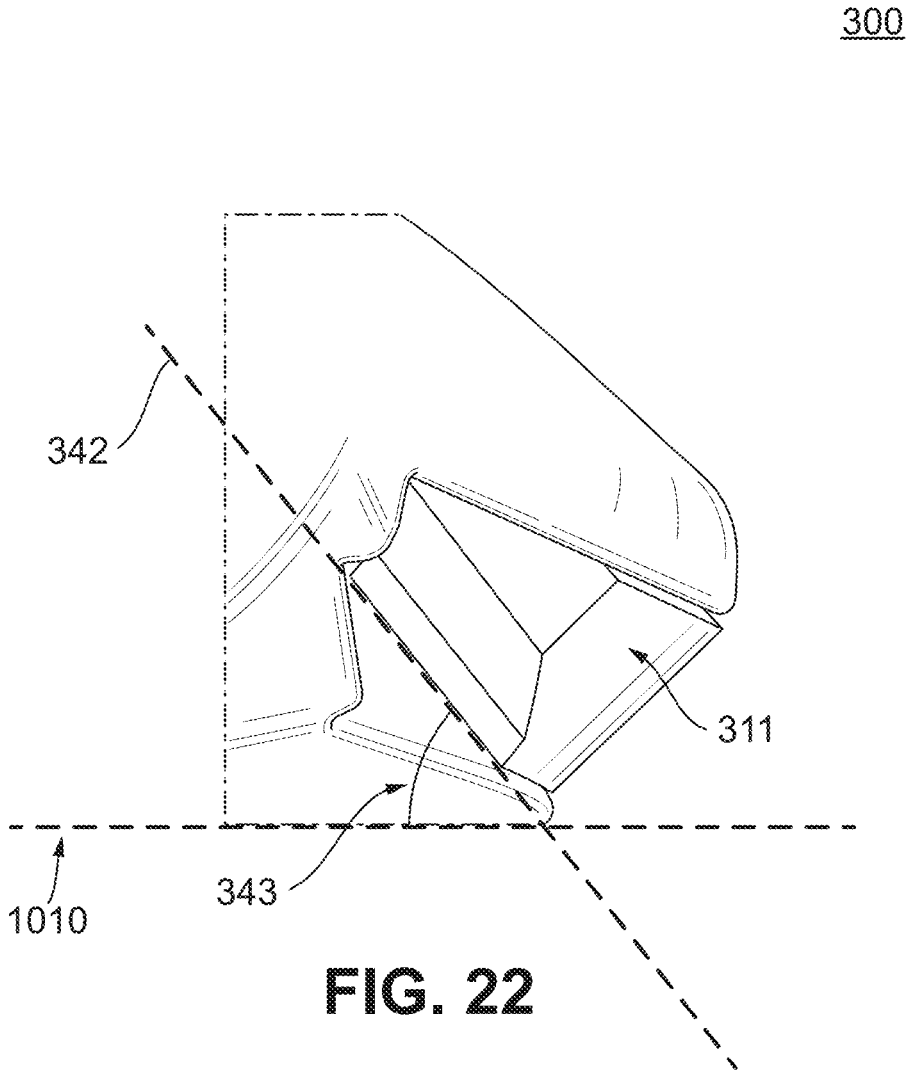
FIG. 22 illustrates a side view of a weight assembly FIG. 19.

As illustrated in FIGS. 12 and 22, the channel second surface 216, 316 can further define a second surface plane 242, 342. The second surface plane 242, 342 can form a second angle 243, 343 with relative to ground plane 1010. In some embodiments, the second angle 243, 343 can be between 15 degrees and 70 degrees. In some embodiments, the second angle 243, 343 can be between 15 degrees and 25 degrees, 25 degrees and 35 degrees, 35 degrees and 50 degrees, or 50 degrees and 70 degrees. In some embodiments, the second angle 243, 343 can be greater than 15 degrees, or greater than 45 degrees. In one exemplary embodiment, the second angle 243, 343 is approximately 21 degrees. In another exemplary embodiment, the second angle 243, 343 is approximately 50 degrees.

Figure 13:
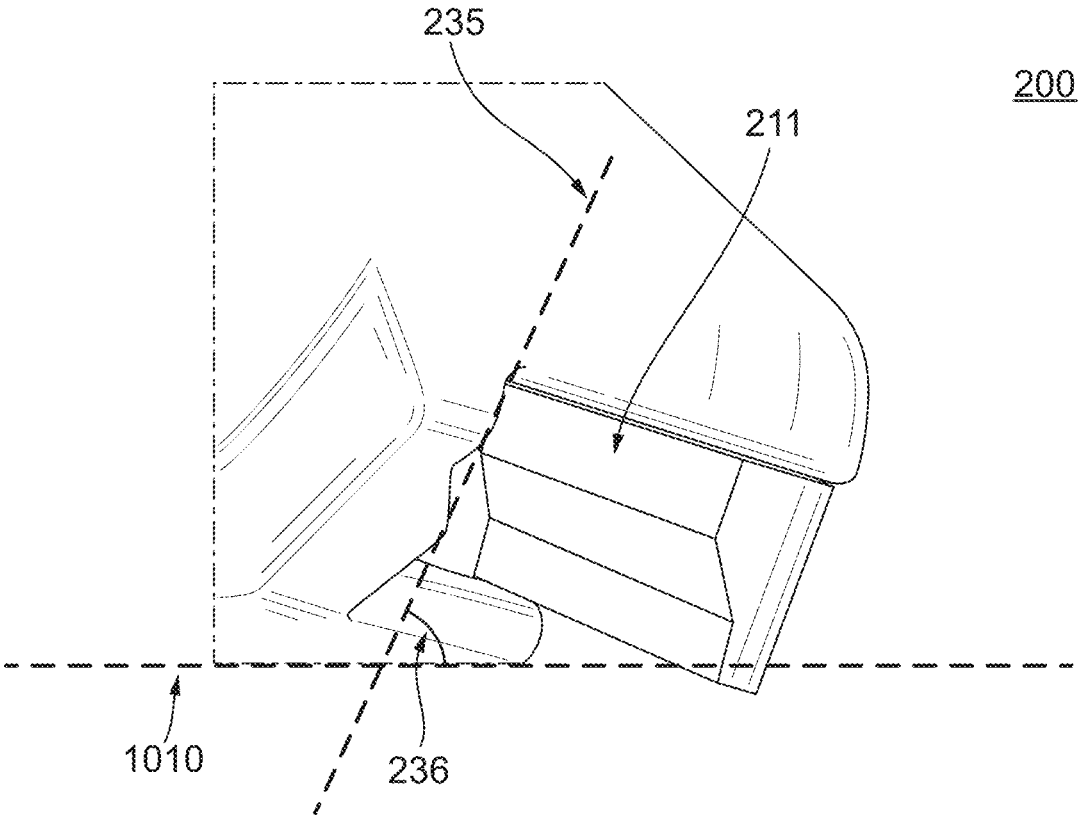
FIG. 13 illustrates a side view of a weight assembly of FIG. 9.
Figure 23:
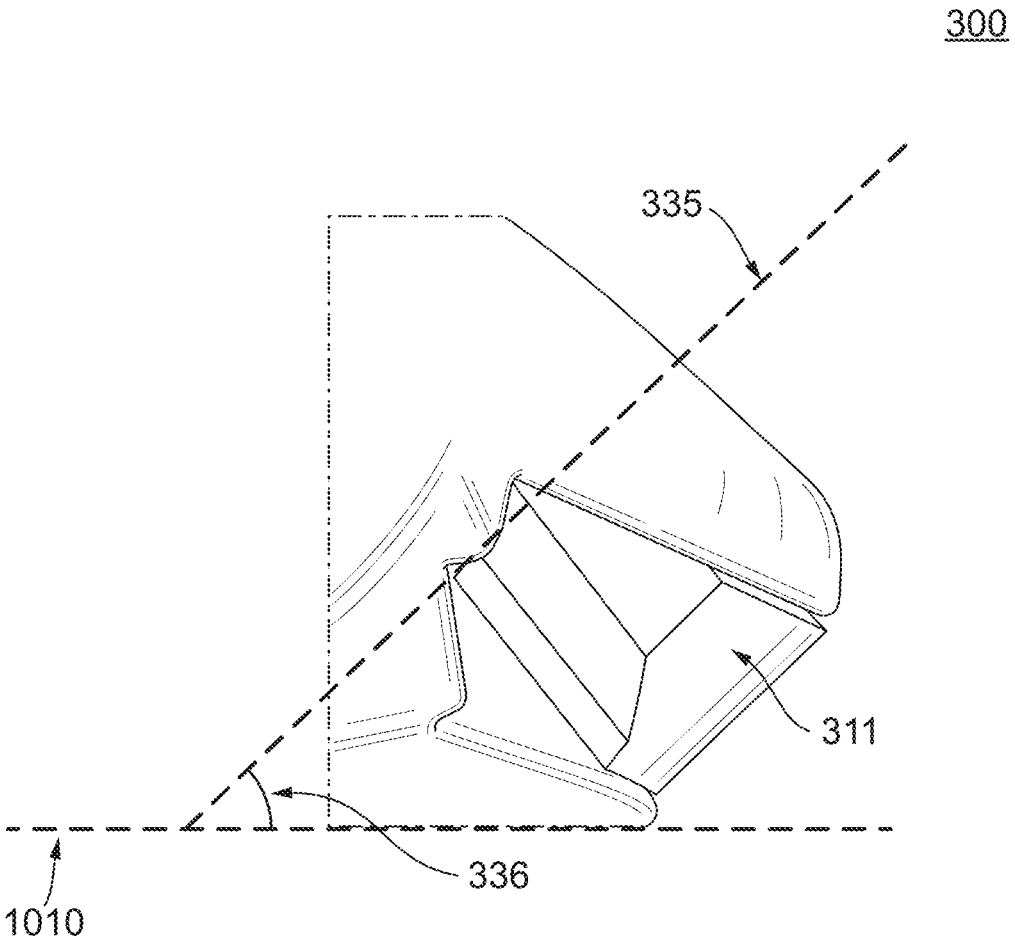
FIG. 23 illustrates a side view of a weight assembly FIG. 19.

As shown in FIGS. 13 and 23, the channel rear surface 219, 319 can further define rear surface plane 235, 335. The rear surface plane 235, 335 can be perpendicular to the recess axis 229, 329. The rear surface plane 235, 335 can form a rear angle 236, 336 relative to the ground plane 1010. In some embodiments, the rear angle 236, 336 can be between 100 degrees and 140 degrees. In some embodiments, the rear angle 236, 336 can be between 100 degrees and 110 degrees, 110 degrees and 120 degrees, 120 degrees and 130 degrees, or 130 degrees and 140 degrees. In some embodiments, the rear angle 236, 336 can be greater than 100 degrees, greater than 110 degrees, greater than 120 or greater than 130 degrees. In one exemplary embodiment, the rear angle 236, 336 is approximately 107 degrees. In another exemplary embodiment, the rear angle 236, 336 is approximately 136 degrees.

Figure 14A:
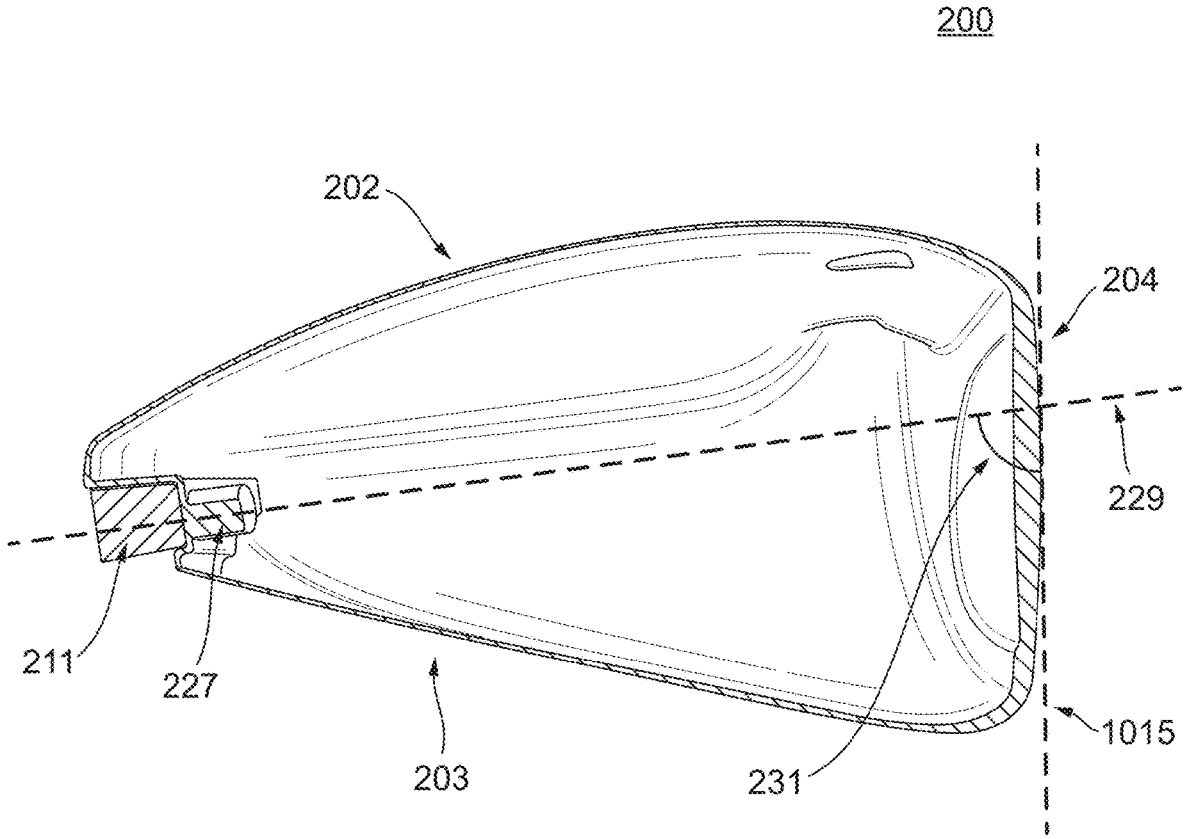
FIG. 14A illustrates a cross-sectional view of the golf club head of FIG. 5.
Figure 24A:
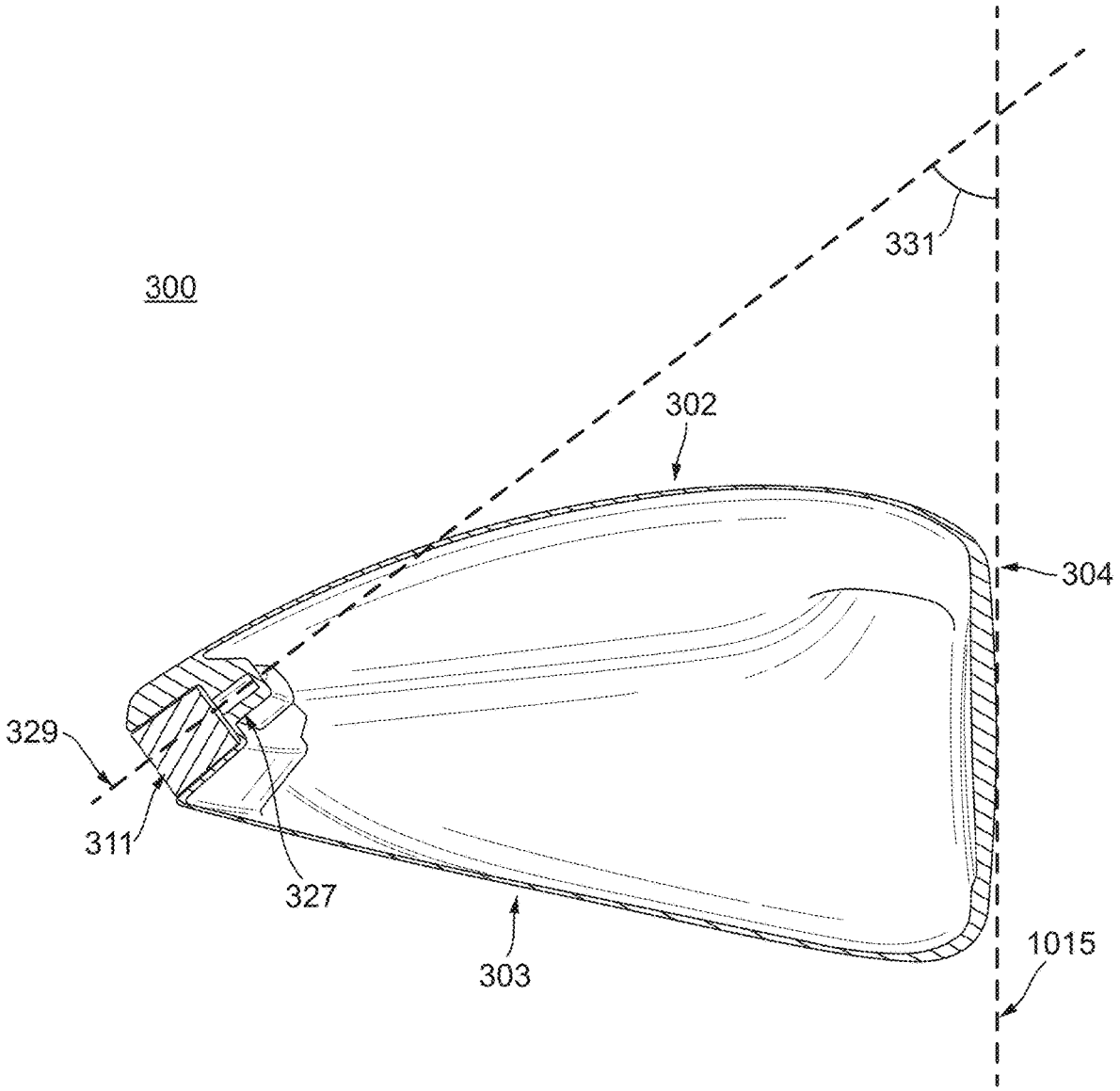
FIG. 24A illustrates a cross-sectional view of the golf club head of FIG. 17.

Referring to FIGS. 14A and 24A, the recess axis 229, 329 can form a recess loft angle 231, 331 relative to the loft plane 1015. In some embodiments the recess loft angle 231, 331 can be between 85 degrees and 135 degrees. In some embodiments, the recess loft angle 231, 331 can be between 85 degrees and 95 degrees, 95 degrees and 105 degrees, 105 degrees and 115 degrees, 115 degrees and 125 degrees, or 125 degrees and 135 degrees. In some embodiments, the recess loft angle 231, 331 can be greater than 85 degrees, greater than 95 degrees, greater than 105 degrees, greater than 115 degrees, or greater than 125 degrees. In one exemplary embodiment, the recess loft angle 231, 331 is 96 degrees. In another exemplary embodiment, the recess loft angle 231, 331 is 125 degrees.

Figure 14B:
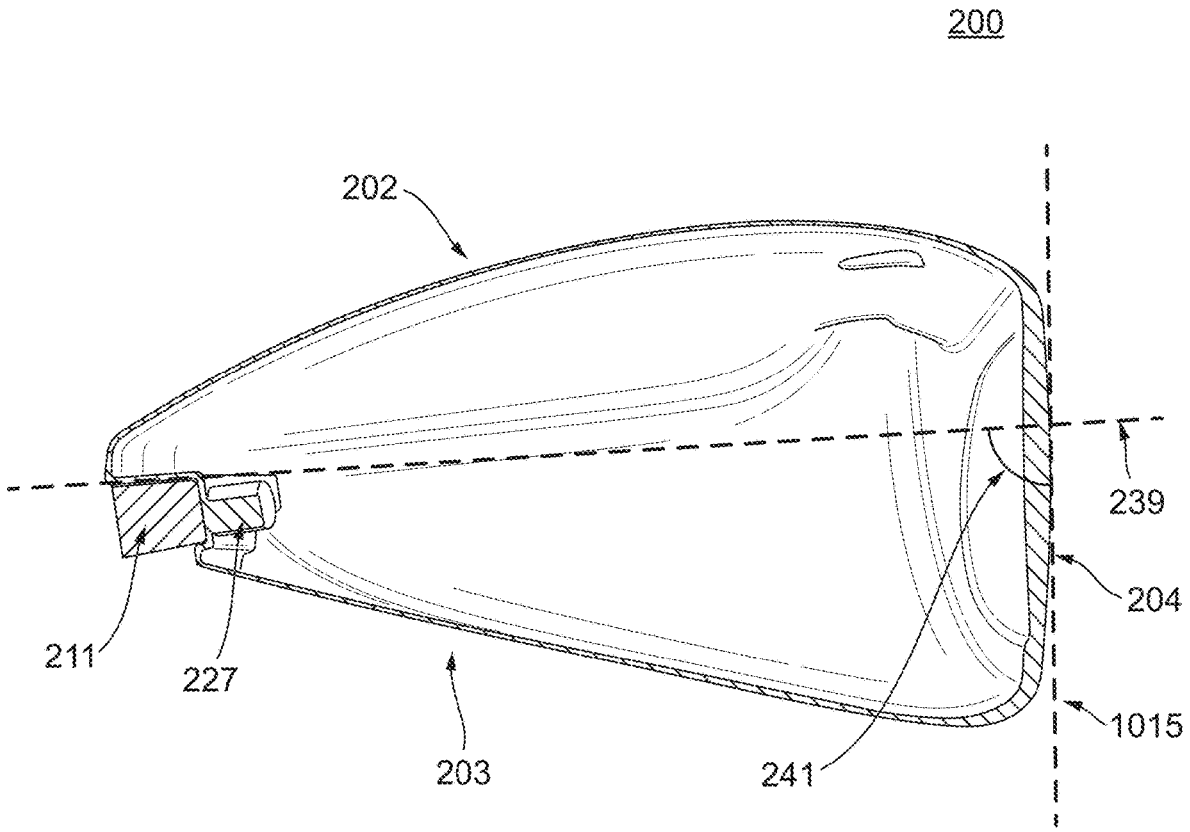
FIG. 14B illustrates a cross-sectional view of the golf club head of FIG. 5.
Figure 24B:
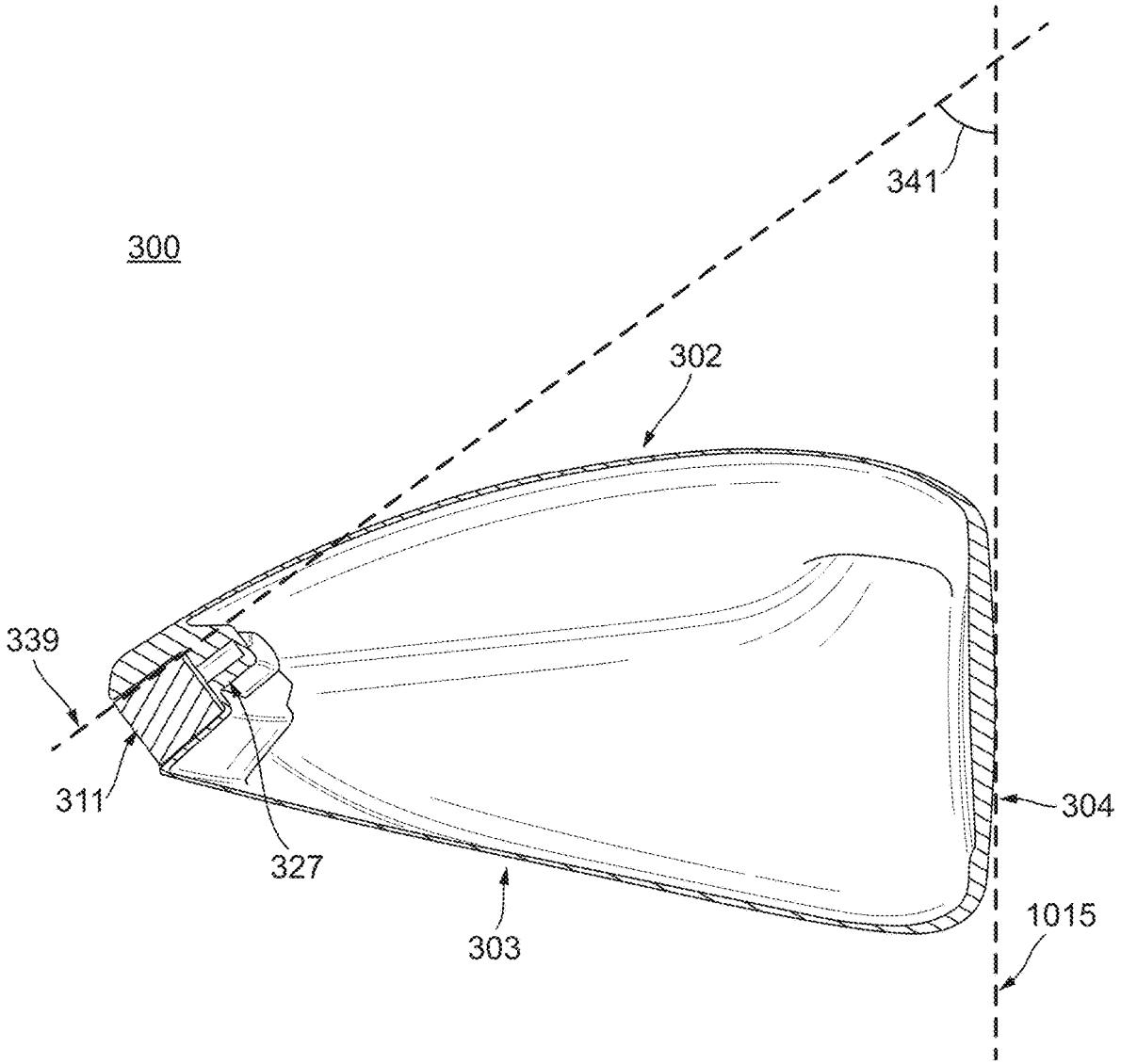
FIG. 24B illustrates a cross-sectional view of the golf club head of FIG. 17.

Referring to FIGS. 14B and 24B, the channel first surface plane 239, 339 can form a first loft angle 241, 341 relative to the loft plane 1015. In some embodiments, the first loft angle 241, 341 can be between 85 degrees and 135 degrees. In some embodiments, the first loft angle 241, 341 can be between 85 degrees and 95 degrees, 95 degrees and 105 degrees, 105 degrees and 115 degrees, 115 degrees and 125 degrees, or 125 degrees and 135 degrees. In some embodiments, the first loft angle 241, 341 can be greater than 90 degrees, greater than 110 degrees, greater than 120 degrees, or greater than 130 degrees. In one exemplary embodiment, the first loft angle 241, 341 is 93 degrees. In another exemplary embodiment, the first loft angle 241, 341 is 122 degrees.

Figure 14C:
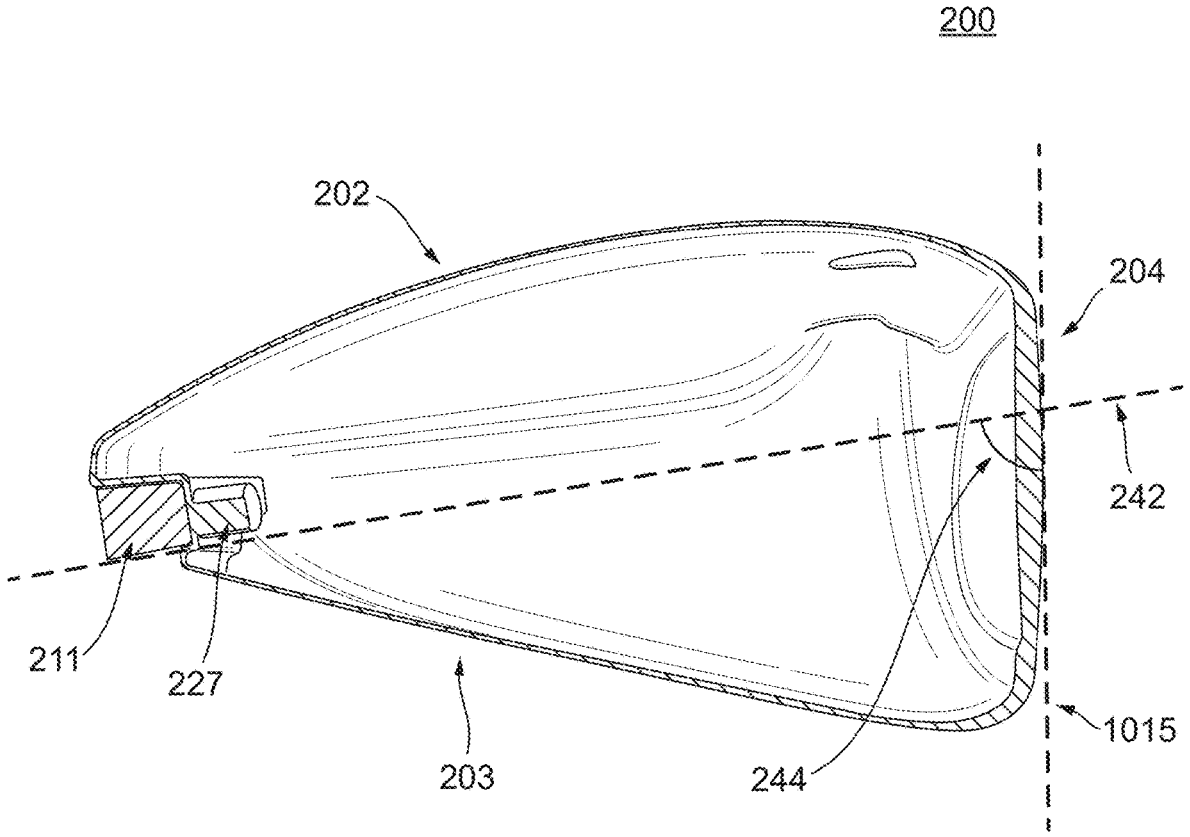
FIG. 14C illustrates a cross-sectional view of the golf club head of FIG. 5.
Figure 24C:
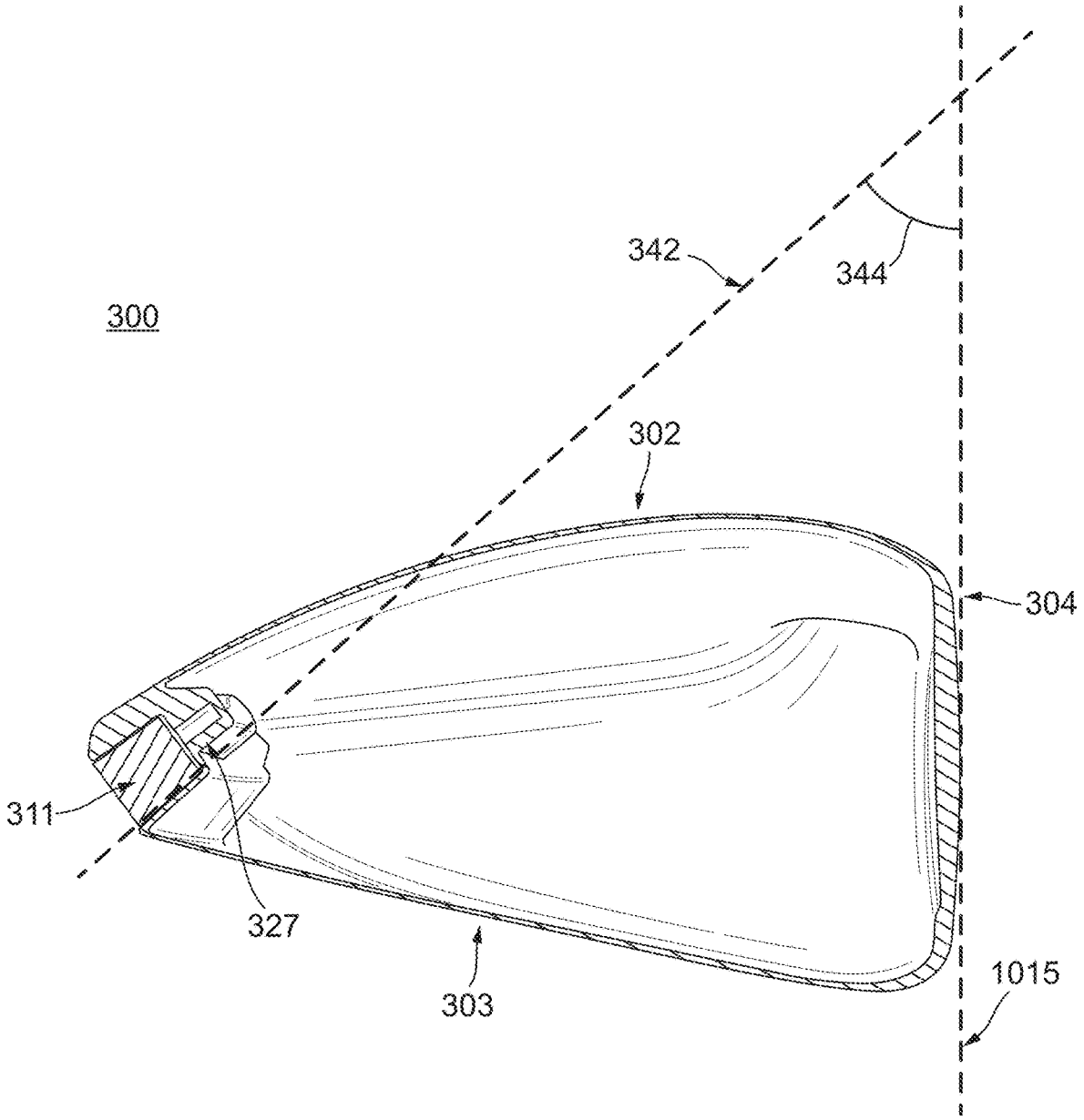
FIG. 24C illustrates a cross-sectional view of the golf club head of FIG. 17

Referring to FIGS. 14C and 24C, the channel second surface plane 242, 342 can form a second loft angle 244, 344 relative to the loft plane. In some embodiments, the second loft angle 244, 344 can be between 85 degrees and 135 degrees. In some embodiments, the second loft angle 244, 344 can be between 85 degrees and 95 degrees, 95 degrees and 105 degrees, 105 degrees and 115 degrees, 115 degrees and 125 degrees, or 125 degrees and 135 degrees. In some embodiments, the second loft angle 244, 344 can be greater than 85 degrees, greater than 95 degrees, greater than 105 degrees, greater than 115 degrees, or greater than 125 degrees. In one exemplary embodiment, the second loft angle 244, 344 is 99 degrees. In another exemplary embodiment, the second loft angle 244, 344 is 128 degrees.

Figure 15A:
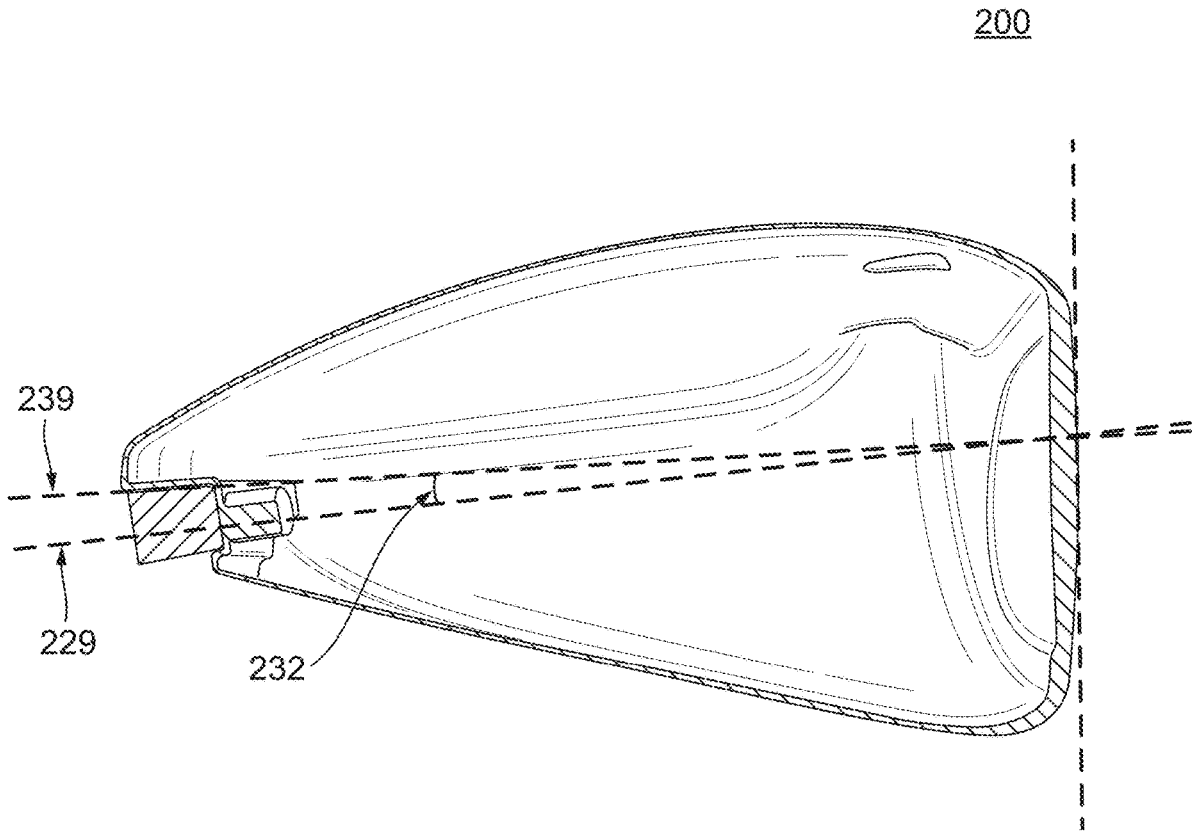
FIG. 15A illustrates a cross-sectional view of the golf club head of FIG. 5.
Figure 25A:
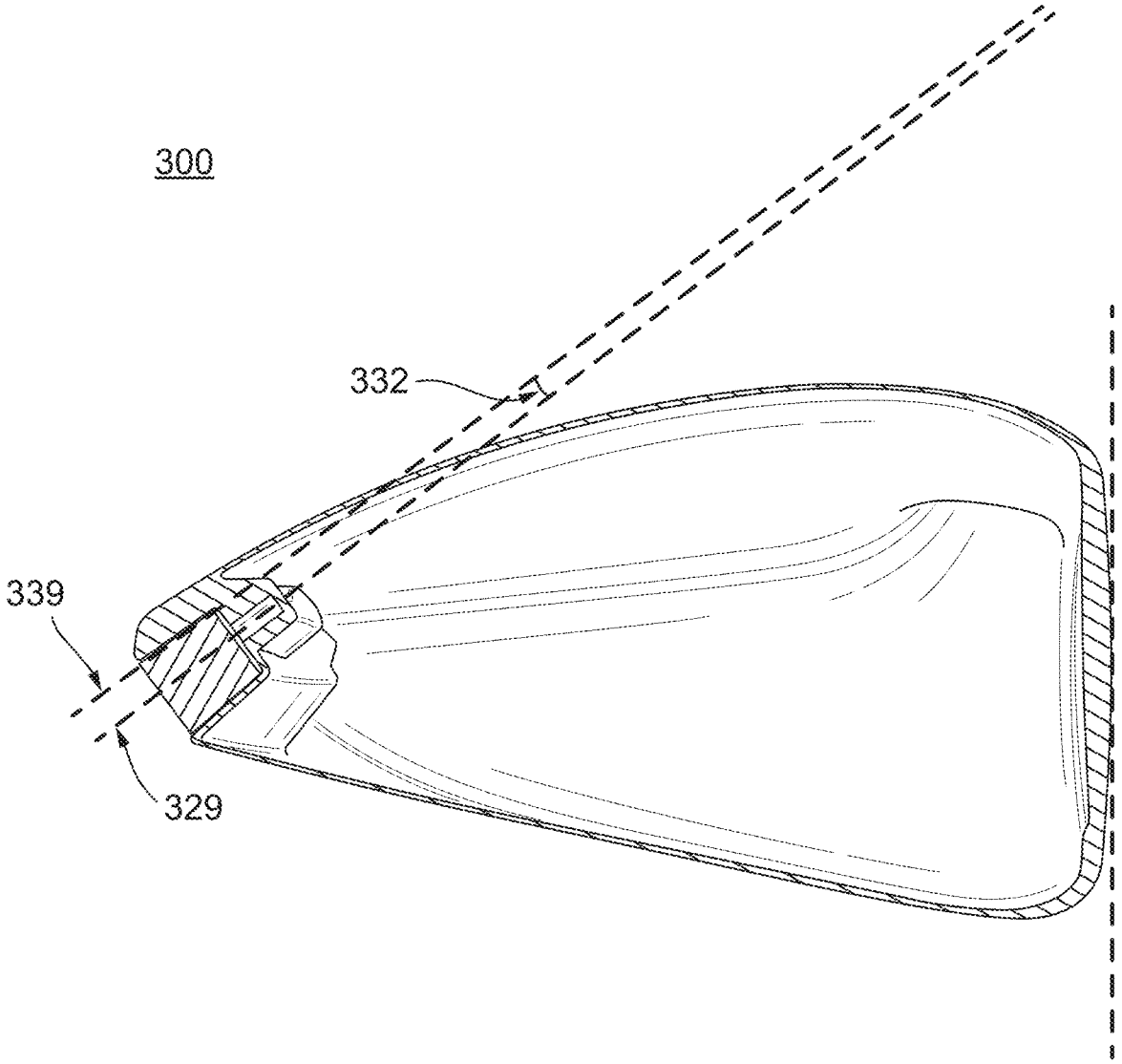
FIG. 25A illustrates a cross-sectional view of the golf club head of FIG. 17.

Additionally, in embodiments where the plurality of attachment points comprises a plurality of threaded recesses 227, 327. As illustrated in FIGS. 15A and 25A, the recess axis 229, 329 can form a first recess angle 232, 332 relative to the first surface 215, 315. In some embodiments, the first recess angle 232, 332 can be between 0 degrees and 15 degrees. In some embodiments, the first recess angle 232, 332 can be between 0 degrees and 1 degree, 1 degree and 2 degrees, 2 degrees and 3 degrees, 3 degrees and 4 degrees, 4 degrees and 5 degrees, 5 degrees and 6 degrees, or 6 degrees and 7 degrees. In some embodiments, the first recess angle 232, 332 can be less than 5 degrees. In one exemplary embodiment, the first recess angle 232, 332 is approximately 3 degrees. In some embodiments, the first recess angle 232, 332 can be constant across the plurality of recesses 227, 327. In some embodiments, the first recess angle 232, 332 can vary across the plurality of recesses 227, 327.

Figure 15B:
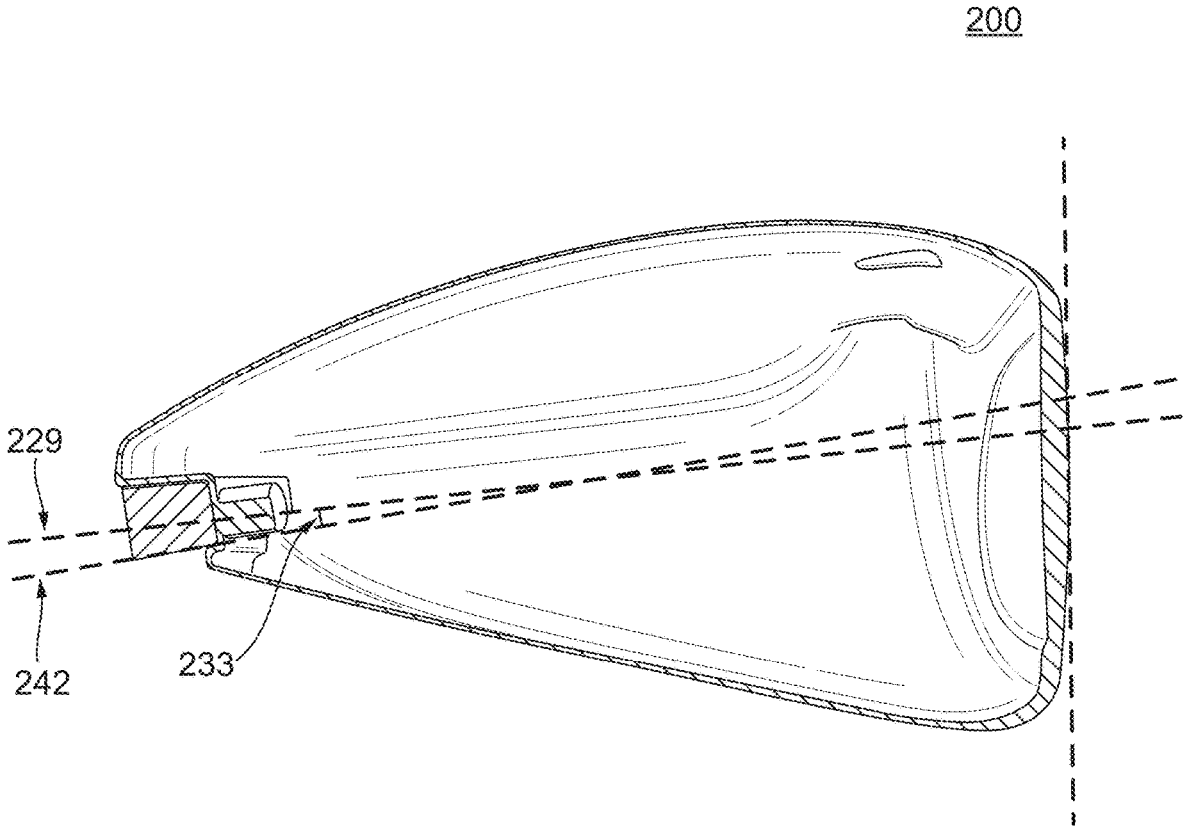
FIG. 15B illustrates a cross-sectional view of the golf club head of FIG. 5.
Figure 25B:
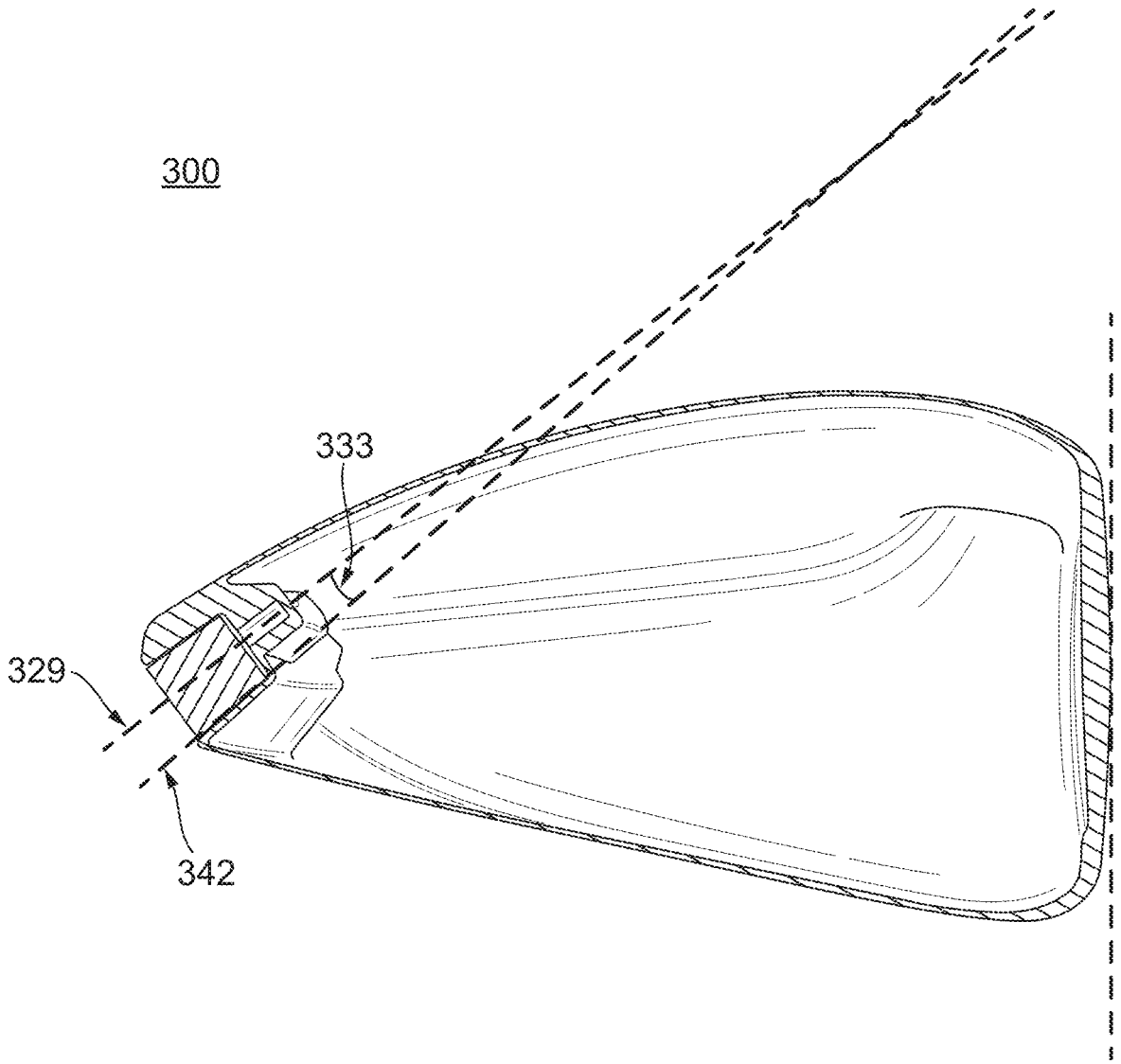
FIG. 25B illustrates a cross-sectional view of the golf club head of FIG. 17.

As illustrated in FIGS. 15B and 25B, the recess axis 229, 329 can form a second recess angle 233, 333 relative to the channel second surface plane 242, 342. In some embodiments, the second recess angle 233, 333 can be between 0 degrees and 6 degrees. In some embodiments, the second recess angle 233, 333 can be between 0 degrees and 1 degree, 1 degree and 2 degrees, 2 degrees and 3 degrees, 3 degrees and 4 degrees, 4 degrees and 5 degrees, or between 5 degrees and 6 degrees. In some embodiments, the second recess degree 233, 333 can be less than 5 degrees. In one exemplary embodiment, the second recess angle 233, 333 is approximately 3 degrees. In some embodiments, the second recess angle 233, 333 can be constant across the plurality of recesses 227, 327. In some embodiments, the second recess angle 233, 333 can vary across the plurality of recesses 227, 327.

Figure 15C:
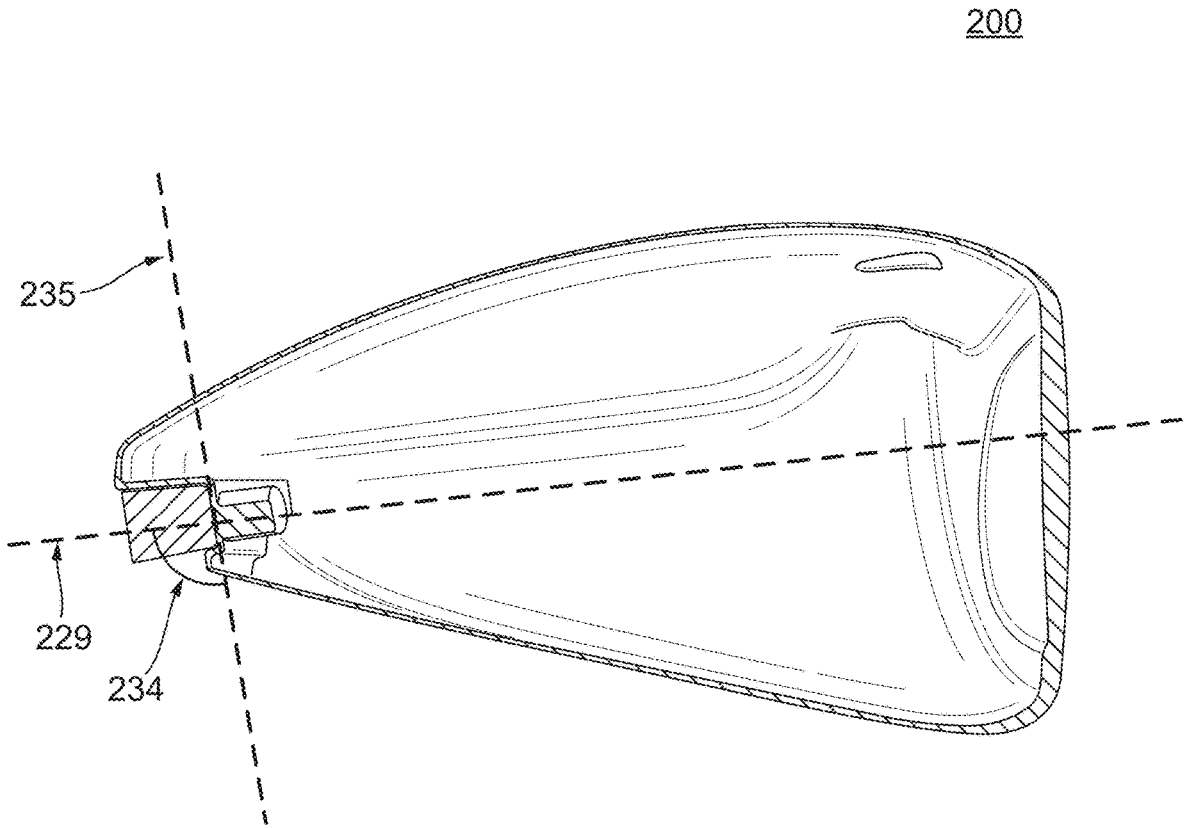
FIG. 15C illustrates a cross-sectional view of the golf club head of FIG. 5.
Figure 25C:
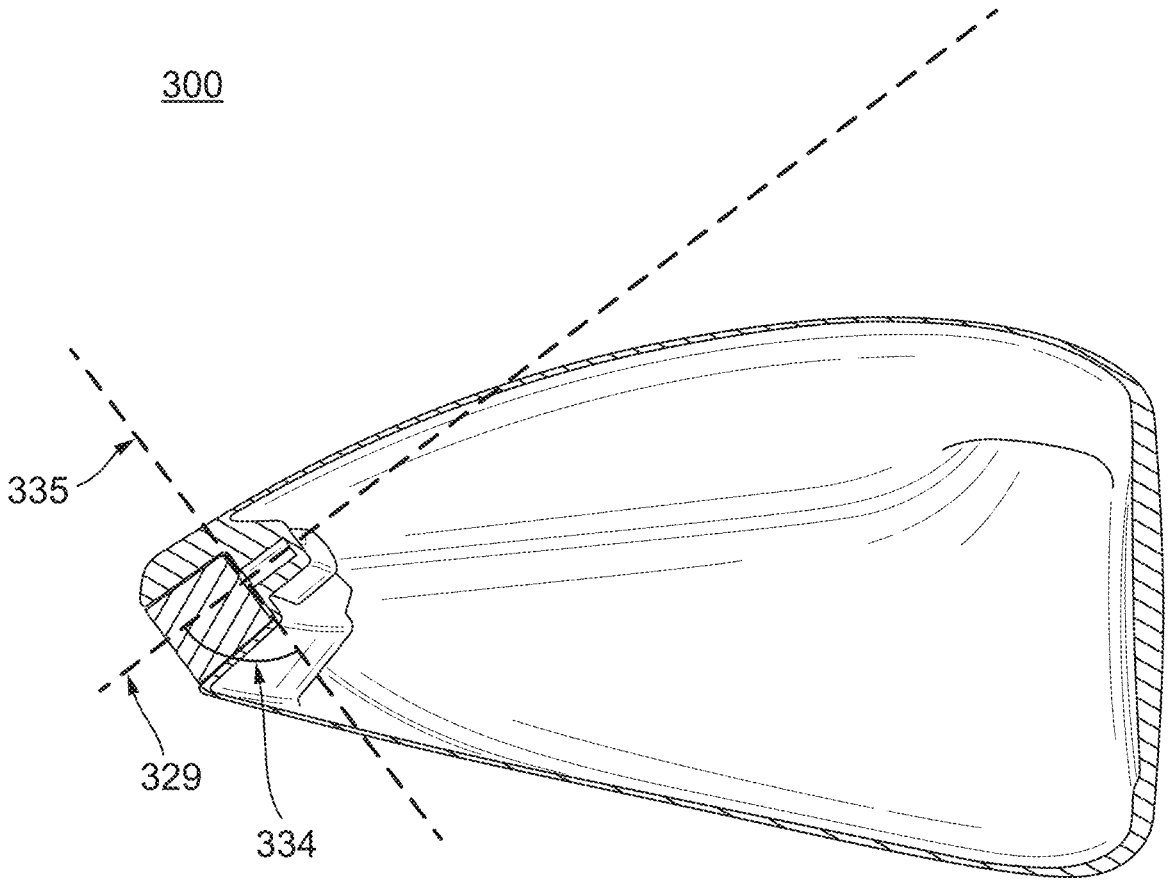
FIG. 25C illustrates a cross-sectional view of the golf club head of FIG. 17.

As shown in FIGS. 15C and 25C, the recess axis 229, 329 can form a rear recess angle 234, 334 relative to the channel rear surface plane 235, 335. In some embodiments, the recess axis 229, 239 can be perpendicular to the rear surface plane 235, 335. In some embodiments, the rear recess angle 234, 334 can be between 80 degrees and 100 degrees. In some embodiments, the rear recess angle 234, 334 can be between 80 degrees and 82 degrees, 82 degrees and 84 degrees, 84 degrees and 86 degrees, 86 degrees and 88 degrees, 88 degrees and 90 degrees, 90 degrees and 92 degrees, 92 degree and 94 degrees, 94 degrees and 96 degrees, 96 degrees and 98 degrees, or 98 degrees and 100 degrees. In some embodiments, the rear access angle can be 8-degrees, 85 degrees, 90 degrees, 95 degrees, or 100 degrees. In one exemplary embodiment, the rear recess angle 234, 334 is approximately 90 degrees. In some embodiments, the rear recess angle 234, 334 can be constant across the plurality of recesses 227, 327. In some embodiments, the rear recess angle 234, 334 can vary across the plurality of recesses 227, 327.

Figure 16:
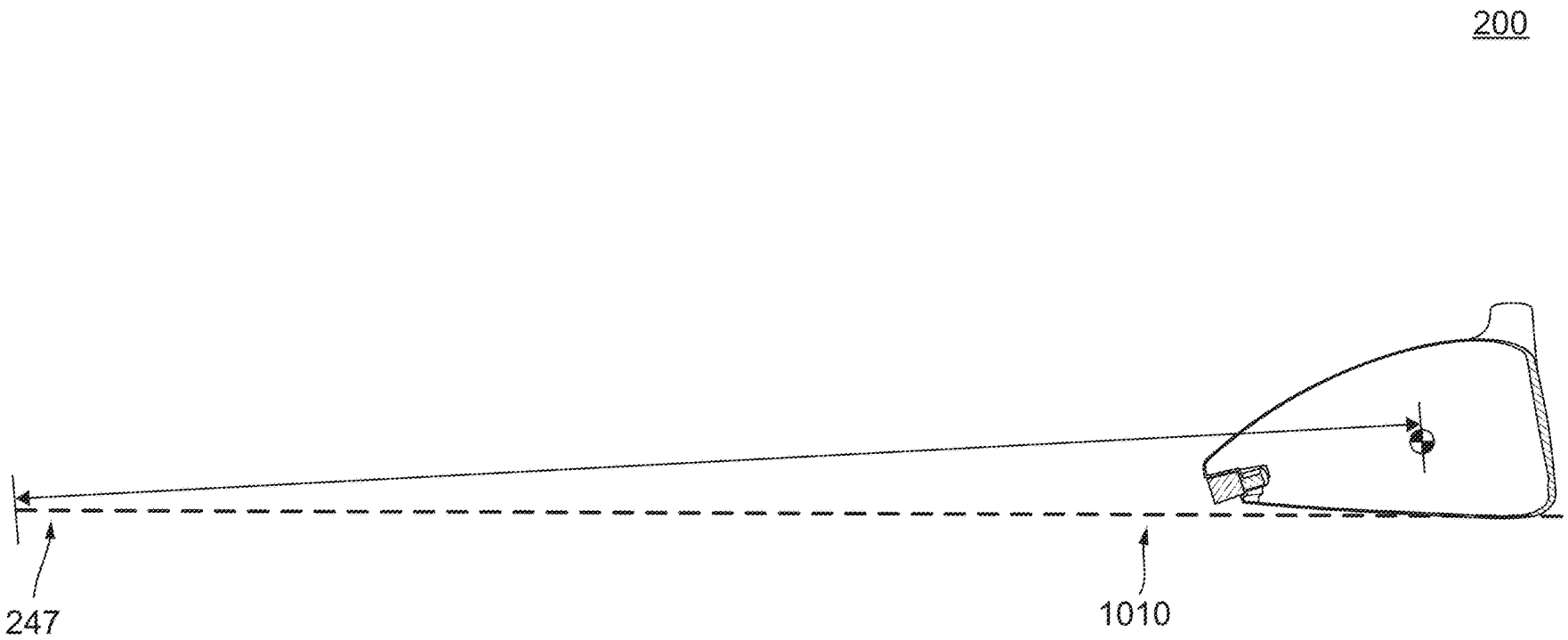
FIG. 16 illustrates a cross-sectional view of the golf club head of FIG. 5.
Figure 17:
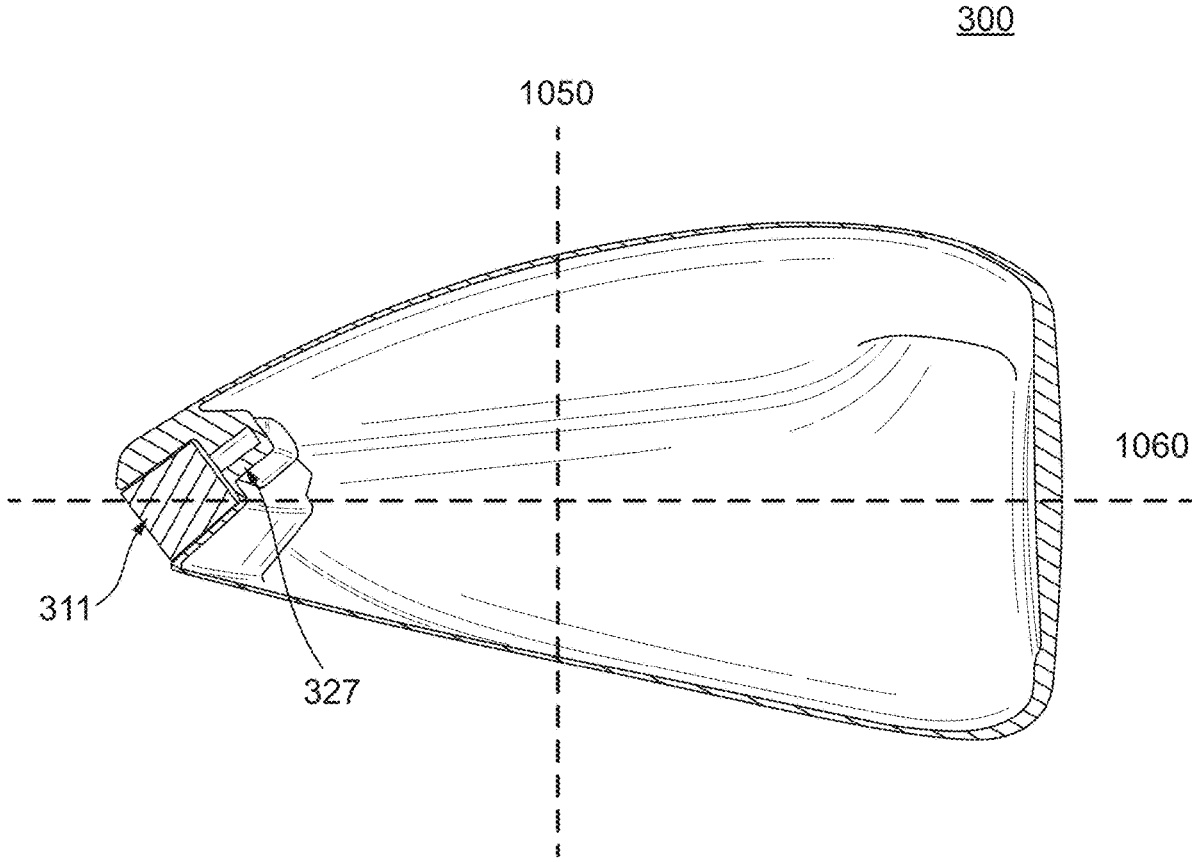
FIG. 17 illustrates a cross-sectional view of a golf club head according to a second embodiment.
Figure 26:
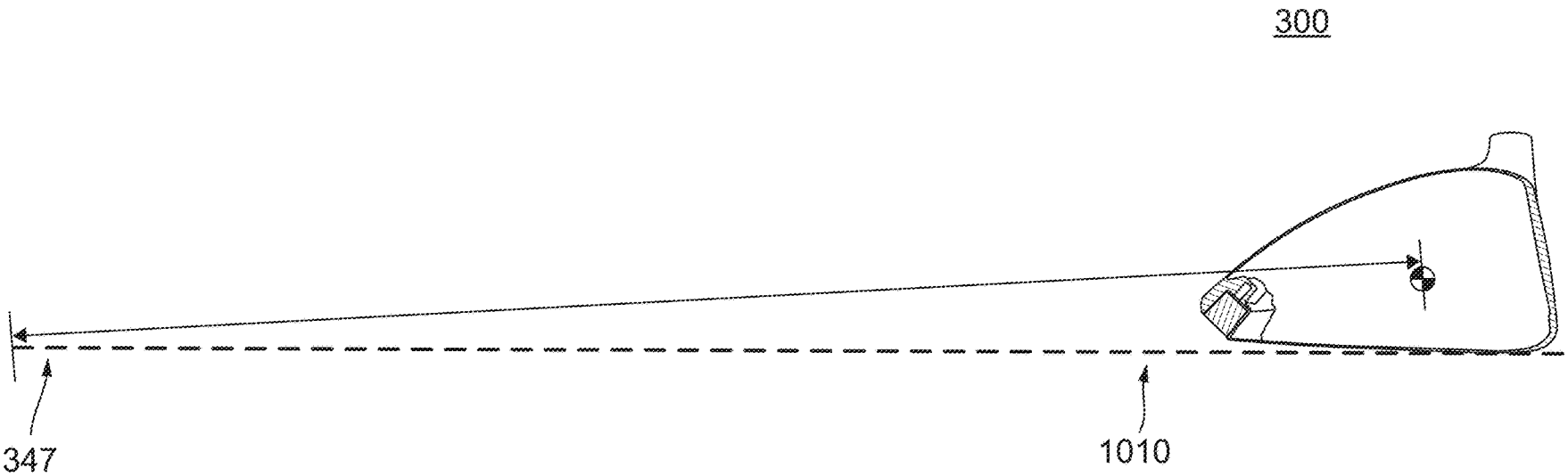
FIG. 26 illustrates a cross-sectional view of the golf club head of FIG. 17.

Further, the recess axis 229, 329 can intersect the ground plane 1010. The point where the recess axis 229, 329 intersects the ground plane 1010 can define an RG point 247, 347, as illustrated in FIGS. 16 and 26. A distance can be defined between the RG point 247, 347 and the center of gravity (hereafter referred to as "RGCG distance"). In some embodiments, the RGCG distance can be between 2.75 inches and 4.25 inches. In some embodiments, the RGCG distance can be between 2.75 inches and 3.00 inches, 3.00 inches and 3.25 inches, 3.25 inches and 3.50 inches, 3.50 inches and 3.75 inches, 3.75 inches and 4.00 inches, or 4.00 inches and 4.25 inches. In some embodiments, the RGCG distance can be less than 6.0 inches or less than 5.0 inches. In one exemplary embodiment, the RGCG distance is 4.04 inches. In another exemplary embodiment, the RGCG distance is 3.19 inches. In another exemplary embodiment, the RGCG distance is 2.46 inches.

Additionally, a distance can be defined between the RG to the leading edge of the club head (hereafter known as "RGLE"). In some embodiments, the RGLE distance can be between 4.6 inches and 6.0 inches. In some embodiments, the RGLE distance can be between 4.6 inches and 4.8 inches, 4.8 inches and 5.0 inches, 5.0 inches and 5.2 inches, 5.2 inches and 5.4 inches, 5.4 inches and 5.6 inches, 5.6 inches and 5.8 inches, or 5.8 inches and 5.0 inches. In some embodiments, the RGLE distance can be less than 6.0 inches or less than 5.0 inches. In one exemplary embodiment, the RGLE distance is 5.80 inches. In another exemplary embodiment, the RGLE distance is 4.94 inches.

The angling of the weight assembly 214, 314 can both decrease and redirect the bending motion of the golf club head 200, 300 into a down and forward direction at impact. This improved bending motion can decrease the stress placed upon the golf club head 200, 300, and more specifically on the weight channel 210, 310. Reducing stress on the weight channel 210, 310 can reduce or eliminate support material, increasing discretionary mass that can then be redistributed throughout the golf club head 200, 300.

Reducing or eliminating the ribs can provide several advantages. With the bending movement directed downwards and forward, instead of upwards and forward, the internal ribs can be reduced in mass or removed entirely. Within the golf club head 200, 300, the ribs can form a radial orientation along the crown 202, 302. The club head can comprise one or more ribs. In some embodiments, there can be one rib, two ribs, three ribs, four ribs, five ribs, six ribs, seven ribs, eight ribs. In one exemplary embodiment, the golf club head 200, 300 comprises six ribs.

Further, the mass removed from the rib support structures can be reallocated to other areas, such as the weight to improve other club head characteristics such as the center of gravity and moment of inertia. Shifting the center of gravity can improve club characteristics such as launch angle and spin rate. Increasing the launch angle and spin rate can lower of the static loft of wood-type golf clubs. The aforementioned characteristics can be achieved through angling of the weight channel.

The weight assembly 214, 314 can further comprise support material. As the angle of the weight assembly changes, a mass structure can be placed around the weight assembly 214, 314 internally to provide extra support. The mass structure further can move the CG lower and to the back.

II. RELATIONSHIPS

Weight channels perpendicular to the z axis maintain a preferable CG low and towards the rear, but are not stable through impact. Weight channels parallel to the z axis become more stable through impact through the use of added support material which pushes the CG forward, towards the strike face. Weight channels angled between 5-50 degrees find the balance between maintaining the CG low and towards the rear, all while keeping the weight channel stable through impact. The position of the weight member 211, 311 can directly affect golf club head parameters, such as the CG and MOI. The weight member 211, 311 can be positioned behind the CG relative to the Z-axis, below the CG relative to the y-axis, and heelward of the CG relative to the X-axis. The position of the weight member 211, 311 relative to the CG can be manipulated by the user as the weight member 211, 311 is moved from one attachment point 245, 345 to another.

The bending of the weight channel can have a direct correlation to the displacement of the weight during and after impact. The y-displacement in particular can displace the amount of stress placed on the weight channel. The angling of the weight channel can both reduce and redirect the bending of the golf club head at impact further reducing stress and the y-displacement. In many embodiments, the club head 200, 300 satisfies one or more of the following relations, such that the y-displacement of the golf club head is decreased.

$$Y=2e^{-09}x^5-3e^{-07}x^4+2e^{-05}x^3-0.0003x^2+0.0021x-0.003 \quad \text{Relation 1}$$

$$Y=2e^{-09}x^5-3e^{-07}x^4+2e^{-05}x^3-0.0004x^2+0.0028x-0.0043 \quad \text{Relation 2}$$

$$Y=1e^{-09}x^5-3e^{-07}x^4+2e^{-05}x^3-0.0003x^2+0.0022x-0.0031 \quad \text{Relation 3}$$

$$Y=2e^{-09}x^5-4e^{-07}x^4+2e^{-05}x^3-0.0004x^2+0.0027x-0.004 \quad \text{Relation 4}$$

As discussed above, the weight member 211, 311 can be positioned a distance from the club head CG relative to the x-axis, hereafter referred to as DWX. DWX can be defined as the distance from the club head CG to the weight CG relative to the x-axis. In some embodiments, DWX can be between −0.155 and −0.115 inches. In some embodiments, DWX can be between −0.155 inches and −0.145 inches, −0.145 inches and −0.135 inches, −0.135 inches and −0.125 inches, or −0.125 inches and −0.115 inches. In one exemplary embodiment, DWX is −0.142 inches. In another exemplary embodiment DWX is −0.120 inches. When comparing the DMX of the angled weight port to one that is perpendicular to the z axis, the DMX is longer.

As discussed above, the weight member 211, 311 can be positioned a distance from the club head CG relative to the y-axis, hereafter referred to as DWY. DWY can be defined as the distance from the club head CG to the weight CG relative to the y-axis. In some embodiments, DWY can be between −0.620 and −0.440. In some embodiments, DWY can be between −0.620 inches and −0.600 inches, −0.600 inches and −0.580 inches, −0.580 inches and −0.560 inches, −0.560 inches and −0.540 inches, −0.540 inches and −0.520 inches, −0.520 inches and −0.500 inches, −0.500 inches and −0.480 inches, −0.480 inches and −0.460 inches, or −0.460 inches and −0.440 inches. In one exemplary embodiment, DWY is −0.610 inches. In another exemplary embodiment, DWY is −0.459 inches. It can be desirable to maximize the DWY as the greater DWY is the greater the MOI relative to the y-axis. Further, an increase DWY point to a down and back CG location, which promotes improved shot parameters such as launch angle and spin rate. When comparing the DMY of the angled weight port to one that is perpendicular to the z axis, the DMY is longer.

As discussed above, the weight member 211, 311 can be positioned a distance from the club head CG relative to the z-axis, hereafter referred to as DWZ. DWZ can be defined as the distance from the club head CG to the weight CG relative to the z-axis. In some embodiments, DWZ can be between −2.625 and −2.500. In some embodiments, DWZ can be between −2.625 and −2.600, −2.600 and −2.575, or −2.575 and −2.550. In one exemplary embodiment, DWZ is −2.643 inches. In another exemplary embodiment, DWZ is −2.612 inches. When comparing the DMZ of the angled weight port to one that is perpendicular to the z axis, the DMZ is longer.

Further, the weight member 211, 311 can be positioned a distance from the strike face geometric center relative to the x-axis, hereafter referred to as DFX. DFX can be defined as the distance from the geometric center of the strike face 204, 304 to the weight CG relative to the x-axis. In some embodiments, DFX can be between −0.210 inches and −0.150 inches. In some embodiments, DFX can be between −0.210 inches and −0.200 inches, −0.200 inches and −0.190 inches, −0.190 inches and −0.180 inches, −0.180 inches and −0.170 inches, −0.170 inches and −0.160 inches, or −0.160 inches and −0.150 inches. In one exemplary embodiment, DFX is −0.198 inches. In another exemplary embodiment, DFX is −0.176 inches. When comparing the DFX of the angled weight port to one that is perpendicular to the z axis, the DFX is longer.

As discussed above, the weight member 211, 311 can be positioned a distance from the strike face geometric center relative to the y-axis, hereafter referred to as DFY. DFY can be defined as the distance from the geometric center of the strike face 204, 304 to the weight CG relative to the y-axis. In some embodiments, DFY can be between −0.850 inches and −0.650 inches. In some embodiments, DFY can be between −0.850 inches and −0.825 inches, −0.825 inches and −0.800 inches, −0.800 inches and −0.775 inches, −0.775 inches and −0.750 inches, −0.750 inches and −0.725 inches, −0.700 inches and −0.675 inches, or −0.675 inches and −0.650 inches. In one exemplary embodiment, DFY is −0.820 inches. In another exemplary embodiment, DFY is −0.668 inches. When comparing the DFY of the angled weight port to one that is perpendicular to the z axis, the DFY is longer.

As discussed above, the weight member 211, 311 can be positioned a distance from the strike face geometric center relative to the z-axis, hereafter referred to as DFZ. DFZ can be defined as the distance from the geometric center of the strike face 204, 304 to the weight CG relative to the z-axis. In some embodiments, DFZ can be between −4.450 inches and −4.300 inches. In some embodiments, DFZ can be between −4.450 inches and −4.425 inches, −4.425 inches and −4.400 inches, −4.400 inches and −4.375 inches, −4.375 inches and −4.350 inches, −4.350 inches and −4.325 inches, or −4.325 inches and −4.300 inches. In one exemplary embodiment, DFZ is −4.388 inches. In another exemplary embodiment, DFZ is −4.349 inches. When comparing the DFZ of the angled weight port to one that is perpendicular to the z axis, the DFZ is longer.

III. MOI/CG

As discussed above, the location and angle of the weight assembly 214, 314 can affect the CG location, which in turn can affect the forgiveness of the golf club, flight direction of the golf ball, and/or flight angle of the golf ball.

As discussed above, the CGx of the angled weight assembly as described above, can be defined as the CG location along the x-axis, measured from the origin point. In some embodiments, the CGx can be between −0.075 inches and −0.005 inches. In some embodiments, the CGx can be between −0.075 inches and −0.065 inches, −0.065 inches and −0.055 inches, −0.055 inches and −0.045 inches, −0.045 inches and −0.035 inches, −0.035 inches and −0.025 inches, −0.025 inches and −0.015 inches, or −0.015 inches and −0.005 inches. In one exemplary embodiment, the CGx is −0.056 inches. In another exemplary embodiment, the CGx is −0.057 inches.

As discussed above, the CGy of the angled weight assembly as described above, can be defined as the CG location along the y-axis, measured from the origin point. In some embodiments, the CGy can be between 0.835 inches and 0.851 inches. In some embodiments, the CGy can be between 0.835 inches and 0.837 inches, 0.837 inches and 0.839 inches, 0.839 inches and 0.841 inches, 0.841 inches and 0.843 inches, 0.843 inches and 0.845 inches, 0.845 inches and 0.847 inches, 0.847 inches and 0.849 inches, or 0.849 inches and 0.851 inches. In one exemplary embodiment, the CGy is 0.842 inches. In another exemplary embodiment, the CGy is 0.844 inches.

As discussed above, the CGz of the angled weight assembly as described above, can be defined as the CG location along the z-axis, measured from the origin point. In some embodiments, the CGz can be between −1.950 inches and −2.000 inches. In some embodiments, the CGz can be between −1.950 inches and −1.960 inches, −1.960 inches and −1.970 inches, −1.970 inches and −1.980 inches, −1.980 inches and −1.990 inches, or −1.990 inches and −2.000 inches. In one exemplary embodiment, the CGz is −1.961 inches. In another exemplary embodiment, the CGz is −1.989 inches.

As discussed above, the MOI can determine how forgiving the golf club head is. Increased MOI can result in increased forgiveness for impacts offset from the center of the striking face. The MOI is a property of the perimeter mass distribution of the club head. In general, the discretionary mass of the club head is strategically allocated throughout the club head to maximize the moment of inertia about the CG x-axis (Ixx) and the moment of inertia about the CG y-axis (Iyy). As discussed above, the angle of the weight assembly 214, 314 neutralizes the bending aspect of the club head at ball impact. Angling the weight assembly 214, 314 upwards from the sole 203, 303 helps control the bending rotation. Reduced bending allows support material, such as the removal of ribs and channel material to be removed or eliminated, thereby increasing discretionary mass that can be redistributed throughout the club head. Angled weight assemblies keep MOI similar to weight assemblies that are perpendicular to the z axis, but become more stable through impact. Described below are desirable moment of inertia values that provide high forgiveness.

The golf club head 200, 300 can comprise an MOI relative to the x-axis (Ixx). In some embodiments, the crown-to-sole moment of inertia Ixx can be greater than approximately 3000 g-cm$^2$, greater than approximately 3250 g-cm$^2$, greater than approximately 3500 g-cm$^2$, greater than approximately 3750 g-cm$^2$, greater than approximately 4000 g-cm$^2$, greater than approximately 4250 g-cm$^2$, greater than approximately 4500 g-cm$^2$, greater than approximately 4750 g-cm$^2$, or greater than approximately 5000 g-cm$^2$. In other embodiments, the crown-to-sole moment of inertia Ixx can range between 4000 to 6000 g-cm$^2$. In other embodiments, the crown-to-sole moment of inertia Ixx can range between 4000 to 5000 g-cm$^2$, or 5000 to 6000 g-cm$^2$. In some embodiments, the crown-to-sole moment of inertia Ixx can be 4000, 4100, 4200, 4300, 4400, 4500, 4600, 4700, 4800, 4900, 5000, 5100, 5200, 5300, 5400, 5500, 5600, 5700, 5800, 5900, or 6000 g-cm$^2$. In one exemplary embodiment, the Ixx is approximately 4043 g-cm$^2$. In another exemplary embodiment, the Ixx is approximately 4414 g-cm$^2$.

The golf club head 200, 300 can further comprise a MOI relative to the y-axis (Iyy). In some embodiments the heel-to-toe moment of inertia Iyy can be greater than approximately 4500 g-cm$^2$, greater than approximately 4750 g-cm$^2$, greater than approximately 5000 g-cm$^2$, greater than approximately 5250 g-cm$^2$, greater than approximately 5500 g-cm$^2$, greater than approximately 5750 g-cm$^2$, or greater than approximately 6000 g-cm$^2$. In other embodiments the heel-to-toe moment of inertia Iyy can range between 5000 and 7500 g-cm$^2$. In other embodiments, the heel-to-toe moment of inertia Iyy can range between 4500 to 5200 g-cm$^2$, or 5200 to 6000 g-cm$^2$. In some embodiments, the heel-to-toe moment of inertia Iyy can be 5000, 5100, 5200, 5300, 5400, 5500, 5600, 5700, 5800, 5900, 6000, 6100, 6200, 6300, 6400, 6500, 6600, 6700, 6800, 6900, 7000, 7100, 7200, 7300, 7400, or 7500 g-cm$^2$. In one exemplary embodiment, the Iyy is approximately 5182 g-cm$^2$. In another exemplary embodiment, the Iyy is approximately 5651 g-cm$^2$.

The golf club head 200, 300 can further comprise a combined MOI. The combined MOI can be defined as the sum of the crown-to-sole moment of inertia Ixx and the heel-to-sole moment of inertia Iyy. In some embodiments, the combined MOI can be greater than 8000 g-cm$^2$, greater than 8500 g-cm$^2$, greater than 9000 g-cm$^2$, greater than 9500 g-cm$^2$, greater than 10000 g-cm$^2$, greater than 11000 g-cm$^2$, greater than 11500 g-cm$^2$, or greater than 12000 g-cm$^2$. In other embodiments the combined MOI can be between 8000 g-cm$^2$ and 12000 g-cm$^2$. In some embodiments, the combined MOI can be between 8000 g-cm$^2$ and 8250 g-cm$^2$, 8250 g-cm$^2$ and 8500 g-cm$^2$, 8500 g-cm$^2$ and 8750 g-cm$^2$, 8750 g-cm$^2$ and 9000 g-cm$^2$, 9000 g-cm$^2$ and 9250 g-cm$^2$, 9250 g-cm$^2$ and 9500 g-cm$^2$, 9500 g-cm$^2$ and 9750 g-cm$^2$, 9750 g-cm$^2$ and 10000 g-cm$^2$, 10000 g-cm$^2$ and 10250 g-cm$^2$, 10250 g-cm$^2$ and 10500 g-cm$^2$, 10500 g-cm$^2$ and 10750 g-cm$^2$, 10750 g-cm$^2$ and 11000 g-cm$^2$, 11000 g-cm$^2$ and 11250 g-cm$^2$, 11250 g-cm$^2$ and 11500 g-cm$^2$, 11500 g-cm$^2$ and 11750 g-cm$^2$, or 11750 g-cm$^2$ and 12000 g-cm$^2$.

The golf club head 200, 300 can further comprise an MOI relative to the z-axis (Izz). In some embodiments the front-to-rear moment of inertia Izz can be great than approximately 2000 g-cm$^2$, greater than approximately 2250 g-cm 2, greater than approximately 2500 g-cm 2, greater than approximately 2750 g-cm$^2$, or greater than approximately 3000 g-cm$^2$. In other embodiments, the front-to-rear moment of inertia Izz can range between 2000 to 3500 g-cm$^2$. In some embodiments, the front-to-rear moment of inertia Izz can be 2000, 2100, 2200, 2300, 2400, 2500, 2600, 2700, 2800, 2900, 3000, 3100, 3200, 3300, 3400, or 3500 g-cm$^2$. In one exemplary embodiment, the Izz is approximately 2541 g-cm$^2$. In another exemplary embodiment, the Izz is approximately 2483 g-cm$^2$.

IV. EMBODIMENT 1

In one exemplary embodiment, the golf club head 200 comprises an angled weight channel 210 (hereafter alternately referred to as "the weight channel" or "the channel"). Further, the golf club head 200 can comprise a crown 202, a sole 203 opposite the crown 202, a strike face 204, a rear region 205 opposite the strike face 204, a heel end 206, and a toe end 207 opposite the heel end 206. Together, the strike face 204, the crown 202, the sole 203, the heel end 206, the toe end 207, and the rear region 205 form an enclosed hollow interior of the club head. The club head 200 can further comprise an angled weight channel 210 configured to receive a weight assembly 212. The weight channel 210 can be located in the rear region 205 of the golf club head 200.

The weight channel 210 can be defined by a plurality of surfaces. The weight channel 210 can be defined by a channel rear surface 219, a channel first surface 215, a channel second surface 216, a channel toe side surface 217 and a channel heel side surface 218. The weight channel 210 is open to the rear and the sole 203 of the golf club head such that when the weight member 211 is retained within the weight channel 210 at least a portion of the weight member back surface 225 is visible when viewed from the bottom and the rear.

The weight channel 210 further defines a weight channel depth, a weight channel height, and weight channel length. The weight channel depth is constant. The weight channel depth is between 0.1 inches and 2.0 inches. The weight channel height is variable. The weight channel height is between 0.1 inches and 2.0 inches. The weight channel length varies in a crown to sole direction. The weight channel length varies between 1.5 inches and 3.5 inches.

As discussed above, the weight channel 210 comprises a channel second surface 216. The channel second surface 216 is proximal to the sole 203. The channel second surface 216 is positioned a distance from the sole 203 of the golf club head. The distance between channel second surface 216 and the sole 203 is varies and can range between 0.10 inches and 0.20 inches.

Further, the rear surface 219 comprises a plurality of attachment points 227. The plurality of attachment points 227 comprise a plurality threaded recesses configured to receive a fastener 213. The plurality of attachment points 227 comprises three attachment points spaced equally along the channel. Each attachment point of the plurality of attachment points is positioned 0.6 inches apart. Further, the weight channel 210 comprises a central attachment point, a heel-side attachment point and a toe-side attachment point. Each of the toe-side, central, and heel-side attachment points comprise a circular cross section and an attachment point center.

As discussed above, the plurality of attachment points 227 consists of a threaded recess configured to receiver a fastener 213. Said fastener 213 removably secures the weight member 211 to the desired attachment point. The weight member 211 can further comprise a weight width, weight length, and weight height. The weight width, weight length, and weight height are similar to the weight channel width, weight channel length, and weight channel height ensuring a seam less transition between the weight channel, weight member, and golf club head. The weight width is 0.45 inches. The weight length is 1.65 inches. The weight height is 0.35 inches.

The weight member 211 can further comprise a weight mass wherein the weight mass ranges between 22 grams and 48 grams. The weight assembly can comprise a weight assembly mass wherein the weight assembly mass is between 27 grams and 48 grams.

The position of the weight member 211 as well as the mass can directly affect the MOI and CG. The CGx is −0.056 inches. The CGy is 0.842 inches. The CGz is −1.961 inches. The Ixx is approximately 4043 g-cm$^2$. The Iyy is approximately 5182 g-cm$^2$. The Izz is approximately 2541 g-cm$^2$.

The weight assembly can be positioned at an angle. The recess ground angle is 15 degrees. The first angle is 15 degrees. The second angle is 21 degrees. The rear angle is 107 degrees. The recess loft angle is 96 degrees. The first loft angle is 93 degrees. The second loft angle is 99 degrees. The first recess angle is 3 degrees. The second recess angle is 3 degrees. The rear recess angle is 90 degrees. The RGCG distance is 4.04 inches. The RGLE distance is 5.80 inches. The DWX is −0.142. The DWY is −0.610. The DWZ is −2.643 inches. The DFX is −0.198. The DFY is −0.820. The DFZ is −4.388 inches.

V. EMBODIMENT 2

In one exemplary embodiment, the golf club head 300 comprises an angled weight channel 310 (hereafter alternately referred to as "the weight channel" or "the channel"). Further, the golf club head 300 can comprise a crown 302, a sole 303 opposite the crown 302, a strike face 304, a rear region 305 opposite the strike face 304, a heel end 306, and a toe end 307 opposite the heel end 306. Together, the strike face 304, the crown 302, the sole 303, the heel end 306, the toe end 307, and the rear region 305 form an enclosed hollow interior of the club head. The club head 300 can further comprise an angled weight channel 310 configured to receive a weight assembly 312. The weight channel 310 can be located in the rear region 305 of the golf club head 300.

The weight channel 310 can be defined by a plurality of surfaces. The weight channel 310 can be defined by a channel rear surface 319, a channel first surface 315, a channel second surface 316, a channel toe side surface 317 and a channel heel side surface 318. The weight channel 310 is open to the rear and the sole 303 of the golf club head such that when the weight member 311 is retained within the weight channel 310 at least a portion of the weight member back surface 325 is visible when viewed from the bottom and the rear.

The weight channel 310 further defines a weight channel depth, a weight channel height, and weight channel length. The weight channel depth is constant. The weight channel weight depth is between 0.1 inches and 2.0 inches. The weight channel height is variable. The weight channel height is between 0.1 inches and 2.0 inches. The weight channel length vary in a crown to sole direction. The weight channel length varies between 1.5 inches and 3.5 inches.

As discussed above, the weight channel 310 comprises a channel second surface 316. The channel second surface 316 is proximal to the sole 303. The channel second surface 316 is positioned a distance from the sole 303 of the golf club head. The distance between channel second surface 316 and the sole 303 is vibrable and ranges between 0.10 inches and 0.20 inches.

Further, the rear surface 319 comprises a plurality of attachment points 327. The plurality of attachment points 327 comprise a plurality threaded recesses configured to receive a fastener 313. The plurality of attachment points 327 comprises three attachment points spaced equally along the channel. Each attachment point of the plurality of attachment points is positioned 0.6 inches apart. Further, the weight channel 310 comprises a central attachment point, a heel-side attachment point and a toe-side attachment point. Each of the toe-side, central, and heel-side attachment points comprise a circular cross section and an attachment point center.

As discussed above, the plurality of attachment points 327 consists of threaded recess configured to receiver a fastener 313. Said fastener 313 removably secures the weight member 311 to the desired attachment point. The weight member 311 can further comprise a weight width, weight length, and weight height. The weight width, weight length, and weight height are similar to the weight channel width, weight channel length, and weight channel height ensuring a seam less transition between the weight channel, weight member, and golf club head. The weight width is 0.42 inches. The weight length is 1.12 inches. The weight height is 0.41 inches.

The weight member 311 can further comprise a weight mass wherein the weight mass ranges between 22 grams and 48 grams. The weight assembly can comprise a weight assembly mass wherein the weight assembly mass is between 27 grams and 48 grams.

The position of the weight member 311 as well as the mass can directly affect the MOI and CG. The CGx is −0.057 inches. The CGy is 0.844 inches. The CGz is −1.989 inches. The Ixx is approximately 4414 g-cm$^2$. The Iyy is approximately 5651 g-cm$^2$. The Izz is approximately 2483 g-cm$^2$.

The weight assembly can be positioned at an angle. The recess ground angle is 45 degrees. The first angle is 45 degrees. The second angle is 50 degrees. The rear angle is 136 degrees. The recess loft angle is 125 degrees. The first loft angle is 122 degrees. The second loft angle is 128 degrees. The first recess angle is 3 degrees. The second recess angle is 3 degrees. The rear recess angle is 90 degrees. The RGCG distance is 4.04 inches. The RGLE distance is 5.80 inches. The DWX is −0.120. The DWY is −0.459. The DWZ is −2.612 inches. The DFX is −0.176. The DFY is −0.668. The DFZ is −4.349 inches.

VI. EXAMPLES

Example I

Comparison of Mass Properties Between Club Head Described Herein with 150 or 450 Angled Weight Channel and Control Club Head with 0° or 900 Weight Channel Example I provides a comparison between two embodiments of a traditional weight system and two embodiments of the angled weight system, as described above. More specifically, Example 1 discusses differences in CG and MOI between two traditional weight systems and two embodiments of the angled weight system described above, as shown in Table 1.

Figure 27:
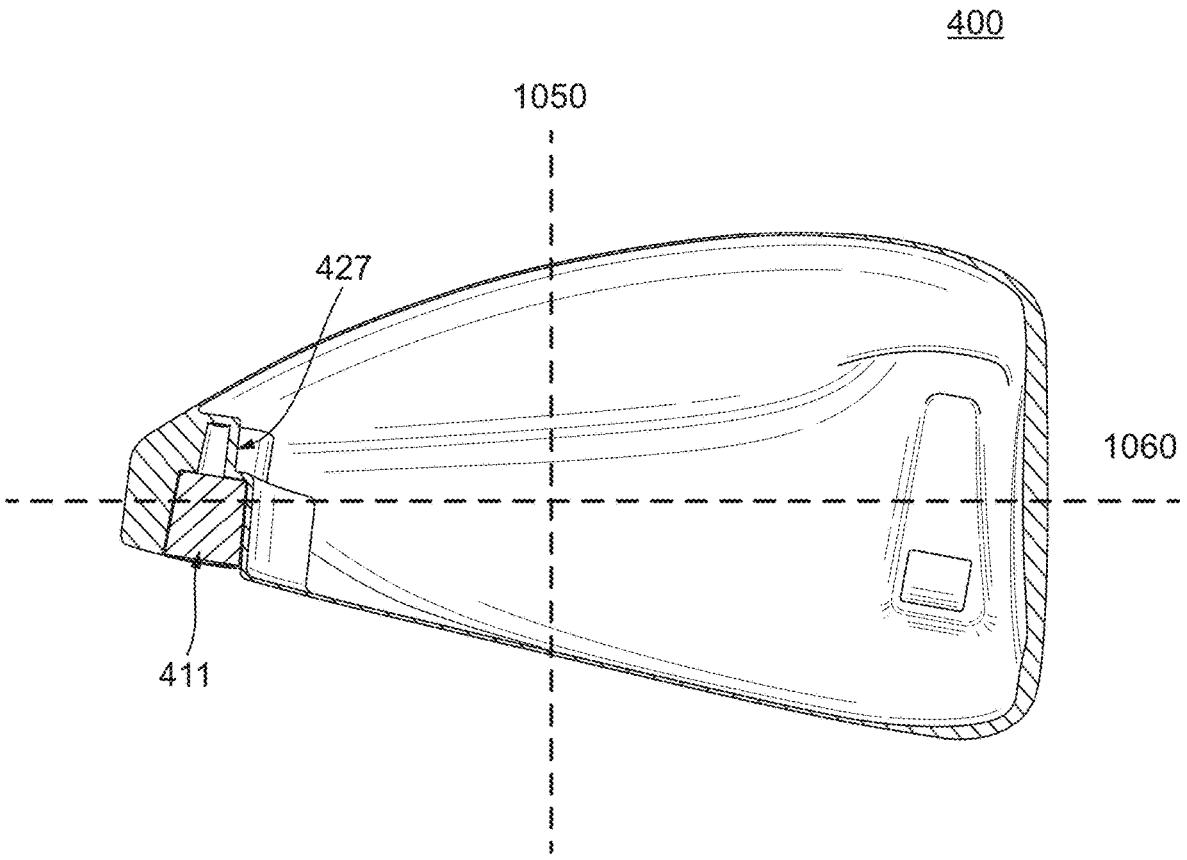
FIG. 27 illustrates a cross-sectional view of a golf club head according to a third embodiment.
Figure 28:
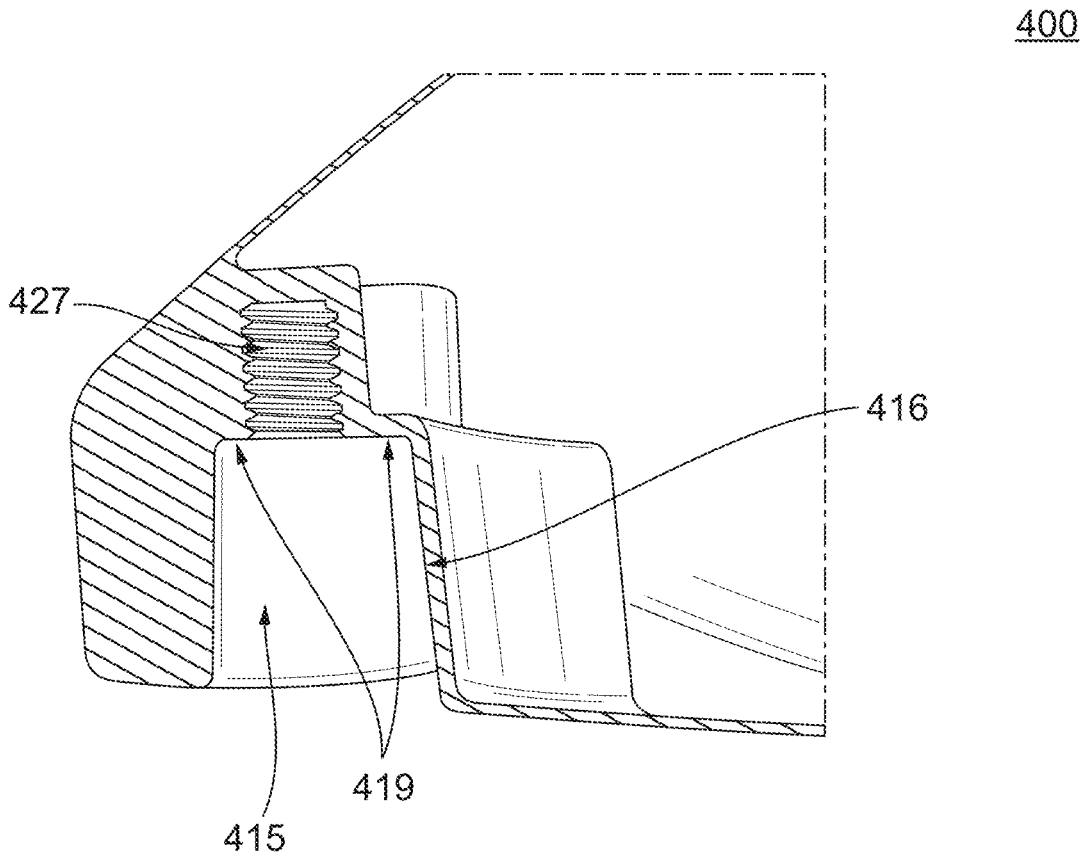
FIG. 28 illustrates a cross-sectional view of a weight channel according to a third embodiment.
Figure 29:
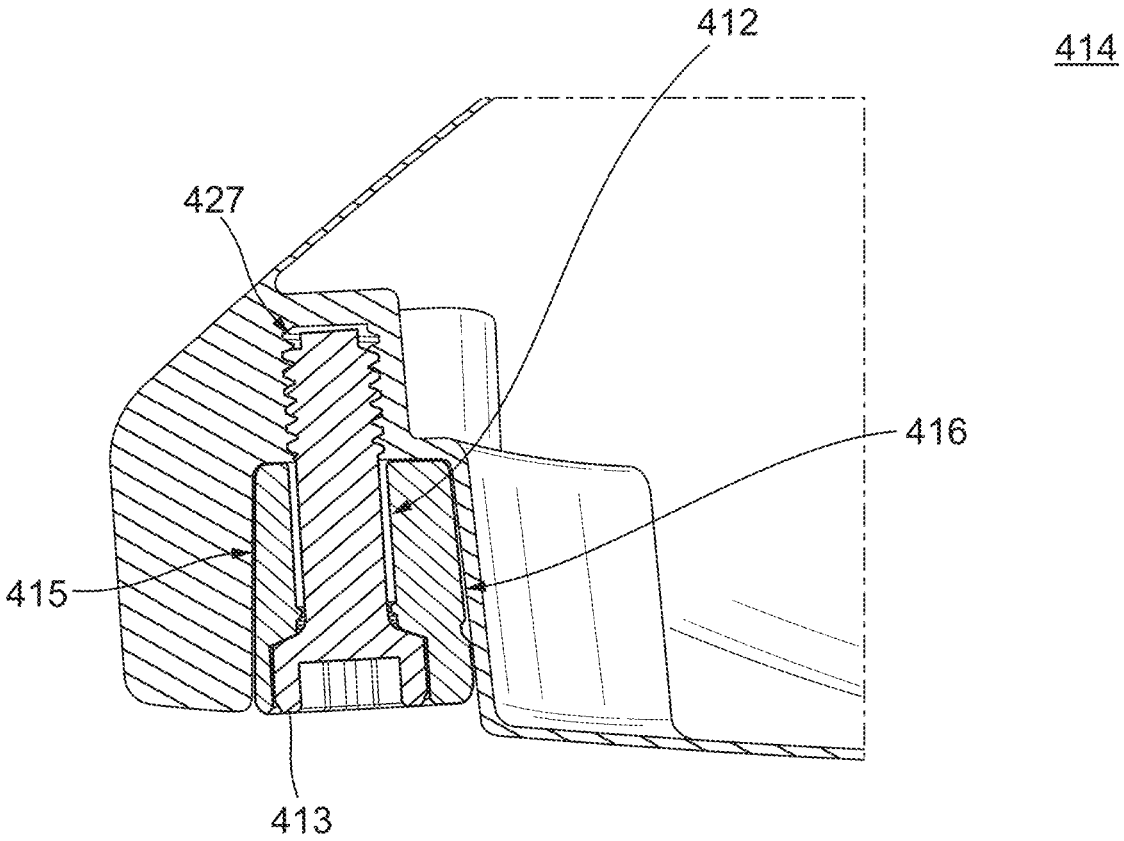
FIG. 29 illustrates a cross-sectional view of a weight assembly according to a third embodiment.

Described herein is a traditional driver type golf club head 100, as shown in FIGS. 1 and 2, comprising a first traditional weight channel 110 (hereafter referred to as "Control Club Head 1"), a second traditional weight channel 410 (hereafter referred to as "Control Club Head 2") as shown in FIGS. 27-29, a first exemplary embodiment consisting of a driver-type golf club head 200 comprising an angled weight channel 210 (hereafter referred to as "Exemplary Club Head 1") as shown in FIGS. 7-16, and a second exemplary embodiment consisting of a driver-type golf club head 300 comprising an angled weight channel 310 (hereafter referred to as "Exemplary Club Head 2") as shown in FIGS. 17-26. The Control Club Head 1 comprises a weight channel that is not angled (i.e. 0 degrees) relative to the ground plane 1010, at address. Control Club Head 2 comprises a weight channel that is perpendicular (i.e. 90 degrees) relative to the ground plane 1010, at address. Exemplary Club Head 1 comprises a weight channel that is angled at 15 degrees relative to the ground plane 1010, at address. Exemplary Club Head 2 comprises a weight channel that is angled at 45 degrees relative to the ground plane 1010, at address.

Control Club Head 1, Control Club Head 2, Exemplary Club Head 1, and Exemplary Club Head 2 each comprise similar body structure, volume, loft angle, and lie angle. A direct comparison highlighting differences in CG and MOI between the Control Club Head 1, Control Club Head 2, Exemplary Club Head 1, and Exemplary Club Head 2 can be seen below in Table 1.

TABLE 1

| | Control Club Head 1 | Control Club Head 2 | Exemplary Club Head 1 | Exemplary Club Head 2 |
|---|---|---|---|---|
| Recess Angle | 0 degrees | 90 degrees | 15 degrees | 45 degrees |
| CGx | −0.056 | −0.057 | −0.056 | −0.057 |
| CGy | 0.842 | 0.842 | 0.844 | 0.842 |
| CGz | −1.964 | −2.091 | −1.961 | −1.989 |
| MOIx | 4144 | 4670 | 4043 | 4414 |
| MOIy | 5293 | 5961 | 5182 | 5651 |
| MOIz | 2542 | 2559 | 2541 | 2483 |

As shown in Table 1, both Exemplary Club Head 1 and Exemplary Club Head 2 maintained desirable CG and MOI values, while providing improvements in structure material mass and total club head mass (detailed in Example II, below). In general, CG measurements of Exemplary Club Head 1 and Exemplary Club Head 2 are maintained within 6.2% of the CG of Control Club Head 1 and Control Club Head 2. Specifically, CGx of Exemplary Club Head 1 and Exemplary Club Head 2 are maintained within 0%-2% of the CGx of Control Club Head 1 and Control Club Head 2. Furthermore, CGy of Exemplary Club Head 1 and Exemplary Club Head 2 are maintained within 0%-0.2% of the CGy of Control Club Head 1 and Control Club Head 2. CGz of Exemplary Club Head 1 and Exemplary Club Head 2 are maintained with 0.2%-6.2% of the CGz of Control Club Head 1 and Control Club Head 2.

Similar to CG, MOI is also maintained in Exemplary Club Heads 1 and 2. MOI measurements of Exemplary Club Head 1 and Exemplary Club Head 2 are maintained within 13% of MOI of Control Club Head 1 and Control Club Head 2. Specifically, MOIx of Exemplary Club Head 1 and Exemplary Club Head 2 are maintained within 5.5%-13% of MOI of Control Club Head 1 and Control Club Head 2. MOIy of Exemplary Club Head 1 and Exemplary Club Head 2 are maintained within 2.1%-13% of MOI of Control Club Head 1 and Control Club Head 2. MOIz of Exemplary Club Head 1 and Exemplary Club Head 2 are maintained within 0.04%-3% of MOI of Control Club Head 1 and Control Club Head 2.

Example II

Comparison of Mass Between Club Head Described Herein with 150 and 450 Angled Weight Channel and Control Club Head with 0° and 900 Weight Channel Example II provides a comparison between two embodiments of a traditional weight system and two embodiments of the angled weight system, as described above. More specifically, Example II illustrates differences in mass of support material and total club head mass between two embodiments of traditional weight systems and two embodiments of the angled weight system described above, as shown below in Table 2.

Described herein is a traditional driver type golf club head 100 comprising a first traditional weight channel 110 (hereafter referred to as "Control Club Head 1"), a second traditional weight channel 410 (hereafter referred to as "Control Club Head 2"), a first exemplary embodiment consisting of a driver-type golf club head 200 comprising an angled weight channel 210 (hereafter referred to as "Exemplary Club Head 1"), and a second exemplary embodiment consisting of a driver-type golf club head 300 comprising an angled weight channel 310 (hereafter referred to as "Exemplary Club Head 2"). The Control Club Head 1 comprises a weight channel that is not angled (i.e. 0 degrees) relative to the ground plane 1010, at address. Control Club Head 2 comprises a weight channel that is perpendicular (i.e. 90 degrees) relative to the ground plane 1010, at address. Exemplary Club Head 1 comprises a weight channel that is angled at 15 degrees relative to the ground plane 1010, at address. Exemplary Club Head 2 comprises a weight channel that is angled at 45 degrees relative to the ground plane 1010, at address.

Control Club Head 1, Control Club Head 2, Exemplary Club Head 1, and Exemplary Club Head 2 each comprise similar body structure, volume, loft angle, and lie angle. A direct comparison highlighting differences in mass and impact reaction parameters between the Control Club Head 1, Control Club Head 2, Exemplary Club Head 1, and Exemplary Club Head 2 can be seen below in Table 2.

TABLE 2

| | Control Club Head 1 | Control Club Head 2 | Exemplary Club Head 1 | Exemplary Club Head 2 |
|---|---|---|---|---|
| Recess Angle | 0 degrees | 90 degrees | 15 degrees | 45 degrees |
| Total mass (g) | 144.91 | 158.96 | 143.31 | 152.00 |
| Mass of support material (g) | 7.06 | 21.11 | 5.47 | 14.15 |

Referencing Table 2, above, the different weight channel angles of Exemplary Club Head 1 and Exemplary Club Head 2 result in mass savings that increase discretionary mass and provide a preferable design for manufacturing. Reductions in total mass of the club head are resultant from minimization or removal of support material, in combination with a reduction in channel wall thicknesses. Exemplary Club Head 1 and Exemplary Club Head 2 are expected to maintain ball speed and maintain or improve launch, relative to Control Club Head 1 and Control Club Head 2.

As shown in Table 2, Exemplary Club Head 1 (15 degree weight channel angle) comprises substantially less support material, resulting in a reduction in club head mass. Specifically, Exemplary Club Head 1 comprises support material totaling only 5.47 g, as opposed to the 7.06 g required by Control Club Head 1 (0 degree weight channel angle), and the 21.11 g required by the Control Club Head 2 (90 degree weight channel angle). Exemplary Club Head 1 shows a 22.5% decrease in support material mass, relative to Control Club Head 1, and a 74% decrease in support material mass, relative to Control Club Head 2. This reduction in support material allows for an increase in discretionary mass that can be positioned strategically to improve performance characteristics.

As shown in Table 2, Exemplary Club Head 2 (45 degree angled weight channel) requires additional support material mass relative to Control Club Head 1 (0 degree angled weight channel), but requires less support material mass relative to Control Club Head 2 (90 degree angled weight channel). Exemplary Club Head 2 provided a desirable distribution of stress and weight member trajectory during and after impact with a golf ball, as detailed in Examples III and IV, below, while maintaining support material mass that is below the higher threshold of a traditional weight assembly, defined by Control Club Head 2.

Example III

Comparison of Stress Concentration Between Club Head Described Herein with 150 and 450 Angled Weight Channel and Control Club Head with 0° and 900 Weight Channel Example III provides a comparison between two embodiments of a traditional weight system and two embodiments of the angled weight system, as described above. More specifically, Example III illustrates differences in stress concentration during a first oscillation and a second oscillation following impact between two embodiments of traditional weight systems and two embodiments of the angled weight system described above, as shown below in FIGS. 30A-33B.

Figure 30B:
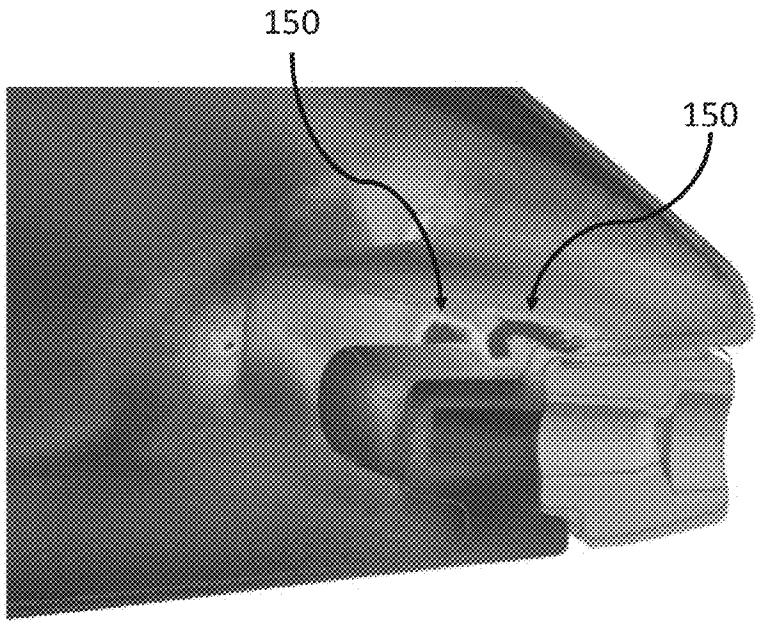
FIG. 30B illustrates a stress diagram of a second oscillation of the weight assembly of FIG. 1.
Figure 30A:
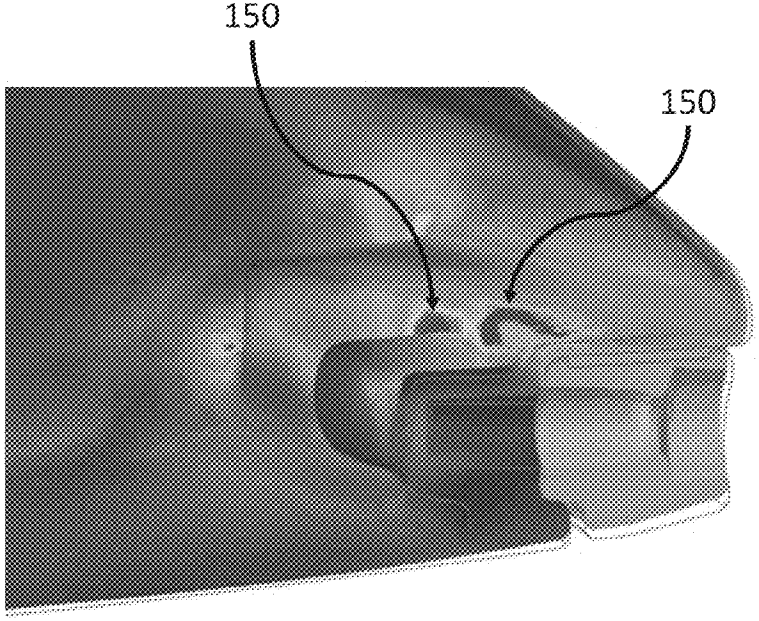
FIG. 30A illustrates a stress diagram of a first oscillation of the weight assembly of FIG. 1.

FIGS. 30A and 30B illustrate regions of greatest stress 150 within the weight channel 110 of Control Club Head 1 (0 degree angled weight channel) resulting from movement of the weight member 111, immediately following impact with a golf ball. FIG. 30A shows stress concentration during an initial oscillation of the weight member 111, and FIG. 30B shows stress concentration regions 150 during a second oscillation of the weight member 111. As shown in FIGS. 30A and 30B, stress is highly concentrated to particular regions upon the weight channel first surface 115 of the weight channel 110. Low dispersion of the stress results in greater cyclic fatigue with repeated use, thereby creating a high risk of failure over time. FIG. 30B shows that a second oscillation of the weight member results in stress being highly concentrated in the exact same regions 150 as the first oscillation, to a similar degree. This means that these regions are experiencing high levels of concentrated stress, repeatedly, with each oscillation of the weight member 111. This targeted stress concentration further increases risk of failure.

Figure 31B:
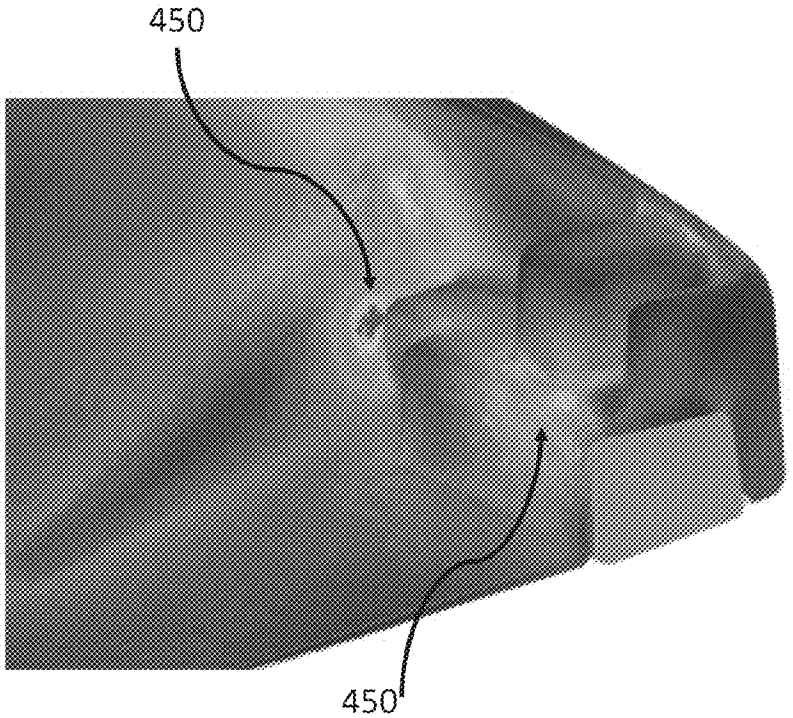
FIG. 31B illustrates a stress diagram of a second oscillation of the weight assembly of FIG. 29.
Figure 31A:
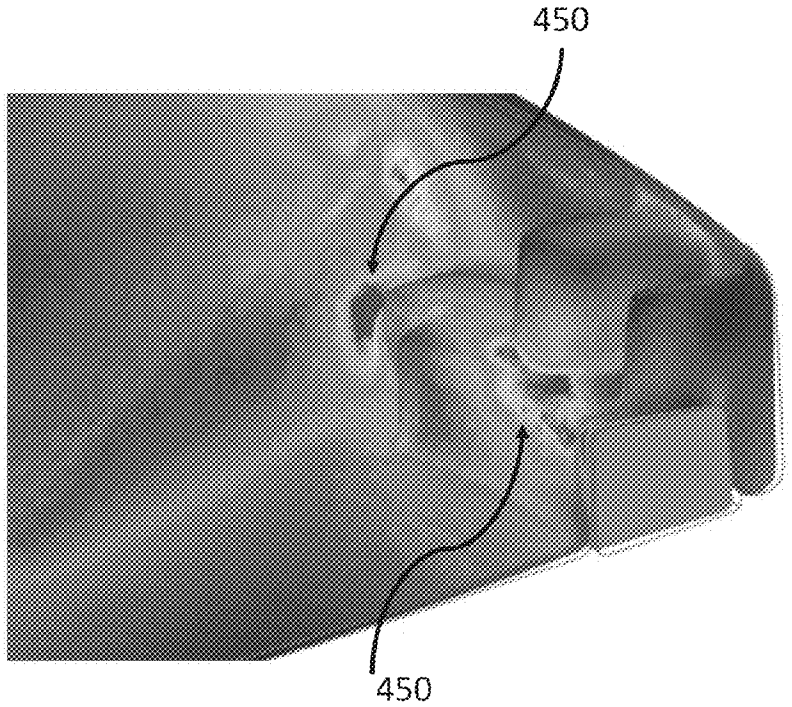
FIG. 31A illustrates a stress diagram of a first oscillation of the weight assembly of FIG. 29.

FIGS. 31A and 31B illustrate regions of greatest stress 450 within the weight channel of Control Club Head 2 (90 degree angled weight channel) resulting from movement of the weight member, immediately following impact with a golf ball. FIG. 31A shows stress concentration regions 450 during an initial oscillation of the weight member 411, and FIG. 31B shows stress concentration during a second oscillation of the weight member 411. Because of the significantly greater bulk of support material positioned around the weight member of Control Club Head 2, stress concentrates not only on the channel first surface 415, but also within joints of nearby internal structures of the club head. While this distribution lowers risk of failure as a result of increased stress dispersion relative to Control Club Head 1, it also indicates that trajectory of the weight member is both in forward direction (toward the strikeface), and also sideways, in a direction toward the toe. The side-to-side oscillations cannot provide the club head with a potential feel or performance benefit of a desirable forward and downward trajectory, and further can create vibrations which may result in undesirable sound and feel.

Because of the significantly greater bulk of support material positioned around the weight member 411 of Control Club Head 2, stress concentrated not only on the channel first surface 415, but also within joints of nearby internal structures of the club head. While this distribution lowered the risk of failure as a result of increased stress dispersion relative to Control Club Head 1, it also indicated that trajectory of the weight member 411 is both in forward direction (toward the strikeface), and also sideways, in a direction toward the toe. The side-to-side oscillations cannot provide the club head with a potential feel or performance benefit of a desirable forward and downward trajectory, and further can create vibrations, which may result in undesirable sound and feel.

Figure 32B:
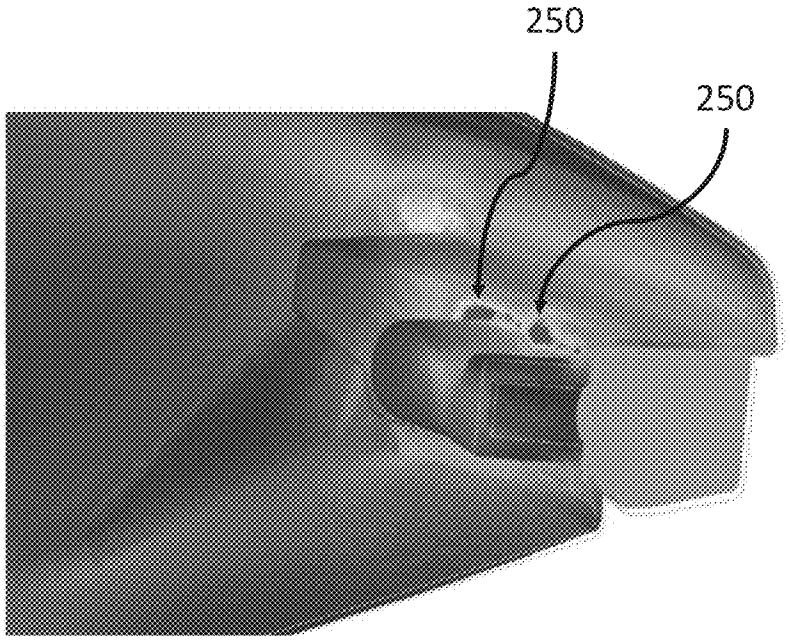
FIG. 32B illustrates a stress diagram of a second oscillation of the weight assembly of FIG. 9.
Figure 32A:
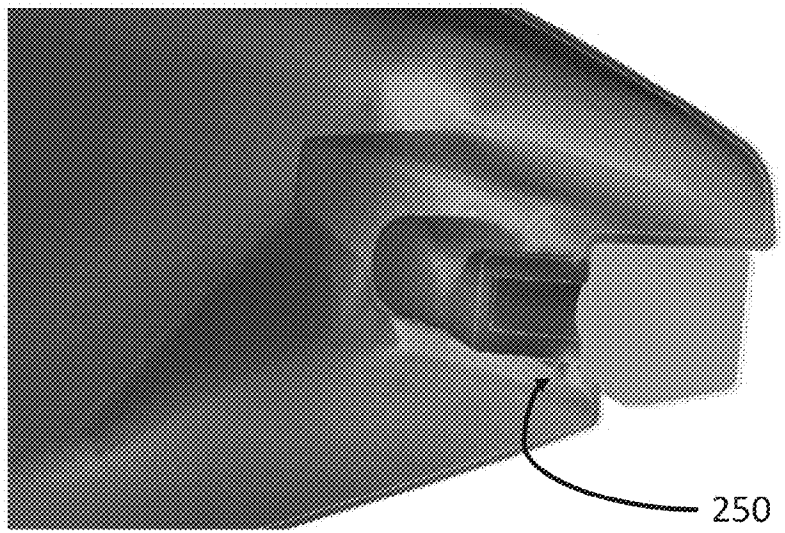
FIG. 32A illustrates a stress diagram of a first oscillation of the weight assembly of FIG. 9.

FIGS. 32A and 32B illustrate regions of greatest stress within the weight channel of Exemplary Club Head 1 (15 degree angled weight channel) resulted from movement of the weight member 211, immediately following impact with a golf ball. FIG. 32A shows stress concentration regions 250 during an initial oscillation of the weight member, and FIG. 32B shows stress concentration regions 250 during a second oscillation of the weight member. FIG. 32A shows that an initial oscillation of the weight member resulted in greatest stress being positioned on the channel second surface 216 of the weight channel 210.

In clear contrast to the stress concentration with subsequent oscillations of Control Club Head 1 and Control Club Head 2, FIG. 32B shows that a second oscillation of the weight member resulted in greatest stress being concentrated on a channel rear surface 219 of the weight channel 210. Because stress is being placed on each region 250 intermittently, cyclic fatigue is reduced by as much as half, thereby greatly reducing risk of failure over time.

Figure 33B:
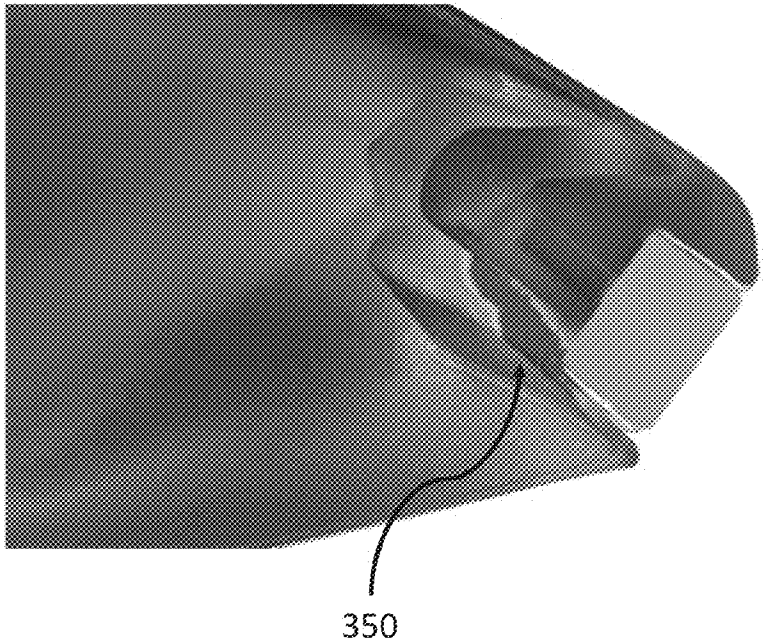
FIG. 33B illustrates a stress diagram of a second oscillation of the weight assembly of FIG. 19.
Figure 33A:
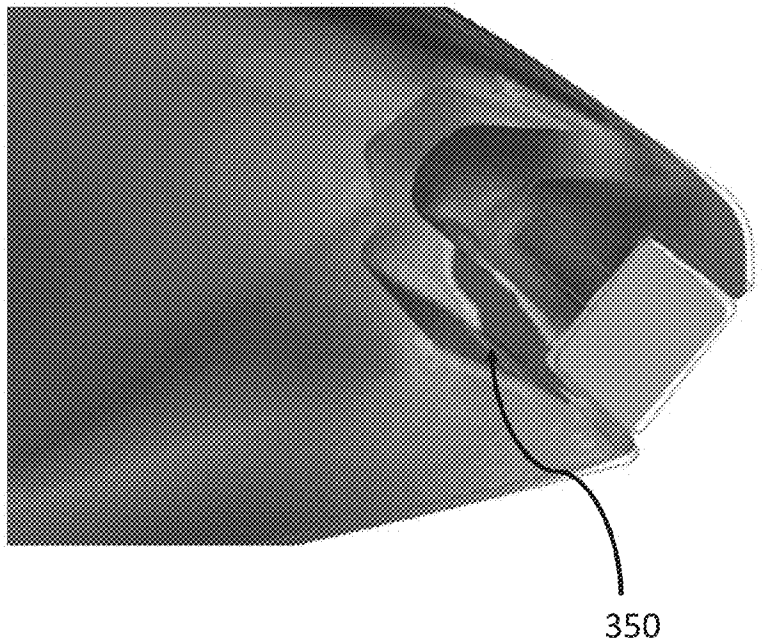
FIG. 33A illustrates a stress diagram of a first oscillation of the weight assembly of FIG. 19.

FIGS. 33A and 33B illustrate regions of greatest stress within the weight channel of Exemplary Club Head 2 (45 degree angled weight channel) resulted from movement of the weight member 311, immediately following impact with a golf ball. FIG. 33A shows stress concentration regions 350 during an initial oscillation of the weight member, and FIG. 33B shows stress concentration during a second oscillation of the weight member. FIG. 33A shows that both an initial oscillation and a second oscillation of the weight member resulted in greatest stress being positioned mostly on the channel rear wall 319, and partially on the channel second surface 316 of the weight channel 310. Stress was spread across the channel second surface 316 of the weight channel 310, in a direction from heel to toe, with great dispersion, thereby reducing risk of failure that would result from highly targeted and concentrated stresses. In addition, the channel first surface 315 of the weight channel 310, which saw the greatest volume of damage due to stress failure in practice, avoided relatively any stress concentration.

In conclusion, the intermittent nature of the regions of greatest stress with each oscillation of the weight member seen in the analysis of Exemplary Club Head 1, and the highly dispersed region of greatest stress seen in the analysis of Exemplary Club Head 2 resulted in decreased risk of failure in comparison with the targeted upper wall stress concentration seen in the analyses of Control Club Head 1 and Control Club Head 2.

Example IV

Comparison of Stress Concentration Between Club Head Described Herein with 150 and 450 Angled Weight Channel and Control Club Head with 0° and 900 Weight Channel Example IV provides a comparison between two embodiments of a traditional weight system and two embodiments of the angled weight system, as described above. More specifically, Example IV illustrates differences in displacement in two directions during initial response in the first 0.00020 seconds following impact with a golf ball between two embodiments of traditional weight systems and two embodiments of the angled weight system described above, as shown below in FIGS. 34 and 35.

Figure 34:
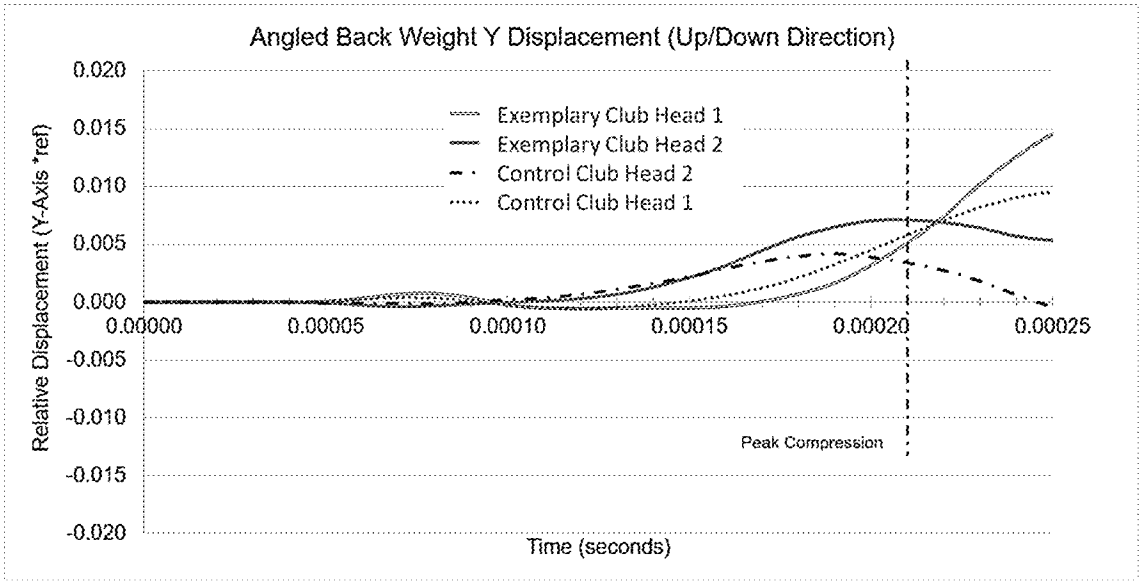
FIG. 34 illustrates a graph depicting the Y-Displacement of the weight with respect to time.

FIG. 34 shows that the immediate response of the weight member 211 of Exemplary Club Head 1 (15 degree angled weight channel) during impact with a golf ball caused the weight member to shift in a direction toward the club head crown (seen from 0.00005 seconds to 0.00010 seconds). While this upward trajectory can create stress on the channel first surface 215, as was demonstrated by the analysis of Example III, detailed above, a second oscillation of the weight member 211 caused it to shift such that it moves in a downward direction. This pendulum-like movement created the intermittent stress concentration discussed in the analysis of Example III, and results in a reduction in cyclic fatigue.

FIG. 34 shows that the immediate response of the weight member 311 of Exemplary Club Head 2 (45 degree angled weight channel) during impact with a golf ball caused the weight member to shift in a downward direction. This trajectory resulted in the channel rear surface 319 and channel second surface 316 regions of greatest stress demonstrated in the analysis of Example III. This downward trajectory has potential to provide a performance benefit by dynamically shifting CG downward and forward during impact. As detailed in Example III, above, the downward trajectory also resulted in the region of greatest stress being positioned within the weight channel on walls other than the channel first surface 315, and therefore, away from the region of greatest volume of failure, as seen in practice.

FIG. 34 shows that neither of Control Club Head 1 weight member nor Control Club Head 2 weight member provide a downward trajectory in either of the first oscillation or the second oscillation. In conclusion, the trajectories seen in a first movement of the weight member and a second movement of the weight member of Exemplary Club Heads 1 and 2 resulted reductions of stress concentration, and therefore reductions in failure risk, when compared with Control Club Heads 1 and 2.

Figure 35:
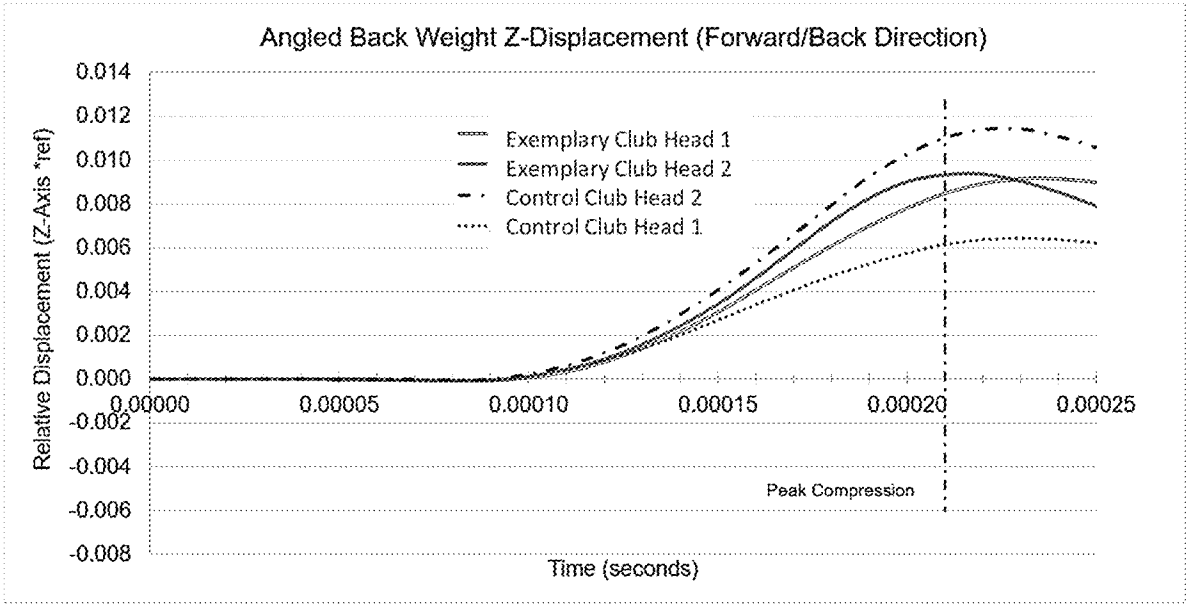
FIG. 35 illustrates a graph depicting the Z-Displacement of the weight with respect to time.

FIG. 35 shows Exemplary Club Head 1 and Exemplary Club Head 2 demonstrate a weight member movement in a forward direction to a greater degree than that of Control Club Head 1 and a lesser degree than that of Control Club Head 2. The greater magnitude of this forward movement provides a trade-off, wherein a greater displacement can increase stress concentration on the weight channel wall(s), but a greater displacement also has potential to provide a performance benefit by dynamically shifting CG forward during impact, possibly increasing power or launch. Both of Exemplary Club Head 1 and Exemplary Club Head 2 fall within a range bound by the Control Club Head 1 and Control Club Head 2, potentially creating a better balance between stress concentration and dynamic CG.

In conclusion, the weight member displacement illustrated by the analysis of Example IV provides benefits and failure risk reductions in a similar manner to those provided by the stress distribution with each weight member oscillation discussed in Example III. The potential for a downward and forward trajectory of the weight member of Exemplary Club Head II may provide a performance benefit, as discussed above. The lesser degree of forward trajectory of the weight member of Exemplary Club Head I results in a lesser degree of stress concentration, and therefore, a lower risk of failure.

CLAUSES

Clause 1. A golf club head comprising: a body comprising a strike face, a rear region, a crown, a sole, a toe end, and a heel end; an XYZ coordinate system; wherein an origin for the XYZ coordinate system is defined at a center point of a leading edge of the club head, the XYZ coordinate system having an x-axis, a y-axis, a z-axis; wherein; a horizontal x-axis extending from the heel to the toe; a vertical y-axis extending from the sole to the crown; a horizontal z-axis extending from the strikeface to the rear; a ground plane is perpendicular to the y-axis and tangent to the sole at the address position; and a weight assembly associated with the rear region of the body, the weight assembly comprising: a weight member; a weight channel sized to receive the weight, the weight channel comprising: a channel first surface; a channel second surface; a channel rear surface extending between the channel first surface and the channel second surface, the channel rear surface defining a plurality of attachment points; and a fastener configured to detachably couple the weight to each of the attachment points; wherein the weight assembly defines an assembly angle along which the weight assembly is oriented when coupled to one of the attachment locations; and wherein the assembly angle extends at an angle of 5-70 degrees relative to the ground plane.

Clause 2. The golf club head of clause 1, wherein the weight assembly is not visible at an address position.

Clause 3. The golf club head of clause 1, wherein the weight assembly has a mass in the range of 20 grams to 50 grams.

Clause 4. The golf club head of clause 1 wherein; the plurality of attachment locations are three threaded recesses; wherein the three apertures are a toe-side recess, a central recess, and a heel-side recess.

Clause 5. The golf club head of clause 4 wherein; when the weight assembly is affixed to the toe side aperture, the weight assembly comprises a toe-side fastener axis; when the weight assembly is affixed to the central aperture, the weight assembly comprises a central fastener axis; when the weight assembly is affixed to the heel side aperture, the weight assembly comprises a heel-side fastener axis.

Clause 6. The golf club head of clause 1, wherein the weight channel further comprises a weight channel height measured between the first surface and the second surface.

Clause 7. The golf club head of clause 6, wherein the comprises a weight channel length measured between the toe side wall and the heel side wall; and wherein the weight channel height is varied along the weight channel length.

Clause 8. The golf club head of clause 1, wherein the weight assembly is offset from the ground plane at an angle of 15 degrees.

Clause 9. The golf club head of clause 1, wherein the weight assembly is offset from the ground plane at an angle between 10 degrees and 20 degrees.

Clause 10. The golf club head of clause 1, wherein the assembly angle is the recess ground angle.

Clause 11. The golf club head of clause 10, wherein the recess ground angle is between 10-45 degrees.

Clause 12. The golf club head of clause 1, wherein the assembly angle is the first angle.

Clause 13. The golf club head of clause 12, wherein the first angle is between 10-45 degrees.

Clause 14. The golf club head of clause 1, wherein the assembly angle is the second angle.

Clause 15. The golf club head of clause 14, wherein the second angle is between 15-70 degrees.

Clause 16. The golf club head of clause 1, wherein the strike face defines a loft plane that is tangent to the geometric center of the strike face.

Clause 17. The golf club head of clause 16, wherein the channel first surface can form a first loft angle with the loft plane.

Clause 18. The golf club head of clause 17, wherein the first loft angle is between 85-135 degrees.

Clause 19. The golf club head of clause 16, wherein the channel second surface can form a second loft angle with the loft plane.

Clause 20. The golf club head of clause 19, wherein the second loft angle is between 85-135 degrees.

Clause 21. The golf club head of clause 4, wherein: the strike face defines a loft plane that is tangent to the geometric center of the strike face; and a recess axis is defined as an axis running through the geometric center of the central recess.

Clause 22. The golf club head of clause 21, wherein the recess axis can form a recess loft angle with the loft plane.

Clause 23. The golf club head of clause 22, wherein the recess loft angle is between 85-135 degrees.

Clause 24. The golf club head of clause 4, wherein a recess axis is defined as an axis running through the geometric center of the central recess.

Clause 25. The golf club head of clause 24, wherein the recess axis can form a first recess angle with the channel first surface.

Clause 26. The golf club head of clause 25, wherein the first recess angle can be between 0-15 degrees.

Clause 27. The golf club head of clause 24, wherein the recess axis can form a second recess angle with the channel second surface.

Clause 28. The golf club head of clause 27, wherein the second recess angle can be between 0-6 degrees.

Clause 29. The golf club head of clause 24, wherein the recess axis can form a rear recess angle with the channel second surface.

Clause 30. The golf club head of clause 29, wherein the second recess angle can be between 80-100 degrees.

Clause 31. The golf club head of clause 24, wherein the recess axis can intersect the ground plane defining an RG point.

Clause 32. The golf club head of clause 31, wherein the RG point is spaced from a center of gravity at a distance between 2.75-4.25 inches.

Clause 33. The golf club head of clause 31, wherein the RG point is spaced from the leading edge of the club head at a distance between 4.6-6.0 inches.

Clause 34. The golf club head of clause 1, wherein the weight member can be positioned at a distance from a center of gravity relative to the x-axis, known as DWX.

Clause 35. The golf club head of clause 1, wherein the weight member can be positioned at a distance from a center of gravity relative to the y-axis, known as DWY.

Clause 36. The golf club head of clause 1, wherein the weight member can be positioned at a distance from a center of gravity relative to the z-axis, known as DWZ.

Clause 37. The golf club head of clause 34, wherein the DWX is between −0.155 to −0.115 inches.

Clause 38. The golf club head of clause 34, wherein the DWY is between −0.620 to −0.440 inches.

Clause 39. The golf club head of clause 34, wherein the DWZ is between −2.625 to −2.500 inches.

Clause 40. The golf club head of clause 1, wherein the weight member can be positioned at a distance from a strike face geometric center relative to the x-axis, known as DFX.

Clause 41. The golf club head of clause 1, wherein the weight member can be positioned at a distance from a strike face geometric center relative to the y-axis, known as DFY.

Clause 41. The golf club head of clause 1, wherein the weight member can be positioned at a distance from a strike face geometric center relative to the z-axis, known as DFZ.

Clause 42. The golf club head of clause 34, wherein the DFX is between −0.210 to −0.150 inches.

Clause 44. The golf club head of clause 34, wherein the DFY is between −0.850 to −0.650 inches.

Clause 43. The golf club head of clause 34, wherein the DFZ is between −4.450 to −4.300 inches.

Clause 46. The golf club head of clause 1 wherein; the weight member comprises: an interior surface configured to conform to the channel first surface and the channel second surface; a weight back surface; a weight front surface; a weight first surface; a weight second surface; a weight toe surface; and a weight heel surface; wherein the weight member is configured to detachably affix to the weight channel at each of the plurality of attachment points such that the weight front surface is exposed at the rear region, and the weight second surface is at least partially exposed at the sole.

Clause 46. The golf club head of clause 16, wherein the weight member lower surface comprises an indent configured to receive the slot bottom surface.

Clause 48. The golf club head of clause 24, wherein the channel first surface is parallel with the recess axis.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

The invention claimed is:

1. A golf club head comprising:

a body comprising a strike face, a rear region, a crown, a sole, a toe end, and a heel end;

an XYZ coordinate system having an origin located at a center point of a leading edge of the golf club head, the XYZ coordinate system comprising:

a horizontal x-axis extending from the heel end to the toe end;

a vertical y-axis extending from the sole to the crown;

a horizontal z-axis extending from the strike face to the rear region;

wherein:

a ground plane is perpendicular to the vertical y-axis and tangent to the sole at an address position; and a weight assembly is associated with the rear region of the body, the weight assembly comprising:

a weight member;

a weight channel sized to receive the weight member, the weight channel comprising:

a channel first surface;

a channel second surface;

a channel rear surface extending between the channel first surface and the channel second surface, the channel rear surface defining a plurality of attachment points; and a fastener configured to detachably couple the weight member to each of the attachment points;

wherein the weight assembly defines an assembly angle along which the weight assembly is oriented when coupled to one of the plurality of attachment points;

wherein the assembly angle extends at an angle of 5-70 degrees relative to the ground plane and extends upwardly in a direction from the ground plane to the crown;

wherein the strike face defines a loft plane that is tangent to geometric center of the strike face;

wherein the channel first surface can form a first loft angle relative to the loft plane; and wherein the first loft angle is between 85-135 degrees.

2. The golf club head of claim 1, wherein the weight assembly is not visible at an address position.

3. The golf club head of claim 1, wherein the weight assembly has a mass between 20 grams and 50 grams.

4. The golf club head of claim 1 wherein;

the plurality of attachment points comprise three threaded recesses;

wherein the three threaded recesses are a toe-side recess, a central recess, and a heel-side recess.

5. The club head of claim 4, wherein a recess axis is defined as an axis running through the geometric center of the central recess.

6. The golf club head of claim 5, wherein the recess axis can form a recess loft angle with the loft plane.

7. The golf club head of claim 6, wherein the recess loft angle is between 85-135 degrees.

8. The golf club head of claim 5, wherein the recess axis intersects the ground plane at an RG point.

9. The golf club head of claim 8, wherein the golf club head defines a center of gravity and the RG point is spaced from the center of gravity by a distance of between 2.75-4.25 inches.

10. The golf club head of claim 8, wherein the RG point is spaced from the leading edge of the golf club head by a distance of between 4.6-6.0 inches.

11. The golf club head of claim 1, wherein the weight member can be positioned at a distance from a center of gravity relative to the horizontal x-axis, known as DWX.

12. The golf club head of claim 11, wherein the DWX is between −0.155 to −0.115 inches.

13. The golf club head of claim 1, wherein the weight member can be positioned at a distance from a center of gravity relative to the vertical y-axis, known as DWY.

14. The golf club head of claim 13, wherein the DWY is between −0.620 to −0.440 inches.

15. The golf club head of claim 1, wherein the weight member can be positioned at a distance from a center of gravity relative to the horizontal z-axis, known as DWZ.

16. The golf club head of claim 15, wherein the DWZ is between −2.625 to −2.500 inches.

* * * * *